US005953993A

United States Patent [19]

Yasuhara

[11] Patent Number: 5,953,993

[45] Date of Patent: Sep. 21, 1999

[54] APPARATUS FOR DRIVING A CLAMPING DEVICE FOR FIXING A PLATE ON A PLATE CYLINDER OF A PRINTING MACHINE

[75] Inventor: Yoshihiro Yasuhara, Fuchu, Japan

[73] Assignee: Ryobi, Ltd., Hiroshima-ken, Japan

[21] Appl. No.: 09/042,058

[22] Filed: Mar. 13, 1998

[30] Foreign Application Priority Data

Mar. 27, 1997 [JP] Japan ..... 9-075666
Jan. 23, 1998 [JP] Japan ..... 10-011012

[51] Int. Cl.[6] ..... B41F 27/12

[52] U.S. Cl. ..... 101/415.1; 101/409

[58] Field of Search ..... 101/409, 415.1

[56] References Cited

U.S. PATENT DOCUMENTS 3,795,193 3/1974 Johne et al. ..... 101/415.1
3,903,795 9/1975 Suzuki ..... 101/409
4,759,290 7/1988 Höll et al. ..... 101/415.1
4,977,833 12/1990 Inage et al. ..... 101/415.1
5,052,299 10/1991 Kojima ..... 101/415.1
5,168,810 12/1992 Kojima ..... 101/415.1

FOREIGN PATENT DOCUMENTS 2-277639 11/1990 Japan .
4-13349 2/1992 Japan .
5-84216 12/1993 Japan .

*Primary Examiner*—Edgar Burr
*Assistant Examiner*—Leslie J. Grohusky
*Attorney, Agent, or Firm*—Merchant & Gould, P.C.

[57] ABSTRACT

A leading edge side shaft 6, a tail edge side shaft 12 and a pulling shaft 14 are interlocked with one another through gears. The gears are rotated by using rotation of the plate cylinder. A leading edge side part 10*a* of the plate 10 is clamped with a leading edge side clamp 4 in accordance with the rotation of the leading edge side shaft 6. Thereafter, a tail edge side part 10*b* of the plate 10 disposed on the cylinder surface of the plate cylinder 60 is clamped with a tail edge side clamp 5. The plate 10 is pulled in a plate tensioning direction as a result of moving the tail edge side clamp 5 in the direction of the arrow 90 in accordance with the rotation of the pulling shaft 14.

11 Claims, 35 Drawing Sheets

<FIRST EMBODIMENT>

<FIRST EMBODIMENT>

<FIRST EMBODIMENT>

<FIRST EMBODIMENT>

<FIRST EMBODIMENT>

<FIRST EMBODIMENT>

<FIRST EMBODIMENT>

<FIRST EMBODIMENT>

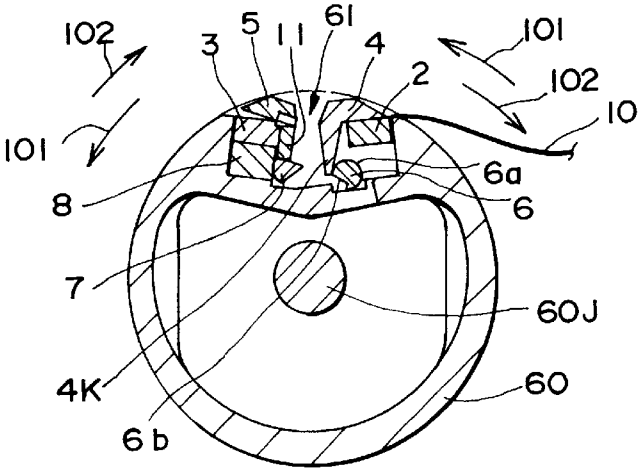
FIG.8C <FIRST EMBODIMENT>
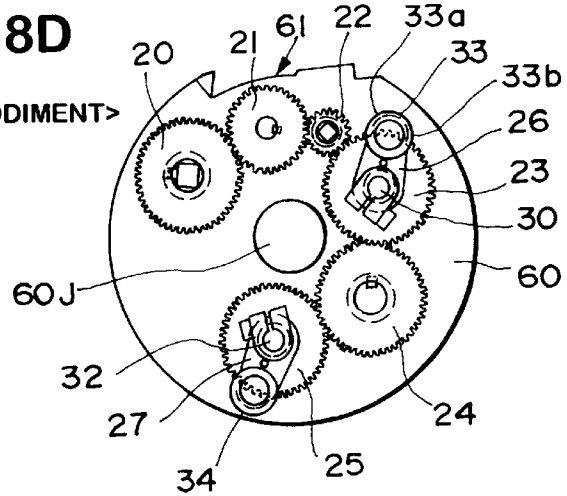
FIG.8D <FIRST EMBODIMENT>
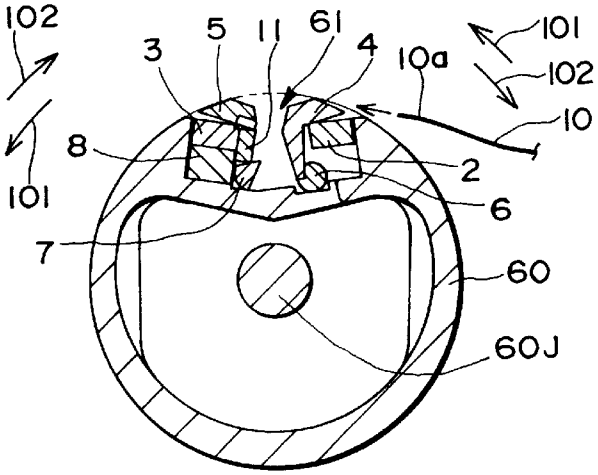
FIG.8A <FIRST EMBODIMENT>
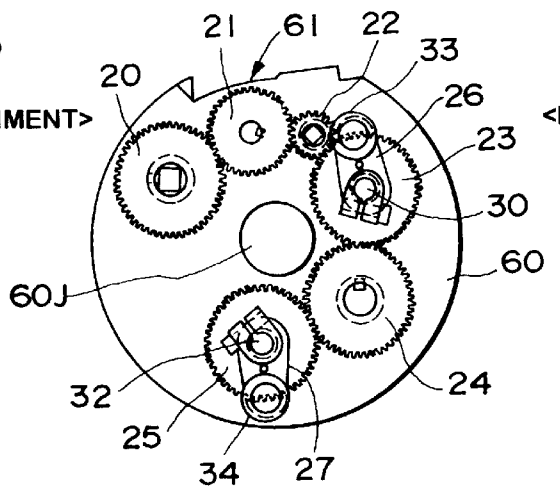
FIG.8B <FIRST EMBODIMENT>

<FIRST EMBODIMENT>

<FIRST EMBODIMENT>

<FIRST EMBODIMENT>

<FIRST EMBODIMENT>

<SECOND EMBODIMENT>

<SECOND EMBODIMENT>

<THIRD EMBODIMENT>

<FOURTH EMBODIMENT>

<FOURTH EMBODIMENT>

<FOURTH EMBODIMENT>

<FIFTH EMBODIMENT>

<FIFTH EMBODIMENT>

<FIFTH EMBODIMENT>

<FIFTH EMBODIMENT>

<FIFTH EMBODIMENT>

<FIFTH EMBODIMENT>

<FIFTH EMBODIMENT>

FIG.21A <FIFTH EMBODIMENT>
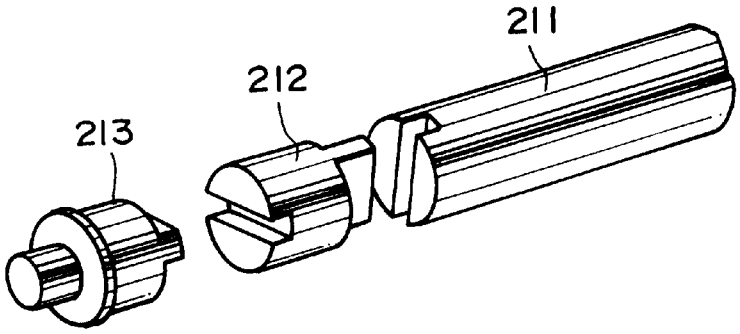
FIG.21B <FIFTH EMBODIMENT>
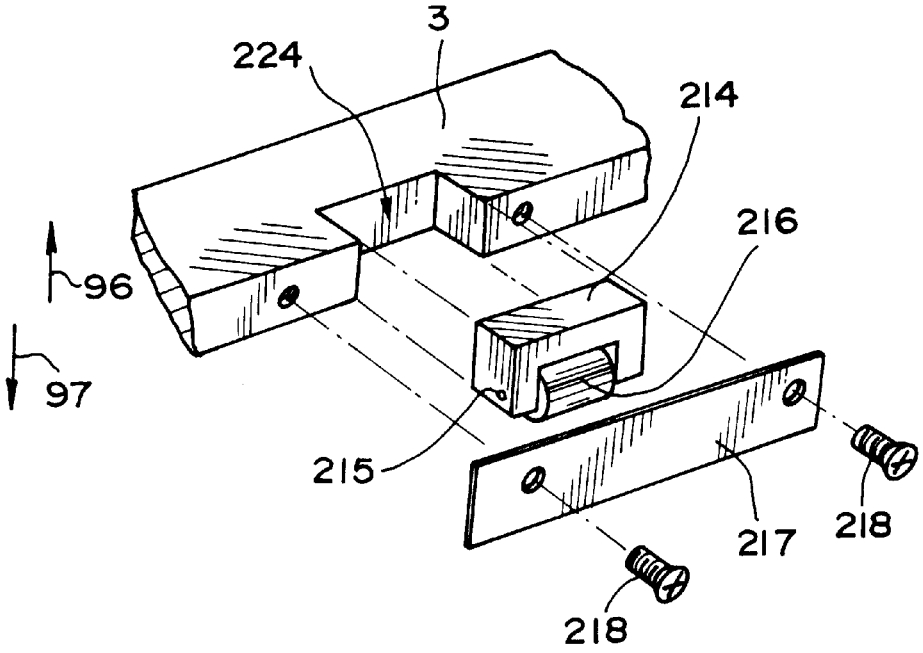

<SIXTH EMBODIMENT>

<SIXTH EMBODIMENT>

<SIXTH EMBODIMENT>

FIG.27 <SIXTH EMBODIMENT>
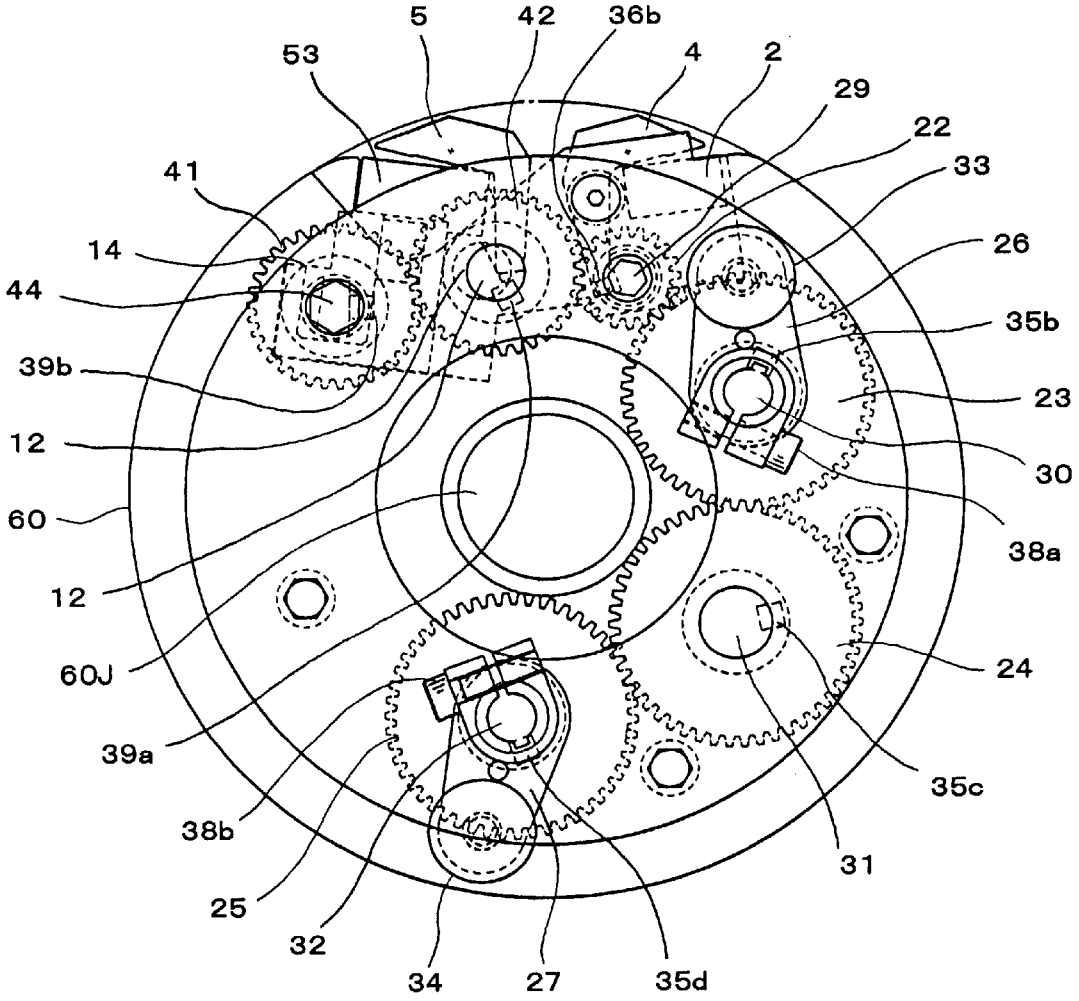

<SIXTH EMBODIMENT>

FIG.29A <SIXTH EMBODIMENT>
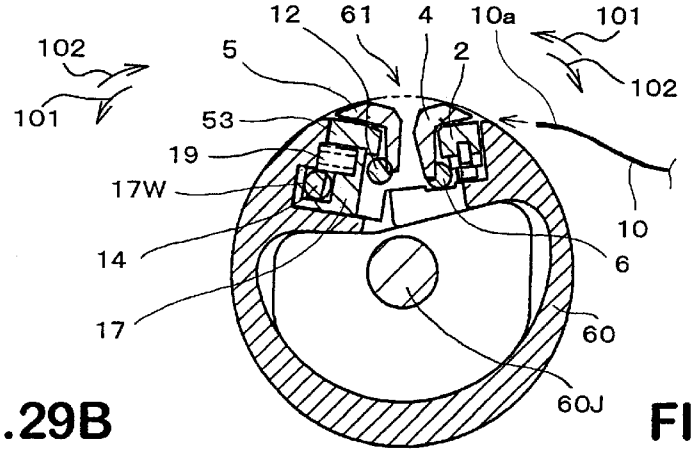
FIG.29B <SIXTH EMBODIMENT>
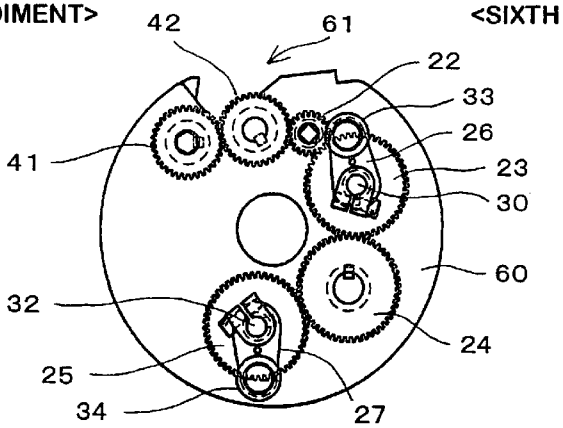
FIG.29C <SIXTH EMBODIMENT>
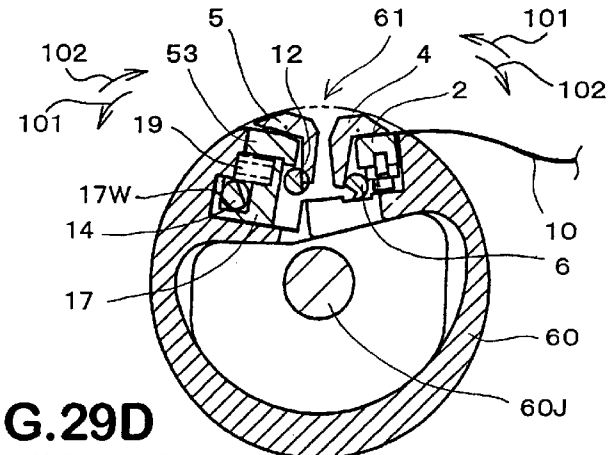
FIG.29D <SIXTH EMBODIMENT>
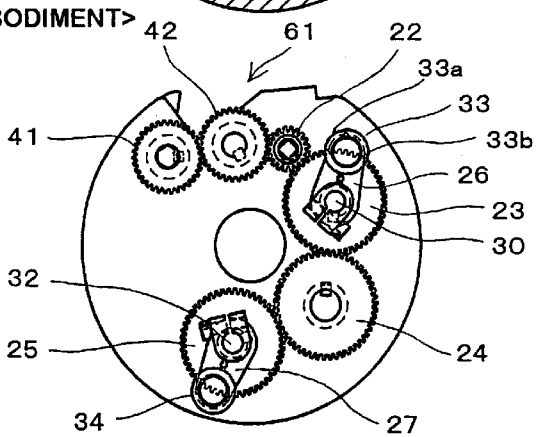

<SIXTH EMBODIMENT>

<SIXTH EMBODIMENT>

<SIXTH EMBODIMENT>

<SIXTH EMBODIMENT>
101
102
2
4
5
6
10
10b
12
14
17
17W
19
22
23
24
25
26
27
30
32
33
33a
33b
34
41
42
53
60
60J
61
90
91

<PRIOR ART>

FIG.32A <PRIOR ART>
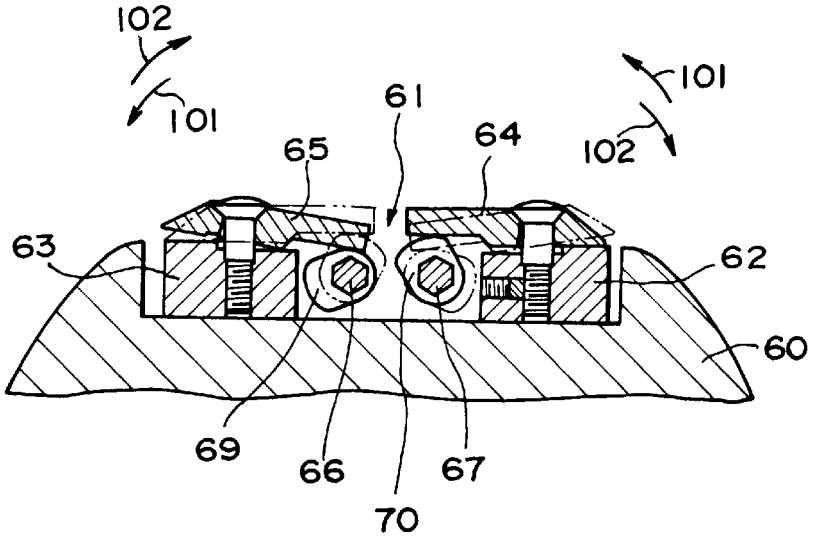
FIG.32B <PRIOR ART>
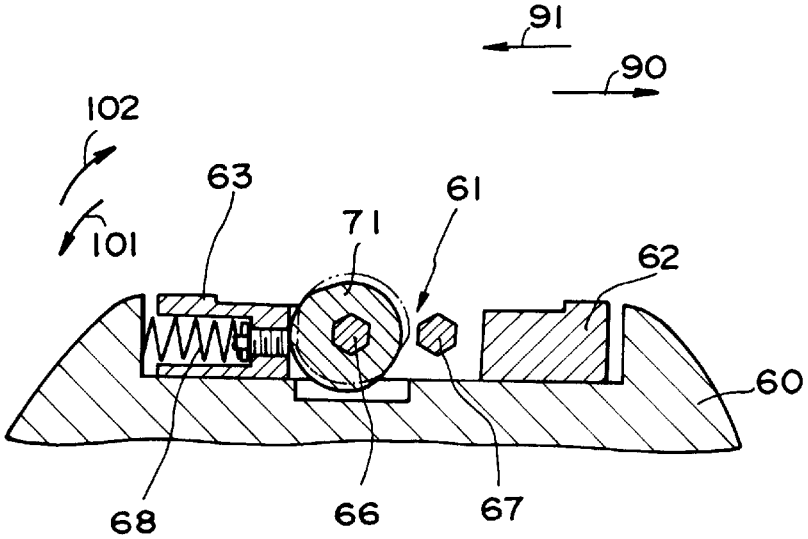

<PRIOR ART>

FIG.34A <PRIOR ART>
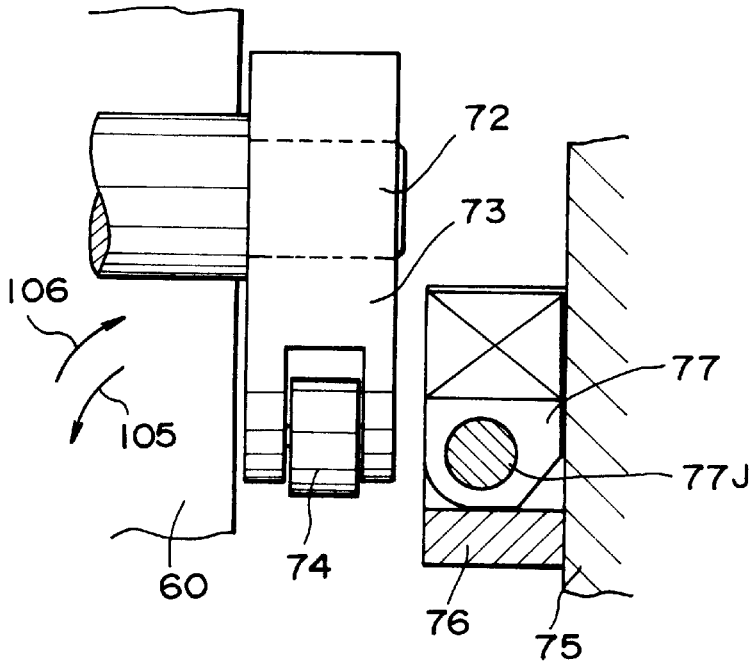
FIG.34B <PRIOR ART>
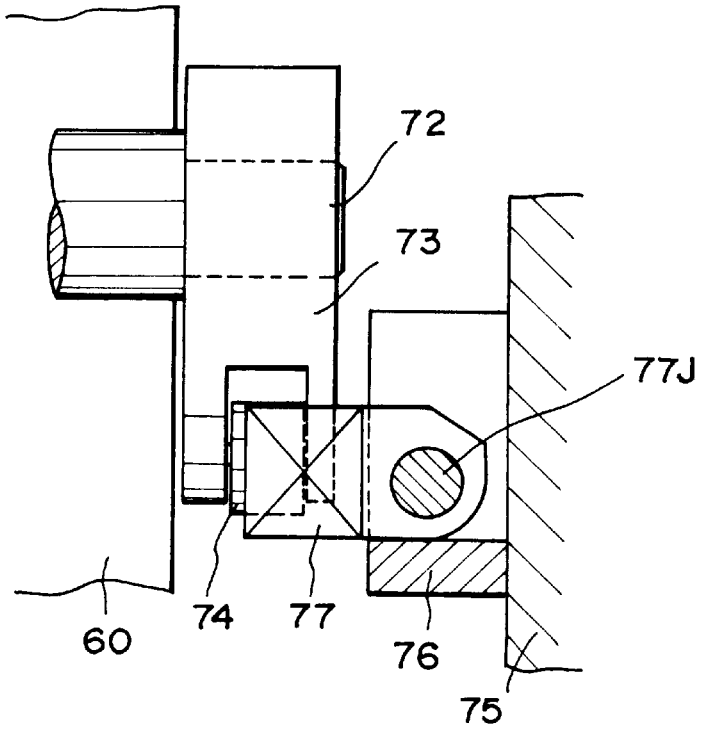

FIG.35 <PRIOR ART>
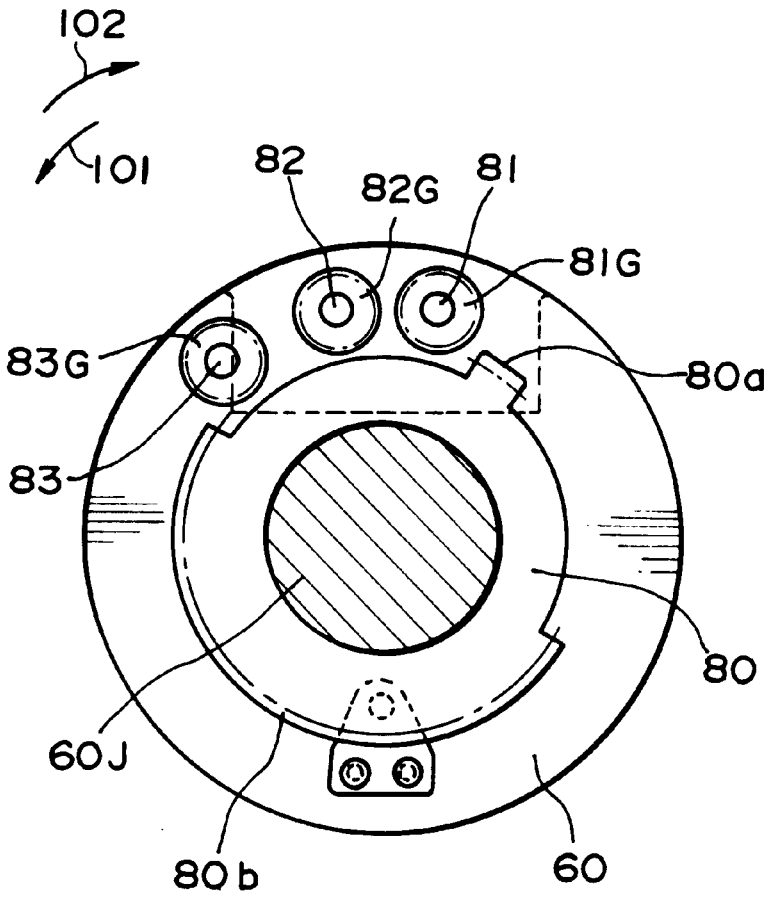

APPARATUS FOR DRIVING A CLAMPING DEVICE FOR FIXING A PLATE ON A PLATE CYLINDER OF A PRINTING MACHINE

CROSS-REFERENCE TO RELATED APPLICATIONS

This application is based on Application No. Hei 9-75666 filed on Mar. 27, 1997 and Application No. Hei 10-11012 filed on Jan. 23, 1998 both of which filed in Japan, the contents of both the applications are incorporated hereinto by reference.

1. Field of the Invention

The present invention relates to a structure of an apparatus for driving a clamping device for fixing printing a plate on a plate cylinder of a printing machine; more specifically, an apparatus for driving a clamping apparatus of a plate for a printing machine which controls clamping of the plate and fixing of the plate.

2. Description of the Prior Art

The overall structure of a plate cylinder 60 is shown in FIG. 31. FIG. 31 is a partial sectional view of the plate cylinder 60. A cut-out part 61 is formed in the plate cylinder 60, and both a leading edge side clamping base 62 and a tail edge side clamping base 63 are provided in the cut-out part 61. Further, a leading edge side clamp 64 is located on the leading edge side clamping base 62, and a tail edge side clamp 65 is positioned on the tail edge side clamping base 63. Both the leading edge side clamp 64 and the tail edge side clamp 65 can be opened and closed in both directions shown by arrow 101 and 102 respectively to the leading edge side clamping base 62 and the tail edge side clamping base 63. Also, both the tail edge side clamping base 63 and the tail edge side clamp 65 can be moved in directions shown by arrow 90 and arrow 91 as a unit.

In order for the plate 10 to fix on the plate cylinder 60, firstly, a leading edge side part 10*a* of the plate 10 is inserted between the leading edge side clamping base 62 and the leading edge side clamp 64, and the leading edge side part 10*a* is clamped by closing the leading edge side clamp 64 in the direction shown by the arrow 102. Thereafter, the plate 10 is disposed around a cylinder surface of the plate cylinder 60, and a tail edge side part 10*b* of the plate 10 is inserted between the tail edge side clamping base 63 and the tail edge side clamp 65. The tail edge side part 10*b* is clamped between the tail edge side clamping base 63 and the tail edge side clamp 65 by closing the tail edge side clamp 65 in the direction shown by the arrow 101.

The plate 10 is not fitted on the cylinder surface of the plate cylinder 60 tightly when both the leading edge side part 10*a* and the tail edge side part 10*b* are clamped. Various troubles such as shear in printing or similar ones are observed during the printing work when the plate 10 is not fitted on the cylinder surface of the plate cylinder 60. In order to fit the plate 10 tightly onto the cylinder surface of the plate cylinder 60, the plate 10 is pulled by moving both the tail edge side clamping base 63 and the tail edge side clamp 65 in the direction shown by the arrow 90.

A plate lock-up device for a printing machine disclosed in Japanese laid-open Publication No. 13349 of 1992 (Hei 4-13349) is shown as the first prior art. An overall structure of the plate lock-up device is shown in FIG. 32A and FIG. 32B. FIG. 32A and FIG. 32B are partially sectional views of the plate cylinder 60 in two different sections. As shown in FIG. 32A, a cam shaft 67 is located underneath a rear end of the leading edge side clamp 64, and an eccentric point of a leading edge side cam 70 is supported by the cam shaft 67.

The rear end of the leading edge side clamp 64 is pushed up by the leading edge side cam 70 when the leading edge side cam 70 is rotated in the direction shown by the arrow 102 in accordance with the rotation of the cam shaft 67. So that, the leading edge side clamp 64 is closed in the direction shown by the arrow 102 to the leading edge side clamping base 62. As a result, the leading edge side part 10*a* of the plate 10 is clamped between the leading edge side clamping base 62 and the leading edge side clamp 64. On the contrary, the leading edge side part 10*a* thus clamped is released by opening the leading edge side clamp 64 to the leading edge side clamping base 62 when the cam shaft 67 and the leading edge side cam 70 are rotated in the direction shown by the arrow 101.

Another cam shaft 66 is positioned underneath a rear end of the tail edge side clamp 65, and an eccentric point of a tail edge side cam 69 is supported by the cam shaft 66. Also, the rear end of the tail edge side clamp 65 is pushed up by the tail edge side cam 69 when the tail edge side cam 69 is rotated in the direction shown by the arrow 102 in accordance with the rotation of the cam shaft 66. So that, the tail edge side clamp 65 is closed in the direction shown by the arrow 101 to the tail edge side clamping base 63. As a result, the tail edge side part 10*b* of the plate 10 is clamped between the tail edge side clamping base 63 and the tail edge side clamp 65. On the contrary, the tail edge side part 10*b* thus clamped is released by opening the tail edge side clamp 65 to the tail edge side clamping base 63 when the cam shaft 66 and the tail edge side cam 69 are rotated in the direction shown by the arrow 101.

A plurality of coil springs are provided to engage the tail edge side clamping base 63, whereby the tail edge side clamping base 63 is pushed in the direction shown by the arrow 90. Another cam 71 is supported by the cam shaft 66 which supports the tail edge side cam 69 (see FIG. 32A). An eccentric point of the cam 71 is supported by the cam shaft 66. The tail edge side clamping base 63 is in contact with the cam 71. So that, movement of the tail edge side clamping base 63 in the direction shown in the arrow 90 is restricted by the cam 71.

In a typical procedure, in order for the plate 10 to fix on the plate cylinder 60, firstly, the leading edge side part 10*a* of the plate 10 is inserted between the leading edge side clamping base 62 and the leading edge side clamp 64, and the cam shaft 67 is rotated in the direction shown by the arrow 102. As a result, the leading edge side part 10*a* of the plate 10 is clamped with the leading edge side clamp 64 by pushing up the rear end of the leading edge side clamp 64 with the leading edge side cam 70. Thereafter, the plate 10 is disposed around the cylinder surface of the plate cylinder 60, and the tail edge side part 10*b* of the plate 10 is inserted between the tail edge side clamping base 63 and the tail edge side clamp 65. Then, the tail edge side part 10*b* of the plate 10 is clamped with the tail edge side clamp 65 by pushing up the rear end of the tail edge side clamp 65 with the tail edge side cam 69 as a result of rotating the cam shaft 66 in the direction of the arrow 102.

Upon clamping the both the leading edge side part 10*a* and the tail edge side part 10*b* of the plate 10, the cam shaft 66 is further rotated in the direction shown by the arrow 102. As a result of the rotation, the cam 71 is rotated in a position shown by a solid line from a position shown by a broken line in FIG. 32B, thereby the tail edge side clamping base 63 is moved in the direction shown by the arrow 90 by the spring force of the coil springs 68. In this manner, the plate 10 is fitted tightly onto the cylinder surface of the plate cylinder 60 as a result of pulling the plate 10 by moving the tail edge side clamping base 63 in the direction shown by the arrow 90.

Next, another plate lock-up device for a printing machine disclosed in Japanese Patent Publication No. 84216 of 1993 (Hei 5-84216) is shown as the second prior art. The overall structure of the plate lock-up device for the printing machine is shown in FIG. 33, FIG. 34A, and FIG. 34B. FIG. 33 is a side view of the plate lockup device, and both FIG. 34A and FIG. 34B are cross sectional views taken along line XIII—XIII of FIG. 33, and both the views illustrate a plane nearby the plate cylinder 60 partially.

Another cam shaft 72 for tightening the plate 10 is protruded beyond the side face of the plate cylinder 60 in a direction along with the shaft 60J of the plate cylinder 60. A lever 73 is fixed to an end of the cam shaft 72 thus protruded beyond the side face. A cam (not shown) is connected with the cam shaft 72 at a position covered by the plate cylinder 60.

The cam thus connected with the cam shaft 72 is in contact with the tail edge side clamping base 63, and movement of the tail edge side clamping base 63 in the directions shown by the arrow 90 and the arrow 91 (FIG. 31) is restricted. In other words, movement of the tail edge side clamping base 63 in the directions shown by the arrow 90 and the arrow 91 can be controlled by rotating the lever 73, and thereby the plate 10 can either be fitted tightly onto the cylinder surface of the plate cylinder 60 or be loosened from the cylinder surface. A roller 74 is rotatably provided on the lever 73.

On the other hand, a kicker 77 is mounted on a frame 75 of the printing machine through a bracket 76, and the kicker 77 is rotatable in directions shown by arrow 105 and arrow 106. The rotation of the kicker 77 in either of the directions shown by the arrow 105 and the arrow 106 can be controlled by a rotary actuator 78 through a coupling joint 79.

The kicker 77 is positioned nearby the lever 73. The kicker 77 is rotated in the direction shown by the arrow 105 so as to locate in a position shown in FIG. 34B when the plate 10 is fitted tightly onto the cylinder surface of the plate cylinder 60.

Thereafter, the plate cylinder 60 is rotated about the shaft 60J. The cam shaft 72 is rotated about the shaft 60J in the rotated direction of the plate cylinder 60 when the plate cylinder 60 is rotated. Because, the cam shaft 72 is located at a position beside the tail edge side clamping base 63 provided adjacent to the plate surface of the plate cylinder 60, whereby the cam shaft 72 is positioned at a position far from the shaft 60J and parallel thereto.

The position of the kicker 77 shown in FIG. 34B is unchanged even when the plate cylinder 60 is rotated, and the kicker 77 is located on a track formed by rotation of the roller 74 provided on the lever 73. Thus, the cam shaft 72 which fixes the lever 73 is rotated as a result of pushing down the lever 73 cause by the contact of the lever 73 with the kicker 77. The tail edge side clamping base 63 is moved in the direction shown by the arrow 90 in accordance with the rotation of the cam shaft 72, and thereby the plate 10 is fitted tightly on the surface of the plate cylinder 60.

In order to eject the plate 10 from the plate cylinder 60, the cam shaft 72 is rotated in the opposite direction by rotating the plate cylinder 60 in the opposite direction with locating the kicker 77 on the track so as to contact with the other side of the roller 74. Thus, the plate 10 is not fitted on the cylinder surface of the plate cylinder 60 because the plate 10 is loosened from the cylinder surface as a result of movement of the tail edge side clamping base 63 in the direction shown by the arrow 91.

Further, another plate lock-up device for an offset press disclosed in Japanese Laid-open Publication No. 277639 of 1990 (Hei 2-277639) is shown as the third prior art. Overall structure of the plate lock-up device for the offset press is shown in FIG. 35. FIG. 35 is a side view of a plate cylinder 60.

A leading edge side cam shaft 81, a tail edge side cam shaft 82, and another cam shaft 83 for tightening the plate 10 are protruded beyond the side face of the plate cylinder 60 in a direction along with the shaft 60J of the plate cylinder 60. A leading edge side gear 81G, a tail edge side gear 82G and another gear 83G are fixed to the leading edge side cam shaft 81, the tail edge side cam shaft 82 and the cam shaft 83 respectively. The leading edge side clamp 64 shown in FIG. 31 is opened and is closed in accordance with the rotation of the leading edge side cam shaft 81, and the tail edge side clamp 65 shown in FIG. 31 is opened and is closed in accordance with the rotation of the tail edge side cam shaft 82. Further, the tail edge side clamping base 63 shown in FIG. 31 is moved in the directions shown by the arrow 90 and the arrow 91 in accordance with the rotation of the cam shaft 83.

As shown in FIG. 35, a gear 80 is rotatably connected to the shaft 60J of the plate cylinder 60. Connection of the gear 80 to the plate cylinder 60 can be switched by a clutch mechanism. Further, second gear tooth 80*b* formed on the gear 80 are engaged with another gear (not shown), and the driving force of a motor for driving the clamping parts is conveyed through the gear.

In order for the plate 10 to fix on the plate cylinder 60, firstly, the leading edge side part 10*a* of the plate 10 is inserted between the leading edge side clamping base 62 and the leading edge side clamp 64 both of which shown in FIG. 31, and the gear 80 shown in FIG. 35 is rotated in the direction shown by the arrow 101. In this manner, the leading edge side part 10*a* is clamped with the leading edge side clamp 64 (FIG. 31) by the closure thereof as a result of rotating the leading edge side cam shaft 81 fixing the leading edge side gear 81G which is engaged with a first gear tooth 80*a* formed on the gear 80.

Thereafter, the plate 10 is disposed around the cylinder surface of the plate cylinder 60 by rotating the plate cylinder 60 in the direction shown by the arrow 101. In this case, the gear 80 is rotated together with the plate cylinder 60 as a unit because the gear 80 is connected with the plate cylinder 60 using the clutch mechanism. At that time, the first gear tooth 80*a* formed on the gear 80 are located between the leading edge side gear 81G and the tail edge side gear 82G.

Upon disposing the plate 10 on the cylinder surface of the plate cylinder 60, the tail edge side part 10*b* of the plate 10 is inserted between the tail edge side clamping base 63 and the tail edge side clamp 65. Then, the gear 80 is rotated in the direction shown by the arrow 101 relative to the plate cylinder 60. In this manner, the tail edge side part 10*b* is clamped with the tail edge side clamp 65 (FIG. 31) by the closure thereof as a result of rotating the tail edge side cam shaft 82 fixing the tail edge side gear 82G which is engaged with the first gear tooth 80*a* formed on the gear 80.

Upon clamping both the leading edge side part 10*a* and the tail edge side part 10*b* of the plate 10, the gear 80 is further rotated in the direction shown by the arrow 101, and thereby the first gear tooth 80*a* is engaged with the gear 83G. As a result of the engagement, the cam shaft 83 is rotated. In this manner, the tail edge side clamping base 63 shown in FIG. 31 is moved in the direction shown by the arrow 90 by the rotation of the cam shaft 83. Thus, the plate 10 is fitted tightly onto the cylinder surface of the plate cylinder 60 as a result of pulling the plate 10 by the movement of the tail edge side clamping base 63. In order to eject the plate 10 from the plate cylinder 60, the procedures described above [are] need to be performed in reversed order by rotating the gear 80 in the direction of the arrow 102.

However, conventional structures of the plate lock-up device described above have the following problems to be resolved. In the prior art device shown in FIG. 32A and FIG. 32B, both the cam shaft 67 and the cam shaft 66 need to be rotated. Therefore, it takes much work to control both the cam shafts. Further, the cam shaft 67 and the cam shaft 66 need to be controlled respectively. Therefore, efficiency of the work is decreased as a result of consuming much time.

In addition, in a printing machine so called "inside gear type" which has gear mechanisms within the frame of the machine, the parts for controlling the machine such as gears or other related mechanisms are mounted on one side of the plate cylinder for compactness. Further, the cam shaft 66 and the cam shaft 67 are installed closely with each other in the printing machine. Therefore, movement of a lever fixed to the cam shaft interferes the movement of another lever fixed to the other cam shaft. As a result, the printing machine can not be operated properly at an adequate timing.

An additional motor or other source for driving the clamping parts is required separately from the motor for driving the plate cylinder 60 when both the cam shaft 67 and the cam shaft 66 are automatically rotated. The size of the printing machine becomes larger, and manufacturing cost is increased because the additional motor or other source for driving the clamping parts is mounted on the printing machine.

In the prior art device shown in FIG. 34A and FIG. 34B, the cam shaft 72 is rotated by using the rotation of the plate cylinder 60. Therefore, no motor dedicated for driving the clamping parts is required. But, both the leading edge side clamp 64 and the tail edge side clamp 65 shown in FIG. 31 need to be controlled in addition to the control of the printing machine described above. Therefore, it take additional work to control the clamping parts. Further, clamping of the plate using both the leading edge side clamp 64 and the tail edge side clamp 65 and applying tension to the plate [are] need to be carried out separately from each other. Therefore, efficiency of the work is decreased as a result of consuming much time.

In the prior art device shown in FIG. 35, both the clamping of the plate carried out by closing the leading edge side clamp 64 and the tail edge side clamp 65 shown in FIG. 31 and the application of tension to the plate carried out by moving the tail edge side clamping base 63 in the directions shown by arrow 90 and the arrow 91 can be performed by rotating the gear 80. However, an additional motor for driving the clamping parts is required separately from the motor for driving the plate cylinder 60 as well as the clutch mechanisms in the prior art device. Therefore, the size of the printing machine becomes larger, and manufacturing cost is increased.

It is an object of the present invention to provide an apparatus for driving a clamping device for fixing a plate on a plate cylinder of a printing machine which achieves a low profile and depreciation of the manufacturing cost thereof, as well as improving efficiency of the work, in addition to easily carry out opening and closing movements of the clamps and plate tensioning.

In accordance with the present invention, an apparatus for driving a clamping device for fixing a plate on a plate cylinder of a printing machine comprises:

a first clamping part mounted on the plate cylinder and including a first clamping base and a first clamping plate, a first end of the plate inserted into a first space formed between the first clamping base and the first clamping plate being clamped by closing the first space, and the first end of the plate clamped in the first space being released by opening the first space, a second clamping part mounted on the plate cylinder and including a second clamping base and a second clamping plate, a second end of the plate inserted into a second space formed between the second clamping base and the second clamping plate being clamped by closing the second space, the plate being disposed around a surface of the plate cylinder, and the second end of the plate clamped in the second space being released by opening the second space, and a movement control part for controlling movement of the second clamping part in a plate tensioning direction for fixing the plate on the surface of the plate cylinder or in a plate loosening direction for loosening the plate on the surface of the plate cylinder, wherein control for opening and closing the first space formed on the first clamping part, control for opening and closing the second space formed on the second clamping part, and control for moving the second clamping part either in a plate tensioning direction or in a plate loosening direction carried out by the movement control part being performed in accordance with rotation of the plate cylinder.

While the novel features of the invention are set forth in a general fashion, both as to organization and content, the invention will be better understood and appreciated, along with other objects and features thereof, from the following detailed description taken in conjunction with the drawings.

FIG. 8A is a cross sectional view taken along line I—I of FIG. 1.

FIG. 8B is a side view looking in the direction of the arrow S1 of FIG. 1.

FIG. 8C is another cross sectional view taken along line I—I of FIG. 1 in a different condition.

FIG. 8D is another side view looking in the direction of the arrow S1 of FIG. 1 in a different condition.

Figure 1:
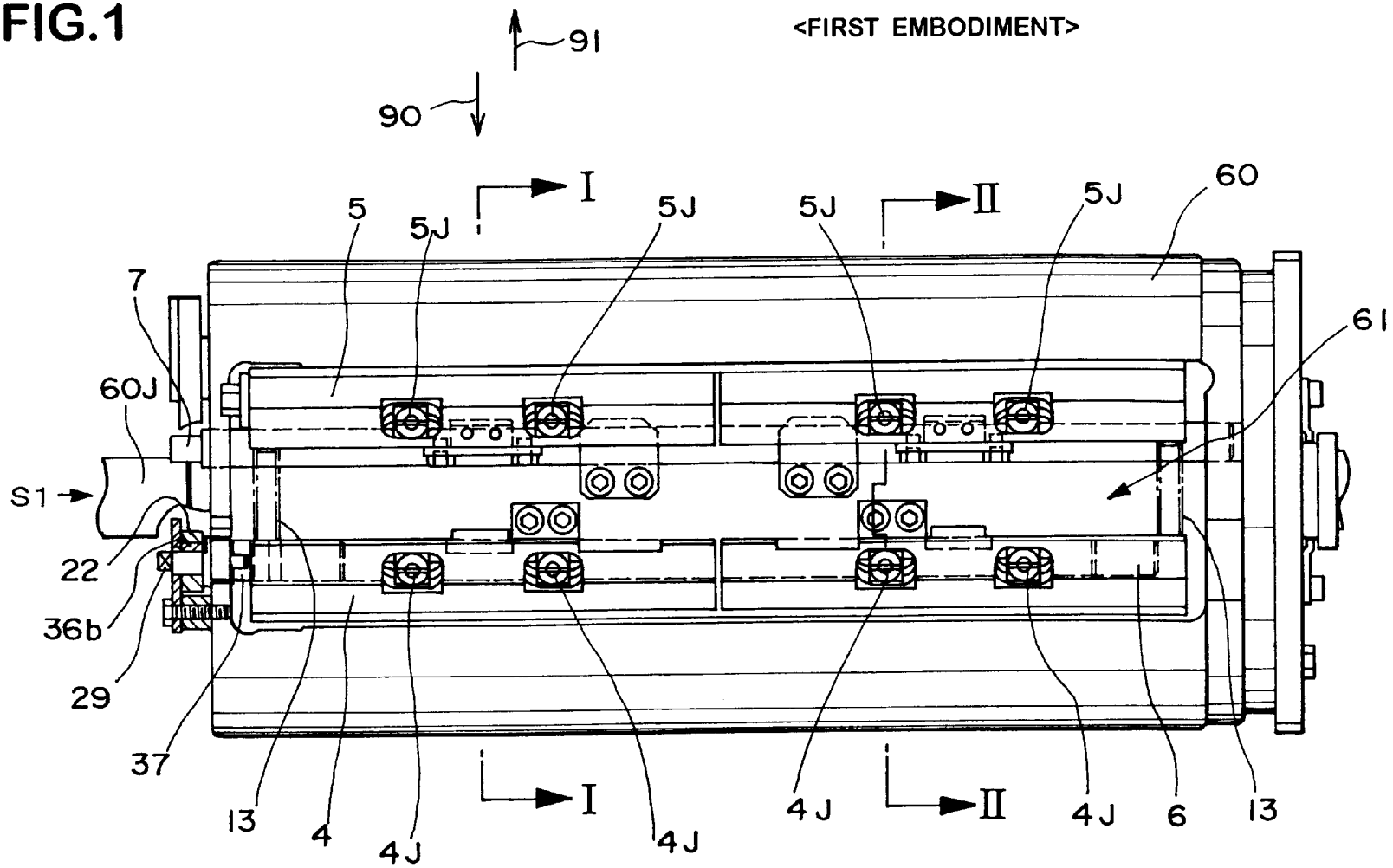
FIG. 1 is a plane view of a plate cylinder 60 showing an embodiment of an apparatus for driving a clamping device for fixing a plate on the plate cylinder of a printing machine in accordance with the present invention.

FIG. 21A is a perspective view of the tail edge side shaft 211, the coupler 212 and the stud 213 in detail.

FIG. 21B is a detailed perspective view of the tail edge side clamping base 3, a block 214 and peripheral parts.

Figure 22:
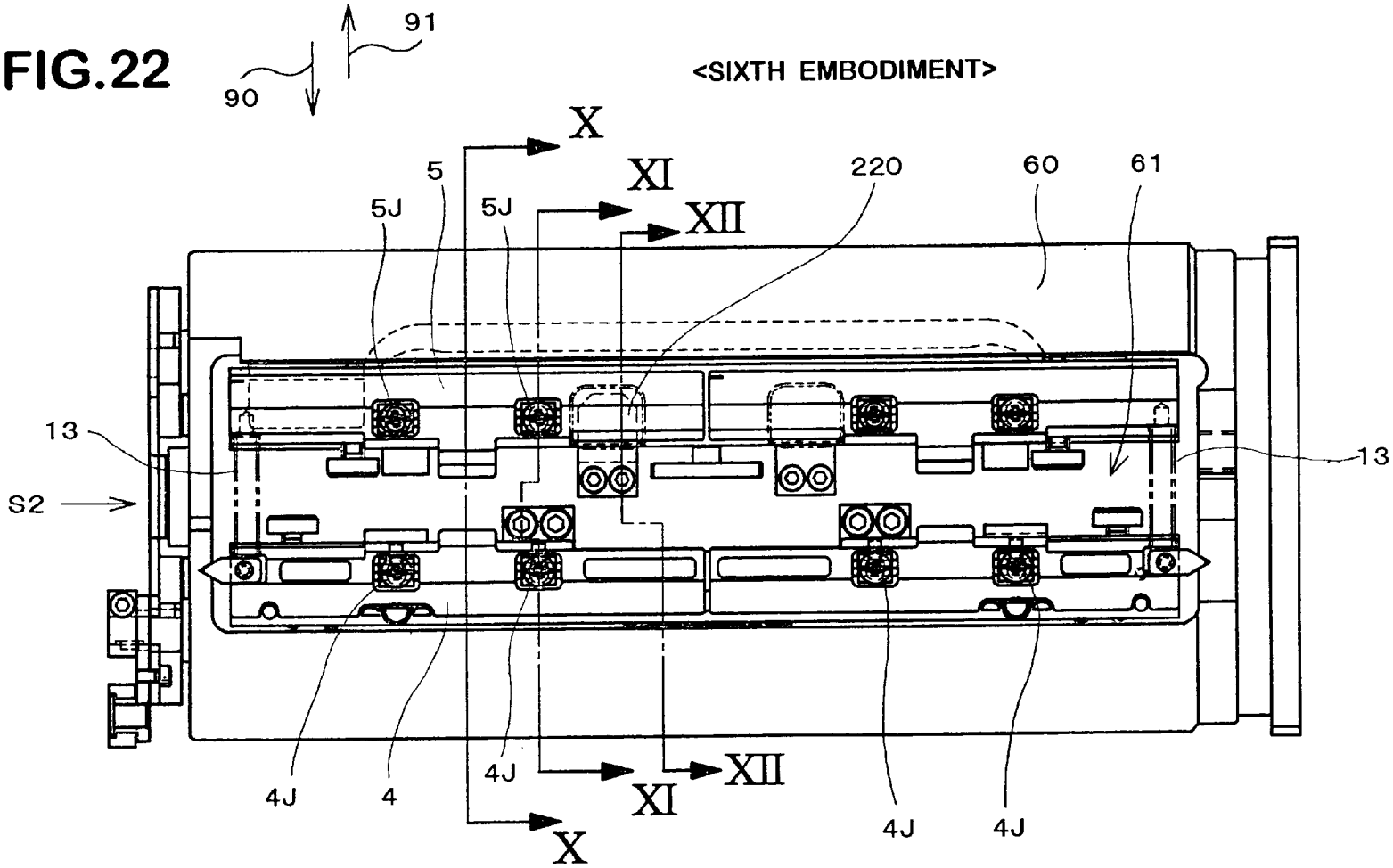

FIG. 22 is a side view of the plate cylinder 60 of the sixth embodiment of the apparatus for driving a clamping device for fixing a plate on the plate cylinder of a printing machine in accordance with the present invention.

Figure 23:
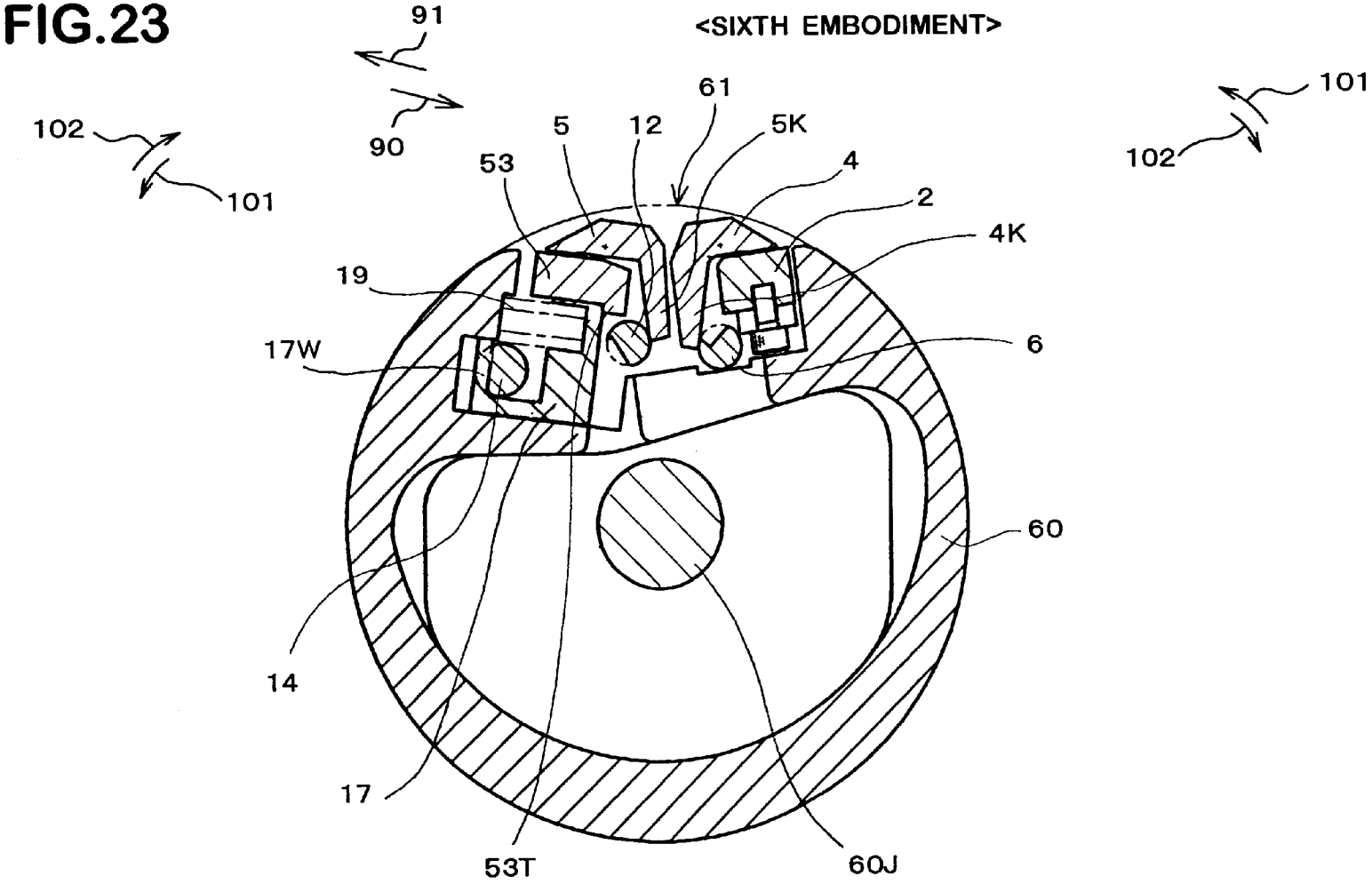

FIG. 23 is a cross sectional view taken along line X—X of FIG. 22.

Figure 24:
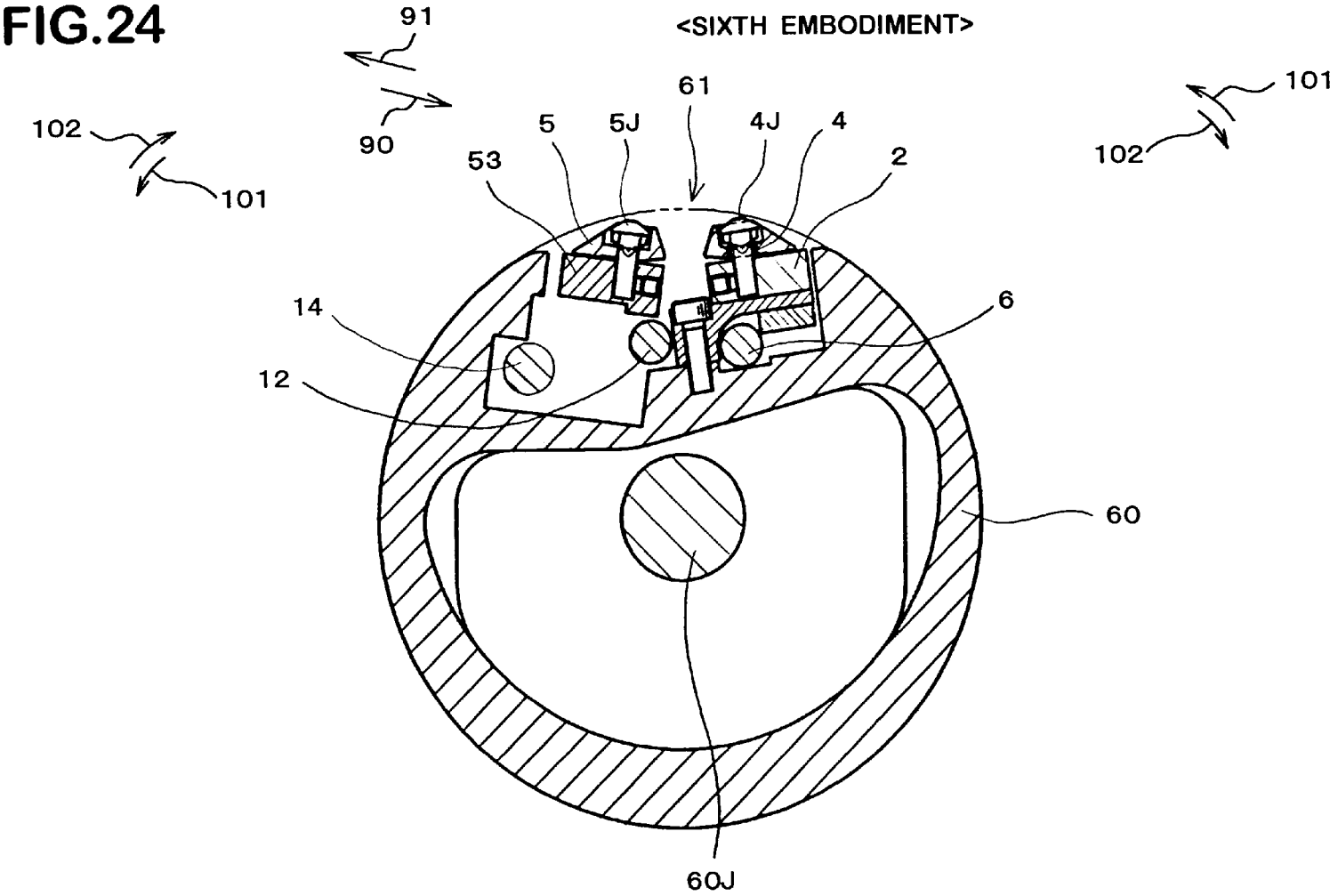

FIG. 24 is another cross sectional view taken along line XI—XI of FIG. 22.

Figure 25:
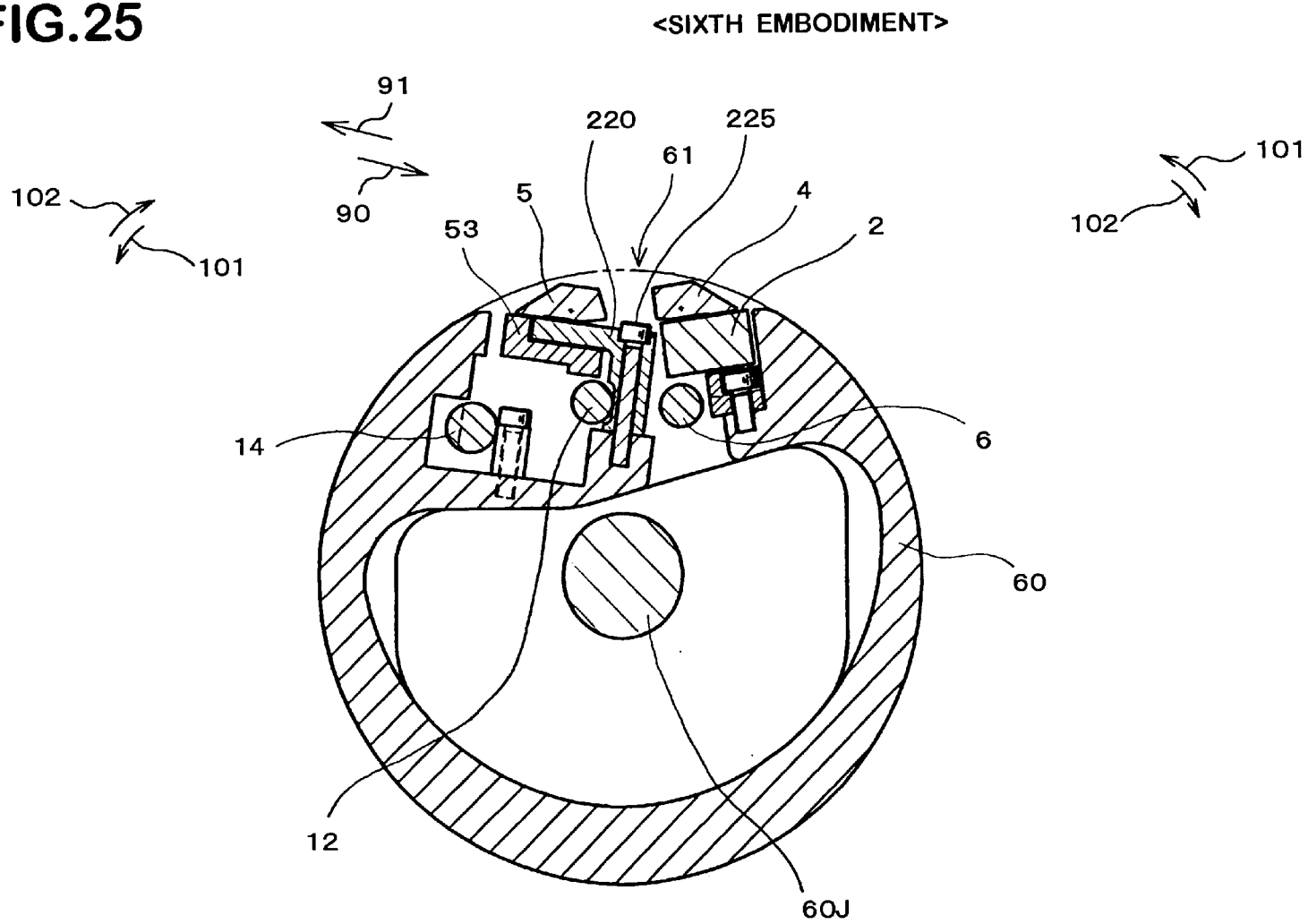

FIG. 25 is another cross sectional view taken along line XII—XII of FIG. 22.

Figure 26A:
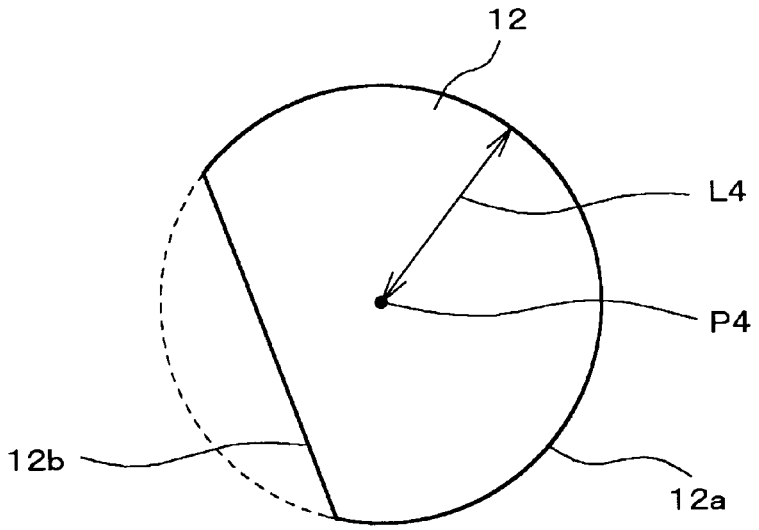

FIG. 26A is a detailed side view of the tall edge side shaft 12.

Figure 26B:
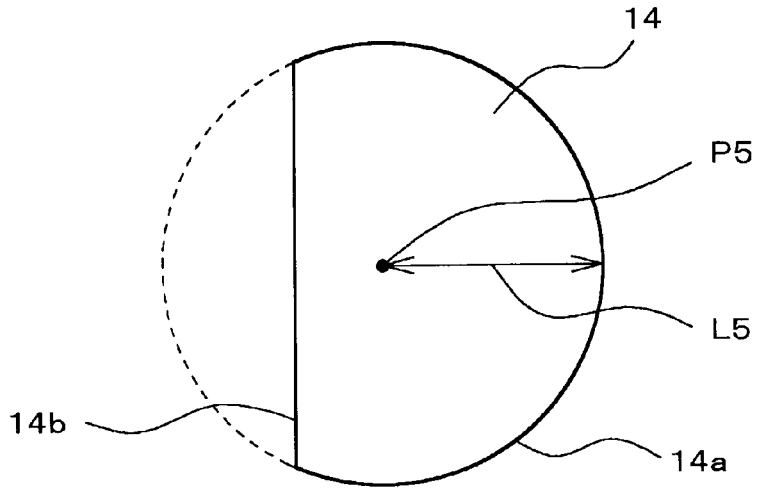

FIG. 26B is a detailed side view of the shaft 14.

FIG. 27 is a side view looking in the direction of an arrow S2 of FIG. 22.

Figure 28:
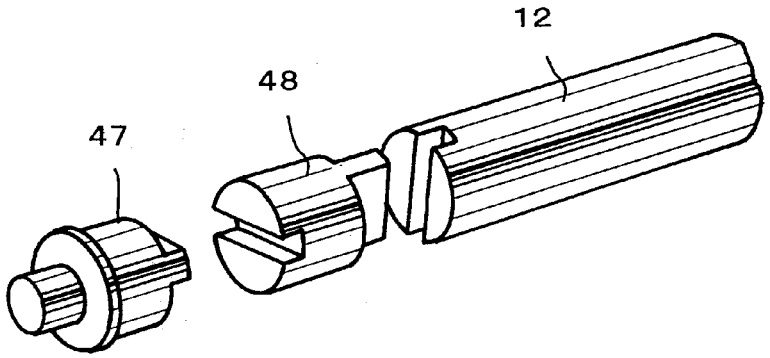

FIG. 28 is a perspective view of the tail edge side shaft 12, the stud 47 and the coupler 48 in detail.

FIG. 29A is a cross sectional view taken along line X—X of FIG. 22.

FIG. 29B is a side view looking in the direction of the arrow S2 of FIG. 22.

FIG. 29C is another cross sectional view taken along line X—X of FIG. 22 in a different condition.

FIG. 29D is another side view looking in the direction of the arrow S2 of FIG. 22 a in different condition.

Figures 30A, 30B, 30C, 30D:
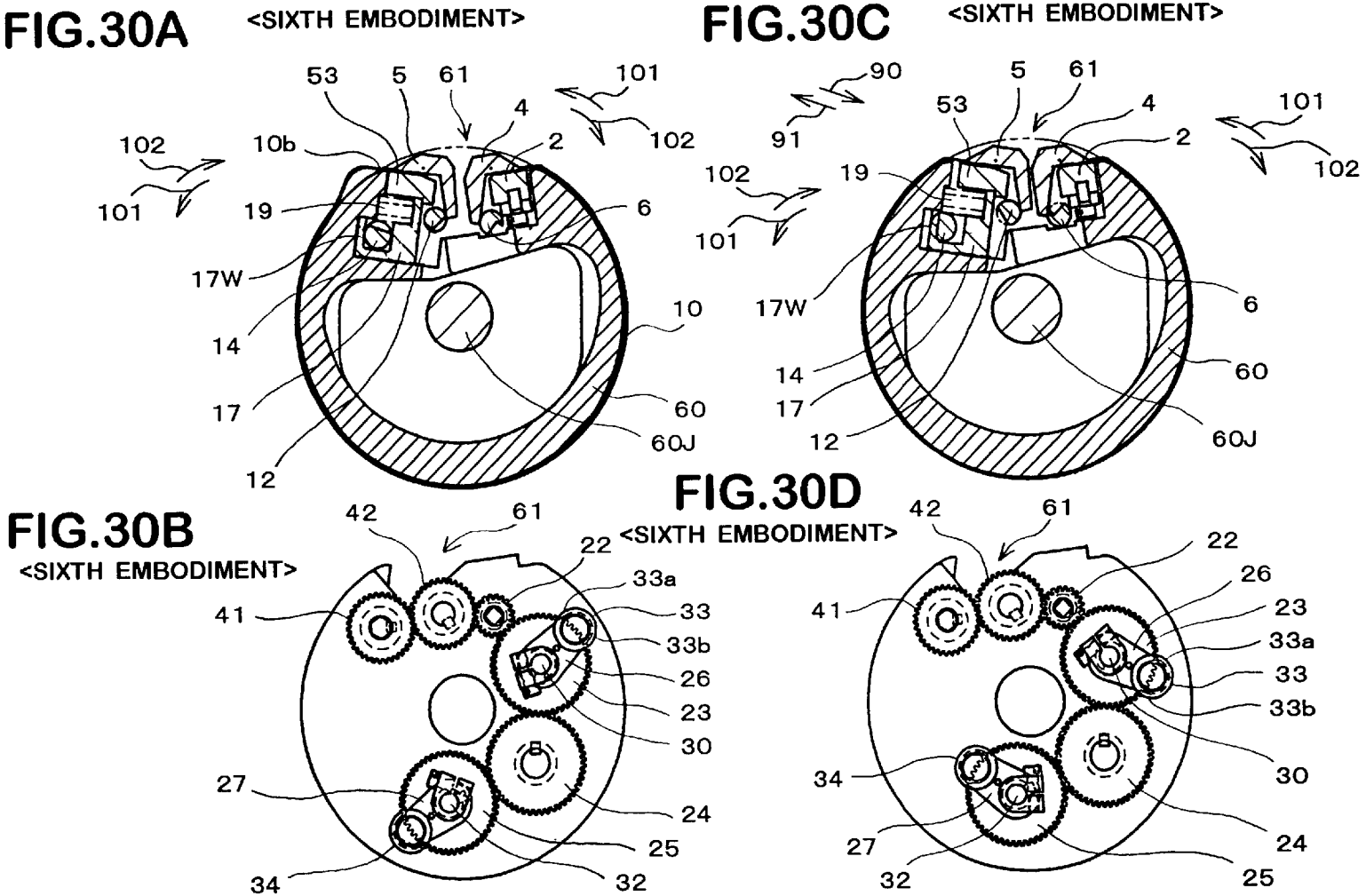

FIG. 30A is another cross sectional view taken along line X—X of FIG. 22 in a different condition.

FIG. 30B is another side view looking in the direction of the arrow S2 of FIG. 22 in a different condition.

FIG. 30C is still another cross sectional view taken along line X—X of FIG. 22 in a different condition.

FIG. 30D is still another side view looking in the direction of the arrow S2 of FIG. 22 in a different condition.

Figure 31:
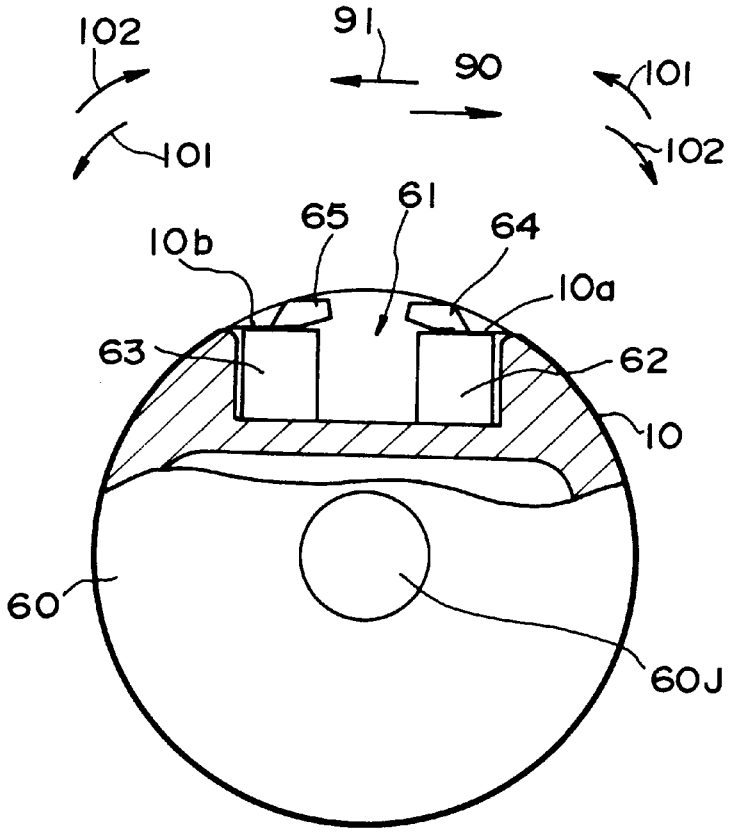

FIG. 31 is a partially sectional view showing an overall structure of the plate cylinder used in the prior art device.

FIG. 32A is a sectional side elevation of the plate lock-up device for a printing machine used in the first prior art.

FIG. 32B is another sectional side elevation of the plate lock-up device for a printing machine used in the first prior art.

Figure 33:
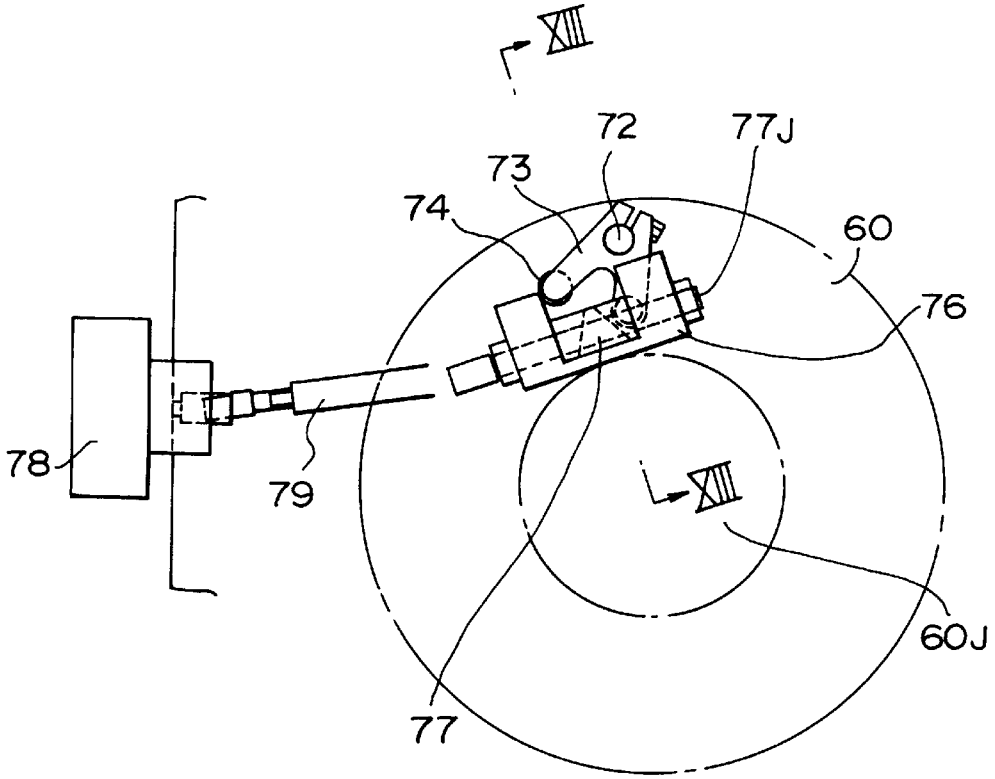

FIG. 33 is a side view of the plate lock-up device for a printing machine used in the second prior art.

FIG. 34A is a cross sectional view taken along line XIII—XIII of FIG. 33. The view illustrating a plane nearby the plate cylinder 60 partially.

FIG. 34B is another cross sectional view taken along line XIII—XIII of FIG. 33 in a different condition. The view illustrating the plane nearby the plate cylinder 60 partially.

FIG. 35 is a side view of the plate cylinder used in the third prior art of the plate lock-up device for an offset press.

(1) First Embodiment

An embodiment of an apparatus for driving a clamping device for fixing a plate on the plate cylinder of a printing machine in accordance with the present invention will be described with reference to FIG. 1, FIG. 2, FIG. 3, FIG. 4A, FIG. 4B, FIG. 5, FIG. 6, FIG. 7, FIG. 8A, FIG. 8B, FIG. 8C, FIG. 8D, FIG. 9A, FIG. 9B, FIG. 9C and FIG. 9D.

Figure 2:
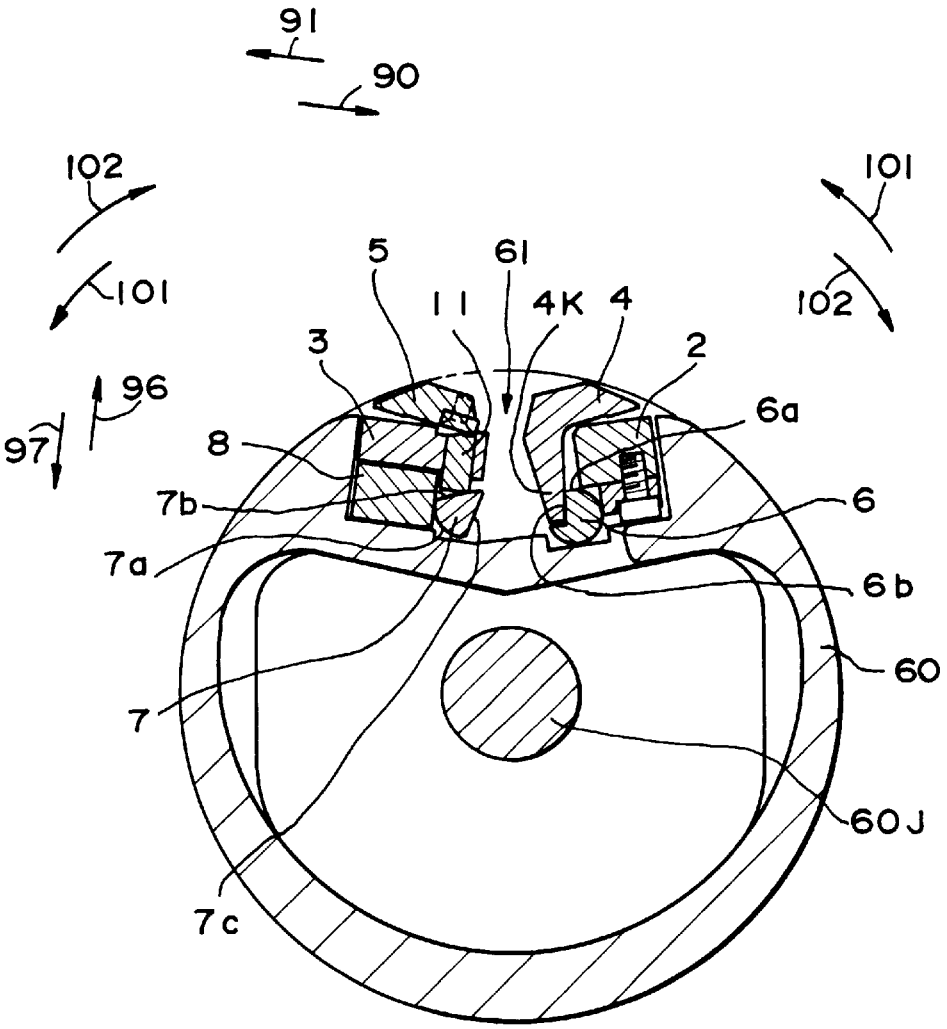
FIG. 2 is a cross sectional view taken along line I—I of FIG. 1.
Figure 3:
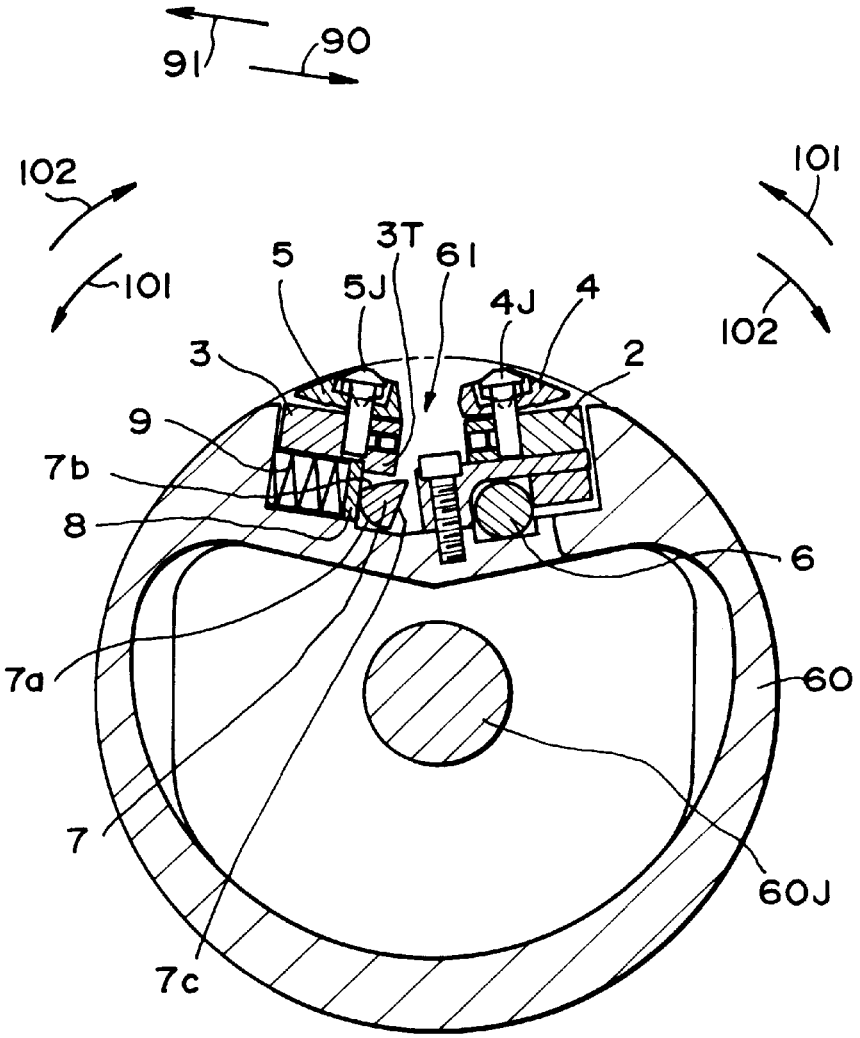
FIG. 3 is a cross sectional view taken along line II—II of FIG. 1.
Figure 4A:
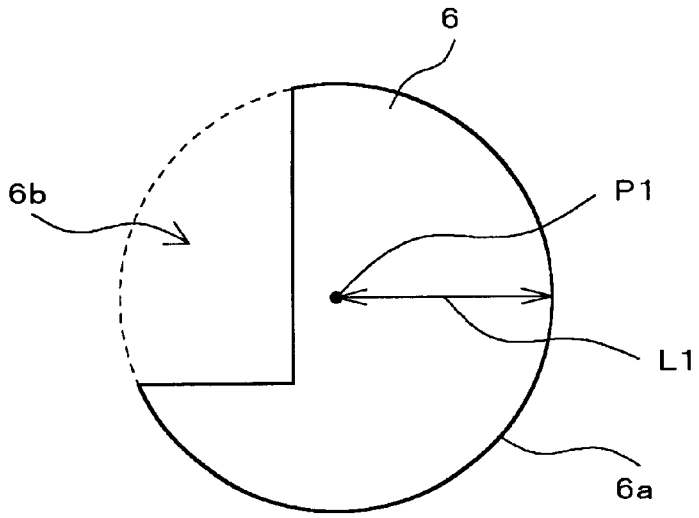
FIG. 4A is a detailed side view of the leading edge side shaft 6 shown in FIG. 3.
Figure 4B:
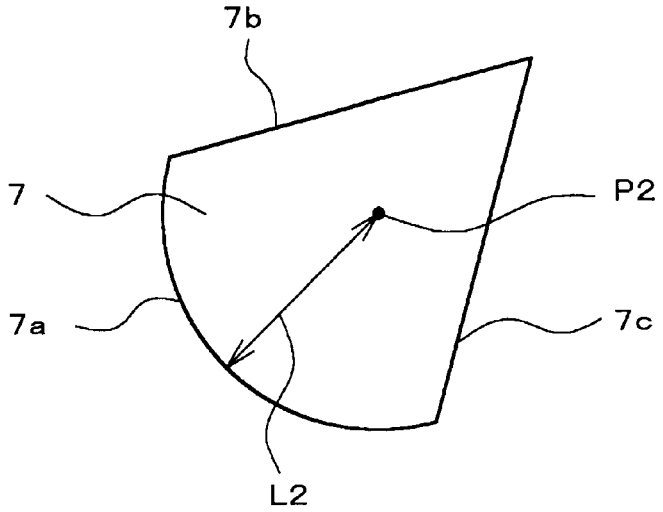
FIG. 4B is a detailed side view of the tail edge side shaft 7 shown in FIG. 3.
Figure 5:
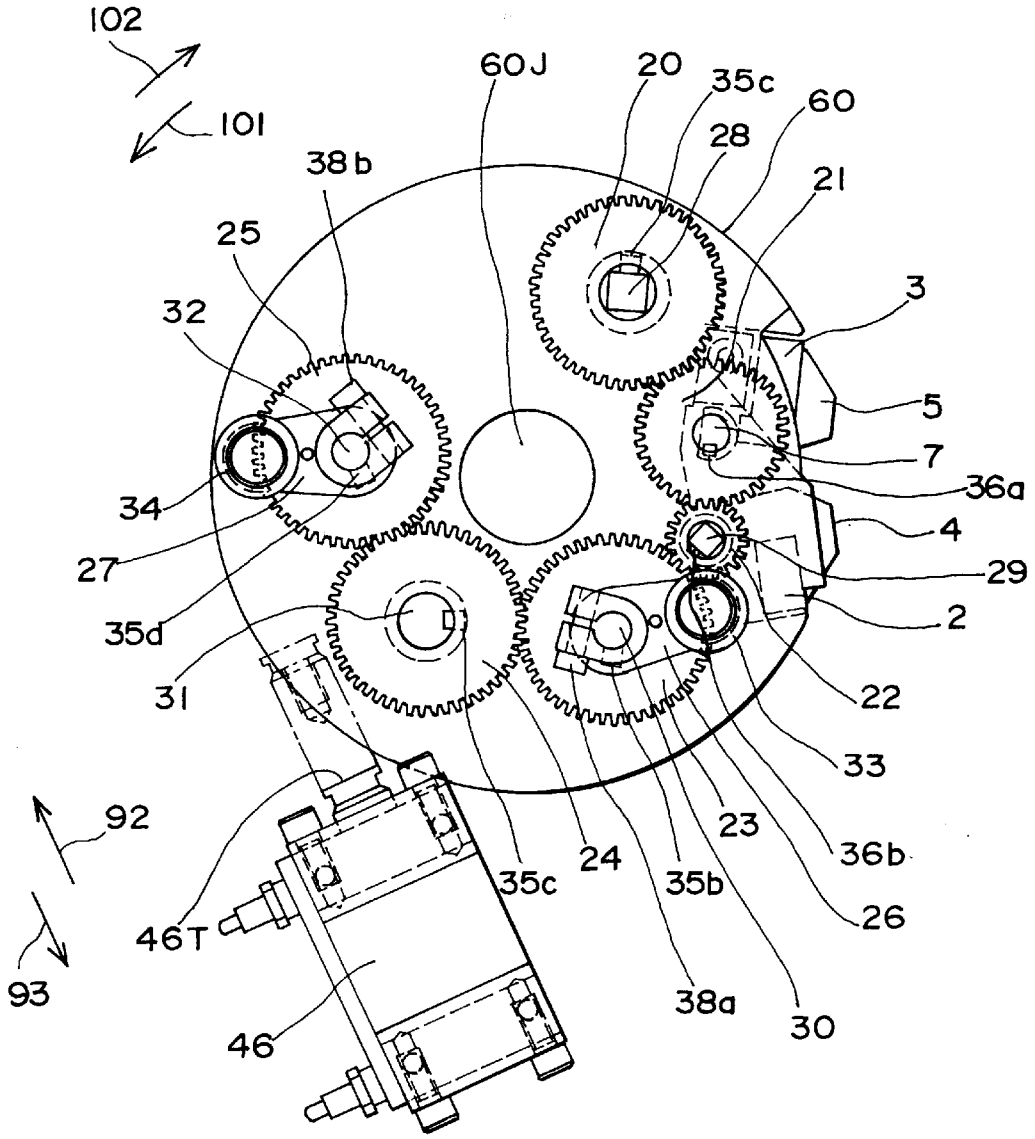
FIG. 5 is a side view looking in the direction of an arrow S1 of FIG. 1.

FIG. 1 is a plane view of a plate cylinder 60 in accordance with this embodiment. FIG. 2 is a cross sectional view taken along line I—I of FIG. 1, and FIG. 3 is a cross sectional view taken along line II—II of FIG. 1. FIG. 4A is a detailed side view of the leading edge side shaft 6, and FIG. 4B is a detailed side view of the tail edge side shaft 7. FIG. 5 is a side view looking in the direction shown by an arrow S1 of FIG. 1.

Figure 6:
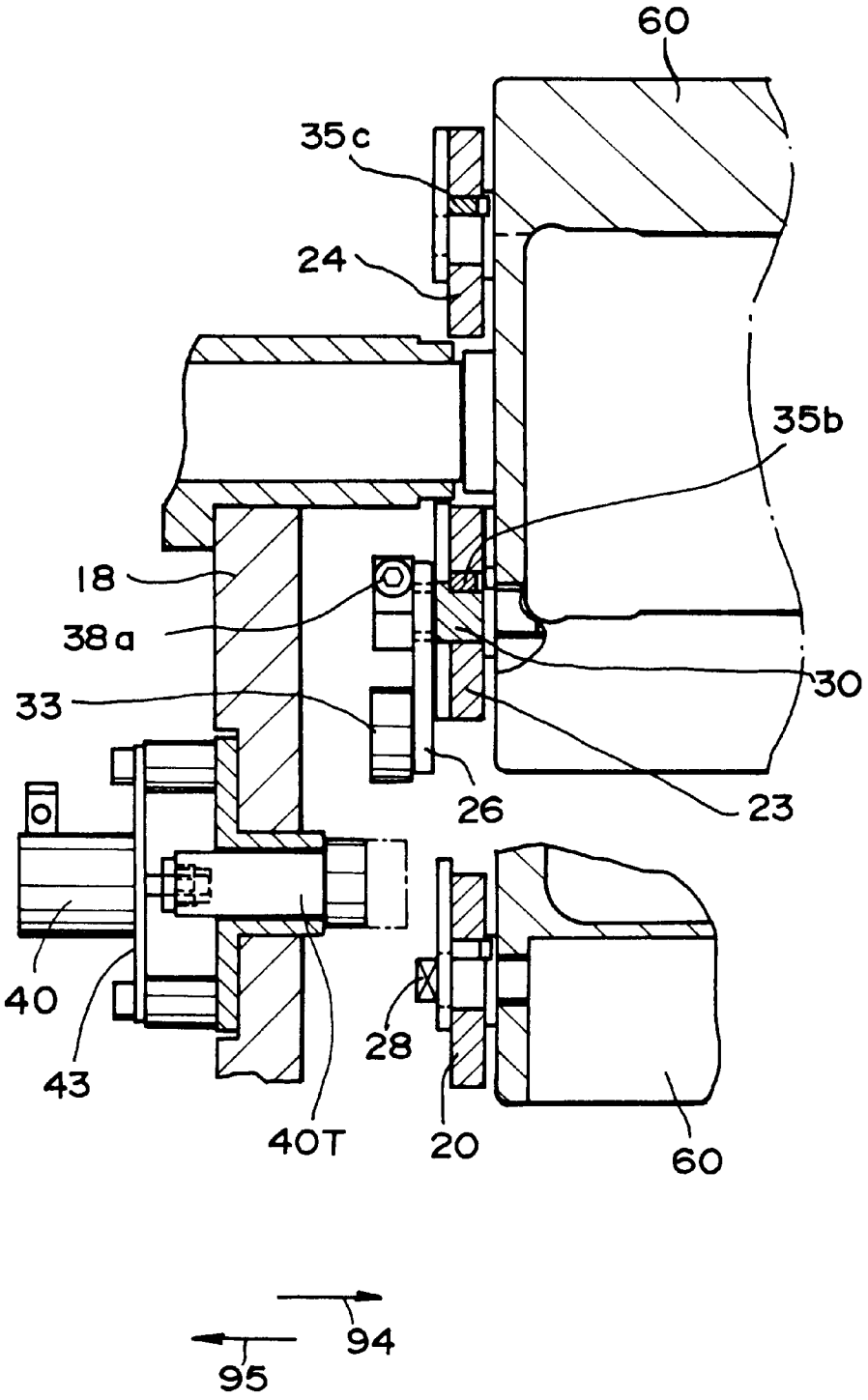
FIG. 6 is a detailed transverse cross section of a vicinity of a first air cylinder 40.
Figure 7:
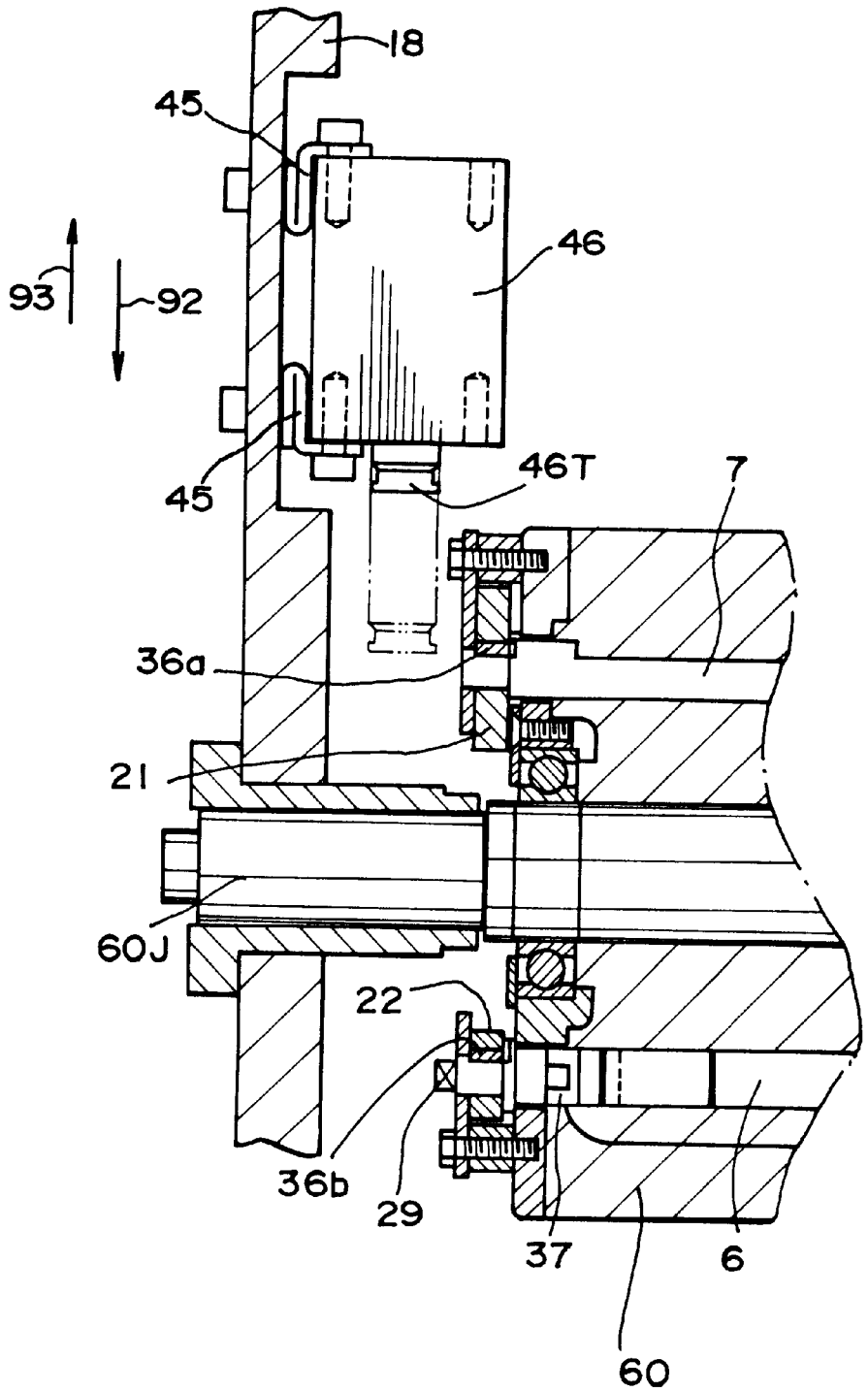
FIG. 7 is a detailed transverse cross section of a vicinity of the second air cylinder 46 shown in FIG. 5.

Further, FIG. 6 is a detailed transverse cross section of a vicinity of a first air cylinder 40, and FIG. 7 is a detailed transverse cross section of a vicinity of a second air cylinder 46. Also, FIG. 8A, FIG. 8B, FIG. 8C, FIG. 8D, FIG. 9A, FIG. 9B, FIG. 9C and FIG. 9D are views showing conditions of the plate cylinder 60 in this embodiment. FIG. 8A, FIG. 8C, FIG. 9A and FIG. 9C are cross sectional views of the plate cylinder 60, and FIG. 8B, FIG. 8D, FIG. 9B and FIG. 9D are side views of the plate cylinder 60.

A cut-out part 61 is formed on the plate cylinder 60, and both a leading edge side clamping base 2 and a tail edge side clamping base 3 are provided in the cut-out part 61. A leading edge side clamp 4 is provided at a position above the leading edge side clamping base 2, and the leading edge side clamp 4 is supported to the leading edge side clamping base 2 with a leading edge supporting bolt 4J.

The leading edge side clamp 4 can be rotated in directions shown by an arrow 101 and an arrow 102 by rotating about the leading edge supporting bolt 4J (see FIG. 3). A leading edge side part 10*a* forming a first end of the plate 10 is clamped between the leading edge side clamping base 2 and the leading edge side clamp 4 by closing the leading edge side clamp 4 in the direction of the arrow 102. On the other hand, the leading edge side clamp 4 is urged in the direction of the arrow 101. In this manner, the leading edge side part 10*a* of the plate 10 is released by opening the leading edge side clamp 4 in the direction of the arrow 101.

Further, the leading edge side clamp 4 has a rear end 4K, and the rear end 4K extends to the inside of the cut-out part 61. Also, the rear end 4K is in contact with a leading edge side shaft 6 as shown in FIG. 2. The leading edge side shaft 6 is rotatably supported to the both sides of the plate cylinder 60 (see FIG. 1).

Details of the leading edge side shaft 6 will be described herein with reference to FIG. 4A. A circumferential surface 6*a* having an equal radius L1 from a center point P1 is formed on the leading edge side shaft 6. Further, a concave part 6*b* inwardly recesses in a direction of the center point P1 from the arc is formed on the leading edge side shaft 6.

The leading edge side clamp 4 opens in the direction of the arrow 101 as shown in FIG. 2 when the rear end 4K of the leading edge side clamp 4 is engaged with the concave part 6*b*. On the contrary, the leading edge side clamp 4 is closed in the direction of the arrow 102 by rotating the leading edge side clamp 4 about the leading edge supporting bolt 4J shown in FIG. 3 with a force to the rear end 4K when the circumferential surface 6*a* is in contact with the rear end 4K of the leading edge side clamp 4.

The leading edge clamping base 2 forms a first clamping base, and the leading edge side clamp 4 forms a first clamping plate in this embodiment. Also, a space formed between the leading edge clamping base 2 and the leading edge side clamp 4 forms a first space in this embodiment. Further, the leading edge clamping base 2 and the leading edge side clamp 4 together form a first clamping part in this embodiment.

A tail edge side clamp 5 is provided at a position above the tail edge side clamping base 3, and a tail edge side part 10*b* forming a second end or an end of the plate 10 disposed on a cylinder surface of the plate cylinder 60 is clamped between the tail edge side clamping base 3 and the tail edge side clamp 5. The tail edge side clamp 5 is urged in the direction of the arrow 102. In this manner, the tail edge side part 10*b* of the plate 10 is released by opening the tail edge side clamp 5 in the direction of the arrow 102.

The tail edge side clamping base 3 forms a second clamping base, and the tail edge side clamp 5 forms a second clamping plate in this embodiment. Also, another space formed between the tail edge side clamping base 3 and the tail edge side clamp 5 forms a second space in this embodiment. Further, the tail edge clamping base 3 and the tail edge side clamp 5 together form a second clamping part in this embodiment.

A pair of coil springs 13 are located between the leading edge side clamping base 2 and the tail edge side clamping base 3 (see FIG. 1). The leading edge side clamping base 2 is pushed in the direction of the arrow 90, and the tail edge side clamping base 3 is pushed in the direction of the arrow 91 by the coil springs 13 respectively.

As shown in FIG. 2, a spring base 8 is located at a position beneath the tail edge side clamping base 3. A plurality of coil springs 9 are provided in the spring base 8, and the spring base 8 is pushed in the direction of the arrow 90. The coil springs 9 are arranged in a spaced fashion along the cylinder shaft 60J of the plate cylinder 60.

A flange part 3T is formed on the bottom of the tail edge side clamping base 3 as shown in FIG. 3, and the flange part 3T is in contact with a side wall of the spring base 8. The flange part 3T is pushed with the spring base 8 which is moved by the spring force of the coil springs 9, thereby the tail edge clamping base 3 and the tail edge side clamp 5 are pushed in the direction of the arrow 90 as a unit.

As shown in FIG. 2 and FIG. 3, the spring base 8 pushed by the coil springs 9 is in contact with a tail edge side shaft 7. The tail edge side shaft 7 is rotatably supported to the both sides of the plate 60 (see FIG. 1). Movement of the spring base 8 in the direction of the arrow 90 is restricted by contact of the spring base 8 with the tail edge side shaft 7. Movement of the tail edge side clamping base 3 in the direction of the arrow 90 is also restricted by limiting the movement of the spring base 8.

Details of the tail edge side shaft 7 will be described herein with reference to FIG. 4B. A circumferential surface 7*a* having an equal radius L2 from a center point P2 is formed on the tail edge side shaft 7. Further, a flat surface 7*b* and another flat surface 7*c* are formed on the tail edge side shaft 7. The lengths between the flat surface 7*b*, the flat surface 7*c* and the center point P2 are less than that of the radius L2.

As shown in FIG. 2, a block 11 is positioned between the tail edge side shaft 7 and the rear end of the tail edge side clamp 5. The block 11 is supported by the tail edge side clamping base 3 in a penetrated fashion so as to be vertically movable in the directions of arrow 96 and arrow 97.

The spring base 8, the coil springs 9 and the tail edge side shaft 7, all of which are used for moving both the tail edge side clamping base 3 and the tail edge side clamp 5 in the directions of the arrow 90 and the arrow 91 form a movement control part in this embodiment. The direction of the arrow 90 corresponds to a plate tensioning direction for fixing the plate 10 on the surface of the plate cylinder 60, and the direction of the arrow 91 corresponds to a plate loosening direction for loosening the plate 10 on the surface of the plate cylinder 60.

As shown in FIG. 5 and FIG. 7, an end of the tail edge side shaft 7 is protruded beyond the side face of the plate cylinder 60 in a direction along with the cylinder shaft 60J. A tail edge side gear 21 is connected to the part of the tail edge side shaft 7 thus protruded via a key 36*a*. Similarly, a leading edge side gear stud 29 is fixed to the leading edge side shaft 6 through a joint 37. The leading edge side gear stud 29 is located at a position outside of the side face of the plate cylinder 60, and a leading edge side gear 22 is fixed to the leading edge side gear stud 29 via a key 36*b*. The leading edge side gear 22 is engaged with the tail edge side gear 21.

Further, the leading edge side gear 22 is engaged with a first lever driving gear 23. The first lever driving gear 23 is fixed to a first lever driving gear stud 30 through a key 35*b*. Also, a first lever 26 is fixed to the first lever driving gear stud 30 with a screw 38*a*. Further, a roller 33 forming a part to be contacted is connected to an end of the first lever 26.

As shown in FIG. 5, the roller 33 is rotated about the cylinder shaft 60J in the rotated direction of the plate cylinder 60 when the plate cylinder 60 is rotated. This is because the roller 33 is located at a position beside the leading edge side clamping base 2 provided adjacent to the plate surface of the plate cylinder 60, whereby the roller 33 is positioned at a position far from the shaft 60J and parallel thereto.

An idler gear 24 which is located at a position outside of the side face of the plate cylinder 60 is also engaged with the first lever driving gear 23. The idler gear 24 is fixed to a idler gear stud 31 thorough a key 35*c*. Further, the idler gear 24 is engaged with a second lever driving gear 25 located at a position outside of the side face of the plate cylinder 60. The second lever driving gear 25 is fixed to a second lever driving gear stud 32 through a key 35*d*. A second lever 27 is fixed to the second lever driving gear stud 32 via a screw 38*b*.

Another roller 34 is connected to an end of the second lever 27. As shown in FIG. 5, the roller 34 is rotated about the cylinder shaft 60J in the rotated direction of the plate cylinder 6*p* when the plate cylinder 60 is rotated. This is because the roller 34 is located at a position adjacent to the plate surface of the plate cylinder 60, whereby the roller 34 is positioned at a position far from the shaft 60J and parallel thereto.

The tail edge side gear 21, the leading edge side gear 22, the first lever driving gear 23, the idler gear 24 and the second lever driving gear 25 all of which are used for interlocking the movement of the leading edge side clamp 4, the tail edge side clamp 5 and the tail edge side clamping base 3 form an interlocking part in this embodiment.

As shown in FIG. 7, a second air cylinder 46 forming a driving part is mounted on a frame 18 of the printing machine through second air cylinder brackets 45. A pushing shaft 46T forming a contact part is extendedly and contractedly moved in directions shown by arrow 92 and arrow 93 under the control of the second air cylinder 46 in accordance with signals inputted therein.

As shown in FIG. 5, the pushing shaft 46T reaches a position on a track formed by rotation of the roller 34 connected to the second lever 27 which is rotated together with the rotation of the plate cylinder 60 when the pushing shaft 46T is moved extendedly in the direction of the arrow 92. On the other hand, the pushing shaft 46T is out from the track formed by rotation of the roller 34 when the pushing shaft 46T is moved contractedly in the direction of the arrow 93.

Further, a first air cylinder 40 also forming the driving part is fixed to the frame 18 through a first air cylinder bracket 43 as shown in FIG. 6. A roller shaft 40T of the first air cylinder 40 also forming the contact part is moved extendedly and contractedly in directions shown by arrow 94 and arrow 95 under the control of the first air cylinder 40 in accordance with signals inputted therein.

As shown in FIG. 6, the roller shaft 40T of the first air cylinder 40 reaches a position on a track formed by rotation of the roller 33 connected to the first lever 26 which is rotated together with the rotation of the plate cylinder 60 when the roller shaft 40T of the first air cylinder 40 is moved extendedly in the direction of the arrow 94. On the other hand, the roller shaft 40T of the first air cylinder 40 is out from the track formed by rotation of the roller 33 when the roller shaft 40T of the first air cylinder 40 is moved contractedly in the direction of the arrow 95.

Next, the movement and conditions of the plate cylinder 60 and the apparatus for driving a clamping device will be described herein with reference to FIG. 8A, FIG. 8B, FIG. 8C, FIG. 8D, FIG. 9A, FIG. 9B, FIG. 9C, and FIG. 9D. In order to fix the plate 10 on the plate cylinder 60, the plate cylinder 60 is rotated about the cylinder shaft 60J, and the rotation is suspended at a predetermined position. The predetermined position is referred to as a plate clamping position. FIG. 8A and FIG. 8B show a condition of the plate cylinder 60 at that time.

The cut-out part 61 is illustrated so as to locate on the upper part of the plate cylinder 60 regardless of a degree of the rotation of the plate cylinder 60 in the FIG. 8A, FIG. 8B, FIG. 8C, FIG. 8D, FIG. 9A, FIG. 9B, FIG. 9C and FIG. 9D for a reason of convenience for description.

In the conditions shown in FIG. 8A and FIG. 8B, the roller 34 connected to the second lever 27 is located at a position adjacent to the pushing shaft 46T, and capable of being contacted with the pushing shaft 46T. The roller 34 also forms the part to be contacted in this embodiment. In other words, the plate clamping position is a position that the roller 34 can be in contact with the pushing shaft 46T by the rotation of the plate cylinder 60 in the direction of the arrow 101 from the condition shown in FIG. 5.

The leading edge side part 10*a* of the plate 10 is inserted between the leading edge side clamping base 2 and the leading edge side clamp 4 after suspending the rotation of the plate cylinder 60 at the plate clamping position. The pushing shaft 46T is moved extendedly to the direction of the arrow 92 by driving the second air cylinder 46 at the plate clamping position. As described earlier, the roller 34 is pushed by the pushing shaft 46T thus moved in the direction because the roller 34 is located at the position capable of being contacted with the pushing shaft 46T.

The second lever driving gear stud 32 is rotated in the direction of the arrow 102 by the movement of the second lever 27 connected to the roller 34 thus pushed (see FIG. 8B and FIG. 8D). The rotation of the second lever driving gear stud 32 is conveyed to the second lever driving gear 25 because the second lever driving gear 25 is fixed to the second lever driving gear stud 32. As a result, the second lever driving gear 25 is rotated in the direction of the arrow 102 when the second lever driving gear stud 32 is rotated.

As described earlier, each of the second lever driving gear 25, the idler gear 24, the first lever driving gear 23, the leading edge side gear 22, the tail edge side gear 21 and a manual operating gear 20 is engaged with adjacent gears. Thus, all the gears are rotated together with others because the rotation of the second lever driving gear 25 is conveyed to all the gears.

FIG. 8C and FIG. 8D are views showing a condition of the gears being rotated by the movement of the pushing shaft 46T. As shown in FIG. 8C, the leading edge side shaft 6 is rotated in the direction of the arrow 101 from the condition shown in FIG. 8A because the leading edge side gear 22 is connected to the leading edge side shaft 6. Hence, the leading edge side clamp 4 is closed in the direction of the arrow 102 by rotating about the leading edge supporting bolt 4J shown in FIG. 3 as a result of pushing the rear end 4K of the leading edge side clamp 4 with the circumferential surface 6*a* of the leading edge side shaft 6.

The leading edge side part 10*a* of the plate 10 is clamped between the leading edge side clamping base 2 and the leading edge side clamp 4 by closing the leading edge side clamp 4 in the direction. At that time, the tail edge side gear 21 is also rotated in the direction of the arrow 102 in accordance with the rotation of other gears generated by the movement of the pushing shaft 46T (see FIG. 8A and FIG. 8C).

However, the circumferential surface 7*a* of the tail edge side shaft 7 is in contact with the side wall of the side wall of the spring base 8 in the condition shown in FIG. 8A. The position of the spring base 8 is unchanged even when the tail edge side shaft 7 is rotated to a position shown in FIG. 8C from the position of that shown in FIG. 8A because the circumferential surface 7*a* having an equal radius L2 from the center point P2 is formed on the tail edge side shaft 7 (see FIG. 4B). Therefore, the movement of the spring base 8 which is pushed in the direction of the arrow 90 with the coil springs 9 (see FIG. 3) is suspended by the circumferential surface 7*a* of the tail edge side shaft 7. As a result, the position of the spring base 8 is unchanged.

Additionally, the flat surface 7*b* of the tail edge side shaft 7 is located at a position opposed to the block 11 at the condition shown in FIG. 8A. In other words, the block 11 stays at substantially the same position even when the tail edge side shaft 7 is rotated to a position shown in FIG. 8C from the position of that shown in FIG. 8A. Therefore, the block 11 is not pushed up by the flat surface 7*a* of the tail edge side shaft 7 at the time shown in FIG. 8 C and FIG. 8D, thereby the space formed between the tail edge side clamping base 3 and the tail edge side clamp 5 remains a condition of open.

The pushing shaft 46T of the second air cylinder 46 is moved contractedly in the direction of the arrow 93 immediately after pushing the roller 34 connected to the second lever 27. Thereafter, the plate 10 is pushed to the cylinder surface of the plate cylinder 60 by a plate pushing roller (not shown) being moved along with the cylinder surface of the plate cylinder 60. The plate pushing roller is located at a position adjacent to the cylinder surface. Then the plate cylinder 60 is rotated about the cylinder shaft 60J in the direction the arrow 101 with pushing the plate 10 by the plate pushing roller.

The plate 10 is disposed on the cylinder surface of the plate cylinder 60 with pushing force of the plate pushing roller by the rotation of the plate cylinder 60. None of the manual operating gear 20, the tail edge side gear 21, the leading edge side gear 22, the first lever driving gear 23, the idler gear 24 and the second lever driving gear 25 are rotated together with the plate cylinder 60, and the leading edge side clamp 4, the tail edge side clamping base 3 and tail edge side clamp 5 maintain the positions shown in FIG. 8C during the rotation of the plate cylinder 60.

The rotation of the plate cylinder 60 is suspended when the plate 10 is disposed on the cylinder surface almost completely. The tail edge side part 10*b* of the plate 10 is inserted between the tail edge side clamping base 3 and the tail edge side clamp 5. After the insertion of the tail edge side part 10*b*, the plate cylinder 60 is rotated again in the direction of the arrow 101, and the roller shaft 40T of the first air cylinder 40 is moved extendedly in the direction of the arrow 94. The first air cylinder 40 maintains the position of the roller shaft 40T.

As described earlier, the roller shaft 40T reaches the position on the track formed by the rotation of the roller 33 connected to the first level 26 when the roller shaft 40T is moved extendedly in the direction of the arrow 94. The roller 33 is pushed by the roller shaft 40T in accordance with the rotation of the plate cylinder 60 as a result of contact of the roller shaft 40T with a first point of action 33*a* of the roller 33 because the first air cylinder 40 is rigidly fixed to the frame 18 of the printing machine.

The first lever driving gear stud 30 is rotated in the direction of the arrow 102 by the movement of the first lever 26 which fix the roller 33 thus pushed. The rotation of the first lever driving gear stud 30 is conveyed to the first lever driving gear 23 because the first lever driving gear 23 is fixed to the first lever driving gear stud 30. Consequently, the first lever driving gear 23 is rotated in the direction of the arrow 102 when the first lever driving gear stud 30 is rotated. As described earlier, each of the second lever driving gear 25, the idler gear 24, the first lever driving gear 23, the leading edge side gear 22, the tail edge side gear 21 and a manual operating gear 20 is engaged with adjacent gears. Thus, all the gears are rotated together with others because the rotation of the first lever driving gear 23 is conveyed to all the gears.

Figure 9A:
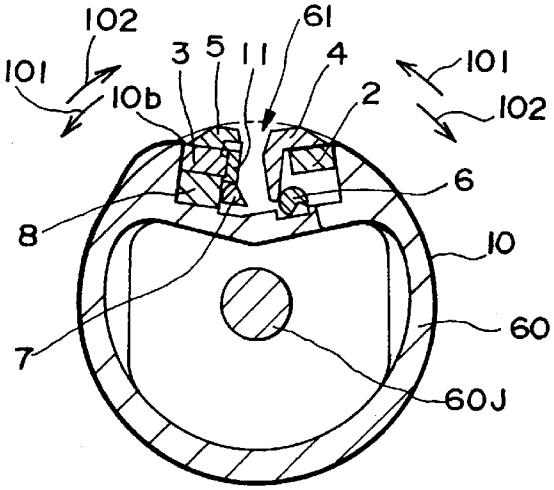
FIG. 9A is another cross sectional view taken along line I—I of FIG. 1 in a different condition.
Figure 9B:
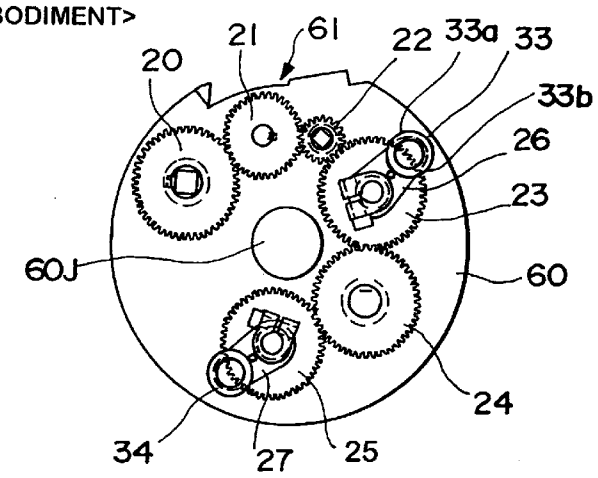
FIG. 9B is another side view looking in the direction of the arrow S1 of FIG. 1 in a different condition.

FIG. 9A and FIG. 9B are views showing a condition of the gears being rotated by the movement of the roller shaft 40T. As shown in FIG. 9A, the tail edge side shaft 7 is rotated in the direction of the arrow 102 from the condition shown in FIG. 8C because the tail edge side gear 21 is connected to the tail edge side shaft 7. In this manner, the tail edge side clamp 5 is closed in the direction of the arrow 101 by rotating about a tail edge supporting bolt 5J shown in FIG. 3 with the pushing force applied to the block 11 so as to push up in the direction of arrow 96 thereof as a result of contact of the circumferential surface 7*a* of the tail edge side shaft 7 with the block 11 (see FIG. 3).

The tail edge side part 10*b* of the plate 10 is clamped between the tail edge side clamping base 3 and the tail edge side clamp 5 by closing the tail edge side clamp 5 in the direction. At that time, a part of the plate 10 located at the vicinity of the tail edge side part 10*b* is not tightly fit onto the cylinder surface of the plate cylinder 60, so that looseness of the plate 10 is observed in the part of the plate 10. The circumferential surface 7*a* of the tail edge side shaft 7 shown in FIG. 3 is in contact with the side wall of the spring base 8 in the condition shown in FIG. 9A and FIG. 9B. Therefore, the movement of the spring base 8 in the direction of the arrow 90 is suspended by the circumferential surface 7*a* of the tail edge side shaft 7. Consequently, the position of the spring base 8 is unchanged.

The leading edge side gear 22 is also rotated in the direction of the arrow 101 by the rotation of the first lever driving gear 23 caused by the movement of the roller shaft 40T of the first air cylinder 40 (see FIG. 8A and FIG. 8C). However, the rear end 4K of the leading edge side clamp 4 is in contact with the circumferential surface 6*a* having the equal radius L1 from the center point P1 as shown in FIG. 4A. Therefore, the leading edge side part 10*a* of the plate 10 is clamped between the leading edge side clamping base 2 and the leading edge side clamp 4 with a certain clamping force regardless of a degree of the plate cylinder 60 because the leading edge side shaft 6 still maintains its pushing force to the rear end 4K of the leading edge side clamp 4.

Figure 9C:
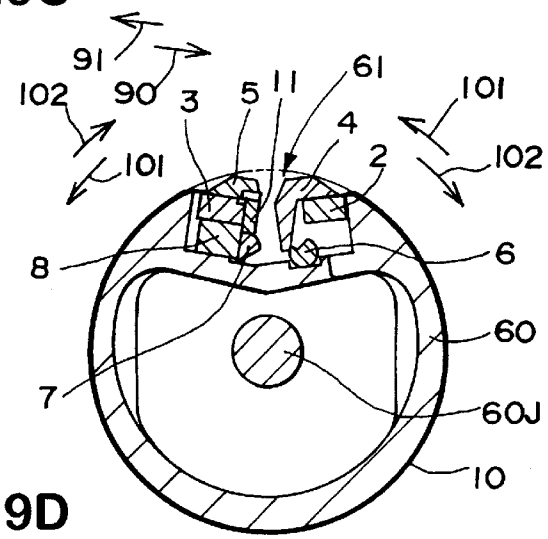
FIG. 9C is still another cross sectional view taken along line I—I of FIG. 1 in a different condition.
Figure 9D:
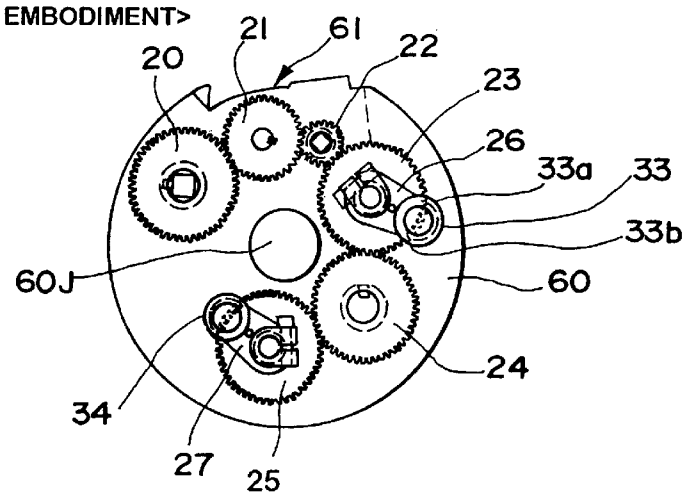
FIG. 9D is still another side view looking in the direction of the arrow S1 of FIG. 1 in a different condition.

The plate cylinder 60 is further rotated from the condition shown in the FIG. 9A and FIG. 9B, thereby the roller 33 being in contact with the first point of action 33*a* of the roller 33 is pushed by the roller shaft 40T of the first air cylinder 40. As a result, the tail edge side shaft 7 connected to the tail edge side gear 21 is further rotated in the direction of the arrow 102. The flat surface 7*c* of the tail edge side shaft 7 is located at a position opposed to the side wall of the spring base 8 by the rotation of the tail edge side shaft 7. FIG. 9C and FIG. 9D are views showing the rotation of the tail edge side shaft 7.

The spring base 8 being pushed by the coil springs 9 is moved in the direction of the arrow 90 by releasing the restriction caused by the circumferential surface 7*a* as a result of opposing the flat surface 7*c* of the tail edge side shaft 7 to the side wall of the spring base 8. Therefore, the tail edge side part 10*b* of the plate 10 is pulled in the direction of the arrow 90, thereby the plate 10 is fitted tightly onto the cylinder surface of the plate cylinder 60. In order to apply sufficient tension to the plate 10 for tightening thereof, the spring base 8 is moved until a position so as not to contact the side wall with the flat surface 7*c* of the tail edge side shaft 7.

The roller shaft 40T is moved contractedly in the direction of the arrow 95 after tightening the plate 10 onto the cylinder surface of the plate cylinder 60. At that time, the plate pushing roller described earlier is detached from the cylinder surface. Printing work will be started after fixing the plate 10.

Upon completion of the printing work, the plate 10 is ejected from the plate cylinder 60. In order to eject the plate 10 from the plate cylinder 60, the plate cylinder 60 is rotated in the direction of the arrow 101 from the position shown in FIG. 9C and FIG. 9D both of which illustrate the condition of fixing the plate 10 onto the cylinder surface, and the roller shaft 40T of the first air cylinder 40 is moved extendedly in the direction of the arrow 94. The rotation of the plate cylinder 60 is suspended when the plate cylinder 60 is moved slightly in the direction of the arrow 101. As a result of the rotation, the roller shaft 40T of the first air cylinder 40 is located at a position adjacent to a second point of action 33*b* of the roller 33.

The plate cylinder 60 is rotated in the direction of the arrow 102 opposite to the rotating direction for fixing the plate 10 to the cylinder surface. In this way, the roller shaft 40T of the first air cylinder 40 is in contact with the second point of action 33*b* of the roller 33. The first lever 26 connecting the roller 33 is rotated in the direction of the arrow 101 by maintaining the contact between the roller shaft 401 and the second point of action 33*b* during the rotation of the plate cylinder 60. The plate 10 is ejected from the plate cylinder 60 by performing the procedures described above in reversed order as a result of rotating the first lever 26 in the direction of the arrow 101.

In other words, the spring base 8 is moved in the direction of the arrow 91 as a result of contact of the circumferential surface 7*a* of the tail edge side shaft 7 with the side wall of the spring base 8 by the rotation of the tail edge side shaft 7 in the direction of the arrow 101. Therefore, the plate 10 is loosened from the cylinder surface of the plate cylinder 60 (see FIG. 9A and FIG. 9B). The tail edge side clamp 5 is opened by contacting the flat surface 7*b* of the tail edge side shaft 7 with the block 11 as a result of the rotation of the first lever 26 in the direction of the arrow 101 as shown in FIG. 8C and FIG. 8D. Further, the leading edge side clamp 4 is opened by plunging the rear end 4K of the leading edge side clamp 4 into the circumferential surface 6*a* of the leading edge side shaft 6 as a result of rotating the leading edge side shaft 6 in the direction of the arrow 102 continuously. Thus, the plate 10 is ejected from the plate cylinder 60. The second air cylinder 46 is not used in the procedures for ejecting the plate 10.

In case of suspending the rotation of the plate cylinder 60 during the procedures for fixing or ejecting the plate 10, the procedures can be performed by rotating the manual operating gear 20 shown in FIG. 5. The manual operating gear 20 can be rotated with a force by hooking a tool such as spanner wrench or the like on a manual operating gear stud 28 and rotating the spanner wrench in either direction. All the related parts can be operated under a manual basis by rotating the manual operating gear 20 engaged with the tail edge side gear 21 with a force.

The tail edge side shaft 7 functions as a shaft for opening and closing movements, as well as a shaft for movement in this embodiment. In other words, a single shaft such as the tail edge side shaft 7 is used instead of the shaft for opening and closing movements and the shaft for movement in this embodiment. The flat surface 7*b* of the tail edge side shaft 7 shown in FIG. 4B forms a region for opening movement, and the circumferential surface 7*a* of the tail edge side shaft 7 shown in FIG. 4B forms a region for closing movement, or a region for restricting movement. Also the flat surface 7*c* of the tail edge side shaft 7 shown in FIG. 4B forms a region for allowing movement.

(2) Second Embodiment

Figure 10:
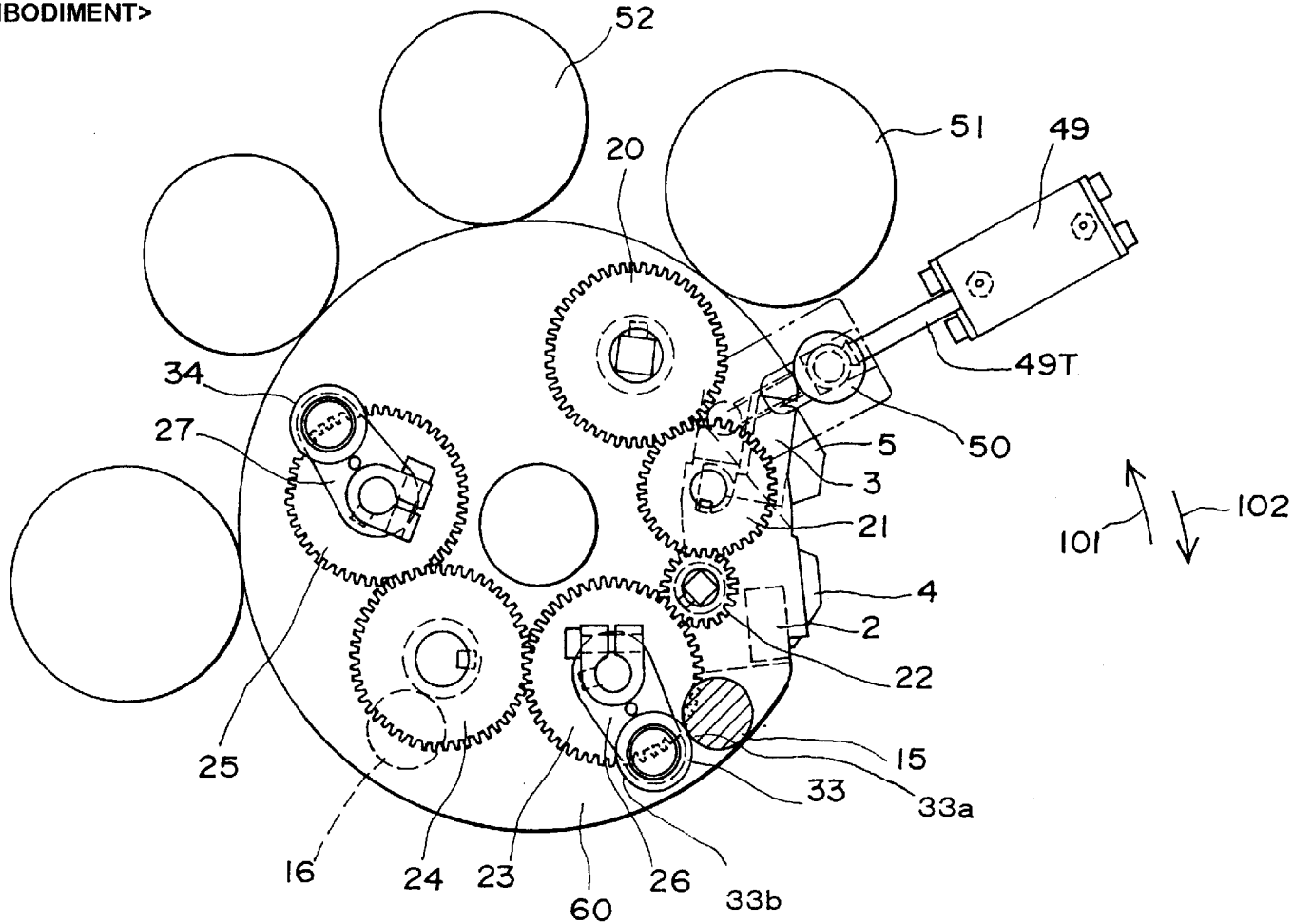
FIG. 10 is a side view of the plate cylinder 60 of the second embodiment of the apparatus for driving a clamping device for fixing a plate on the plate cylinder of a printing machine in accordance with the present invention. The view showing a condition of disposing the plate on the cylinder surface.
Figure 11:
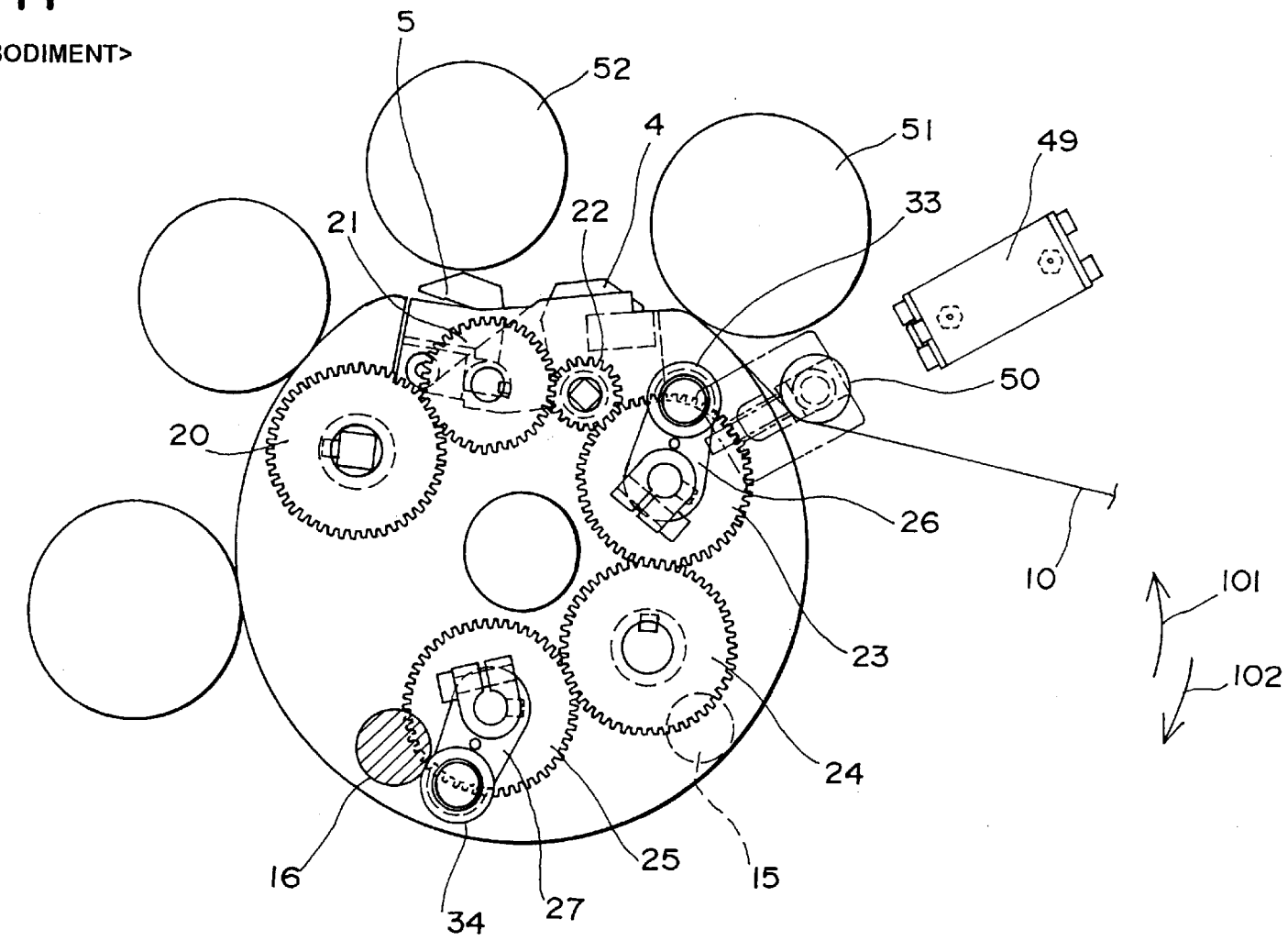
FIG. 11 is another side view of the plate cylinder 60 of the second embodiment of the apparatus for driving a clamping device for fixing a plate on the plate cylinder of a printing machine in accordance with the present invention. The view shows a condition of ejecting the plate from the cylinder surface.

Next, the second embodiment of an apparatus for driving a clamping device for fixing a plate on the plate cylinder of a printing machine in accordance with the present invention will be described with reference to FIG. 10 and FIG. 11. FIG. 10 is a side view of the plate cylinder 60 in a condition of disposing the plate on the cylinder surface. FIG. 11 is another side view of the plate cylinder 60 of the second embodiment in a condition of ejecting the plate from the cylinder surface. In the first embodiment described above, just one air cylinder for pushing the roller 33 such as the first cylinder 40 is provided to the apparatus for driving a clamping device, and the roller shaft 40T of the first cylinder 40 is used for both disposing the plate on the cylinder surface and for ejecting the plate from the cylinder surface.

However, the first cylinder 40 provided solely can not be used for both disposing the plate on the cylinder surface and for ejecting the plate from the cylinder surface for the reason of arrangement of the peripherals provided adjacent to the plate cylinder 60. The plate 10 is disposed onto the cylinder surface of the plate cylinder 60 by a plate pushing roller 50 with some pushing force as shown in FIG. 10. In order to dispose the plate 10 as much as possible on the cylinder surface with the plate pushing roller 50, it is necessary for the leading edge side clamping base 2 and the leading edge side clamp 4 to position as close as possible to the plate pushing roller 50 when the leading edge side part 10*a* of the plate 10.

Therefore, the plate clamping position of the plate cylinder 60 is determined based on the arrangement of the peripherals such as the plate pushing roller 50 or the like provided adjacent to the plate cylinder 60. The roller shaft 40T extendedly moving from the first air cylinder 40 is in contact with the first point of action 33*a* of the roller 33 when the plate is disposed on the cylinder surface as described in the first embodiment. In this connection, it is necessary for the first air cylinder 40 to locate at a position capable of contacting the roller shaft 40T with the first point of action 33*a* of the roller 33 when the plate is disposed on the cylinder surface. The plate pushing roller 50 is connected with a rod 491 extended from or contracted into an air cylinder 49 as shown in FIG. 10.

Further, in order to wipe off the ink applied on the plate 10, it is necessary for the plate 10 to pass through a water form roller 51 as shown in FIG. 11. By doing that, the plate 10 being wiped off of the ink can be ejected. On the other hand, the plate 10 being applied with ink thereon is ejected when the plate 10 is pulled between a first ink form roller 52 and the water form roller 51.

Hence, a position for ejecting the plate is determined based on the arrangement of the peripherals such as the first ink form roller 52 and the water form roller 51. As described in the first embodiment, the roller shaft 40T extendedly moving from the first air cylinder 40 is in contact with the second point of action 33*b* of the roller 33 when the plate is ejected from the cylinder surface. In this connection, it is necessary for the first air cylinder 40 to locate at a position capable of contacting the roller shaft 40T with the second point of action 33*b* of the roller 33 when the plate is ejected from the cylinder surface.

As described above, positions of the plate cylinder 60 during the procedures for fixing or ejecting the plate 10 is restricted by the arrangement of the peripherals provided adjacent thereby. In this manner, the first air cylinder 40 can not be used for both disposing the plate on the cylinder surface and for ejecting the plate from the cylinder surface in some cases.

Two of first air cylinders are provided in this embodiment to remove the restriction stated above. FIG. 10 shows the plate cylinder 60 in a condition of disposing the plate on the cylinder surface, in which the tail edge side part 10*b* of the plate 10 inserted between the tail edge side clamping base 3 and the tail edge side clamp 5 is clamped therebetween after clamping the leading edge side part 10*a* of the plate 10 between the leading edge side clamping base 2 and the leading edge side clamp 4.

In this embodiment, a first roller shaft 15 equipped with one of the first air cylinder is in contact with the roller 33 connected to the first lever 26 by extendedly moving the first roller shaft 15 parallel to the cylinder shaft 60J. The first lever 26 is rotated in the direction of the arrow 102 relative to the plate cylinder 60 by rotating the plate cylinder 60 in the direction of the arrow 101 from the condition shown in FIG. 10. Then, the plate 10 clamped between the tail edge side clamping base 3 and the tail edge side clamp 5 is tightly fitted onto the cylinder surface of the plate cylinder 60 by moving the tail edge side clamping base 3 and the tail edge side clamp 5 in the direction of the arrow 90 after closing the tail edge side clamp 5 similar to the first embodiment described above.

In the procedures for ejecting the plate 10 shown in FIG. 11, a second roller shaft 16 equipped with the other first air cylinder is extendedly moved parallel to the cylinder shaft 60J. The roller 34 connected to the second lever 27 is used when the plate 10 is ejected from the cylinder surface in this embodiment. The second roller shaft 16 reaches a position capable of being contacted with the roller 34 connected to the second lever 27. The second lever 27 is rotated in the direction of the arrow 101 relative to the plate cylinder 60 by rotating the plate cylinder 60 in the direction of the arrow 102 from the condition shown in FIG. 11.

By the rotation of the second lever 27, the tail edge side part 10*b* of the plate 10 is released by opening the tail edge side clamp 5 similar to the first embodiment described above. The release of the plate 10 is caused by loosening the plate 10 from the cylinder surface of the plate cylinder 60 as a result of moving the tail edge side clamping base 3 and the tail edge side clamp 5 in the direction of the arrow 91. Thereafter, the leading edge side part 10*a* of the plate 10 is released by opening the leading edge side clamp 4 by rotating the plate cylinder 60 in the direction of the arrow 102 further to the condition shown in FIG. 11.

Both the first roller shaft 15 used for performing the procedures for clamping the plate 10 and the second roller shaft 16 used for carrying out the procedures for ejecting the plate 10 can extendedly be moved at two different positions by using two of the first air cylinders as described in this embodiment. Therefore, flexibility of the control for the apparatus in this embodiment is increased even when the arrangement of the peripherals is unchanged. The structure employed in this embodiment remains the same as the structure in the first embodiment except for the first air cylinders.

(3) Third Embodiment

Figure 12:
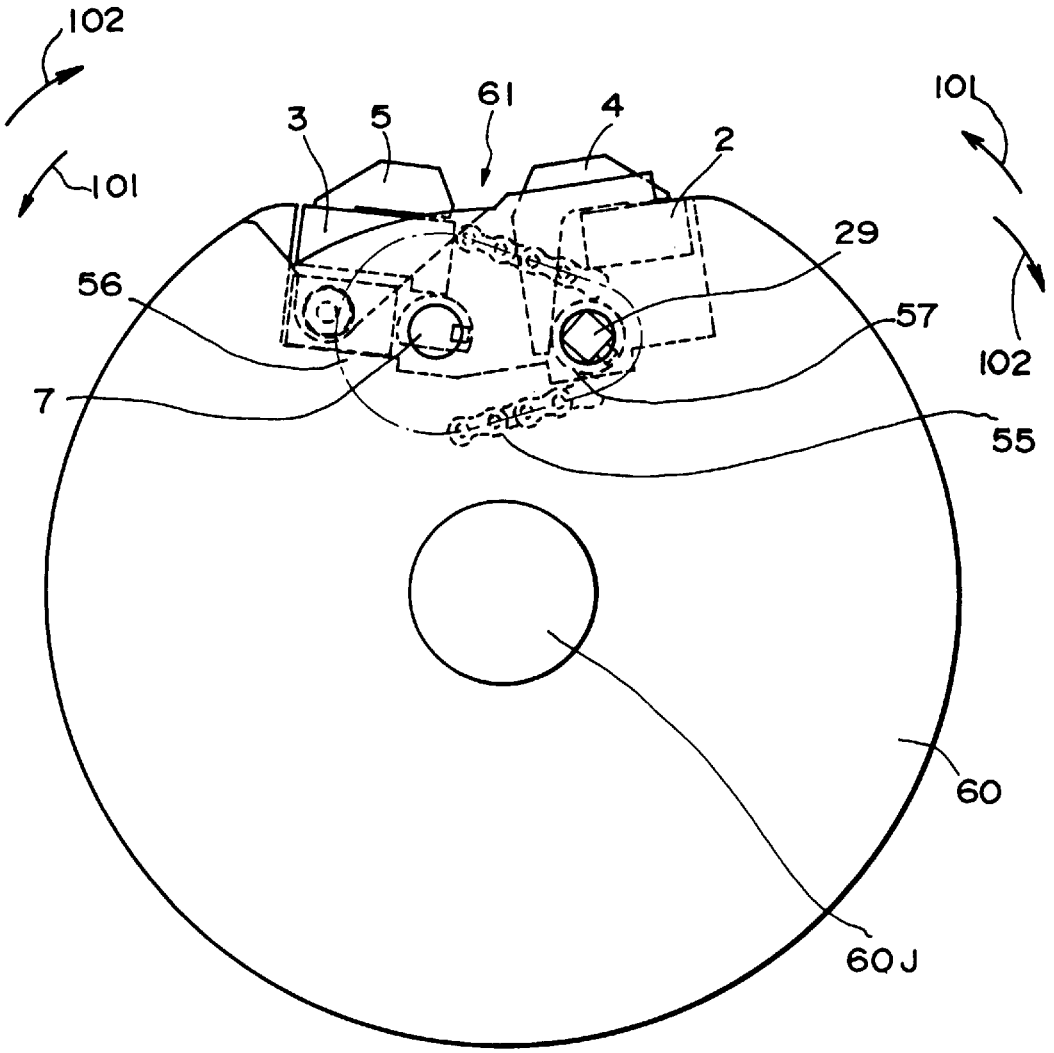
FIG. 12 is a side view of the plate cylinder 60 of the third embodiment of the apparatus for driving a clamping device for fixing a plate on the plate cylinder of a printing machine in accordance with the present invention.

Next, the third embodiment of an apparatus for driving a clamping device for fixing a plate on the plate cylinder of a printing machine in accordance with the present invention will be described with reference to FIG. 12. FIG. 12 is a side view of the plate cylinder 60. Both the tail edge side gear 21 and the leading side edge gear 22 are directly engaged with each other in the first and the second embodiment described in above. However, as shown in FIG. 12, a tail edge side sprocket 56 connected to the tail edge side shaft 7 and a leading edge side sprocket 57 fixed to the leading edge side shaft 6 through the leading edge side gear stud 29 are interlocked with each other by a chain 55 in this embodiment.

The tail edge side shaft 7 and the leading edge side gear stud 29 are rotated in the same direction since the tail edge side shaft 7 is interlocked with the leading edge side gear stud 29 by the chain 55 unlike the embodiments described above so as to engage the tail edge side gear 21 and the leading side edge gear 22 directly with each other.

By employing the structure described above, it is necessary to change the shape of the leading edge side shaft 6 in a shape capable of making the leading edge side clamp 4 to close in the direction of the arrow 102 by rotating the leading edge side gear stud 29 in the direction of the arrow 102 in this embodiment shown in FIG. 12.

Although, other gears forming the interlocking part are not shown in FIG. 12, the gears can be interlocked with one another by using chains similar to the tail edge side sprocket 56 and the leading edge side sprocket 57. For instance, the leading edge side gear 22 used in the first embodiment can be connected to the leading edge side gear stud 29 together with the leading edge side sprocket 57. And the leading edge side gear 22 thus connected can be engaged with the first lever driving gear 23 used in the first embodiment.

(4) Fourth Embodiment

Figure 13:
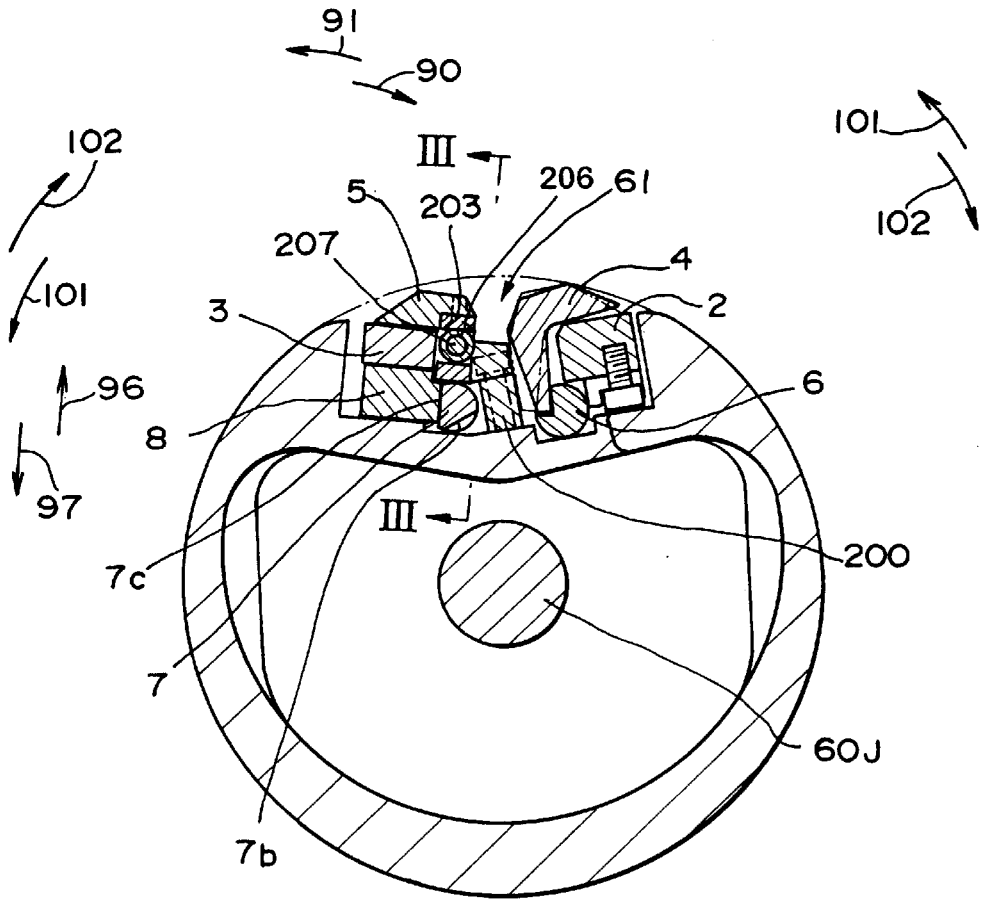
FIG. 13 is a side view of the plate cylinder 60 of the fourth embodiment of the apparatus for driving a clamping device for fixing a plate on the plate cylinder of a printing machine in accordance with the present invention. The view showing a cross sectional view taken along line IV—IV of FIG. 14.
Figure 14:
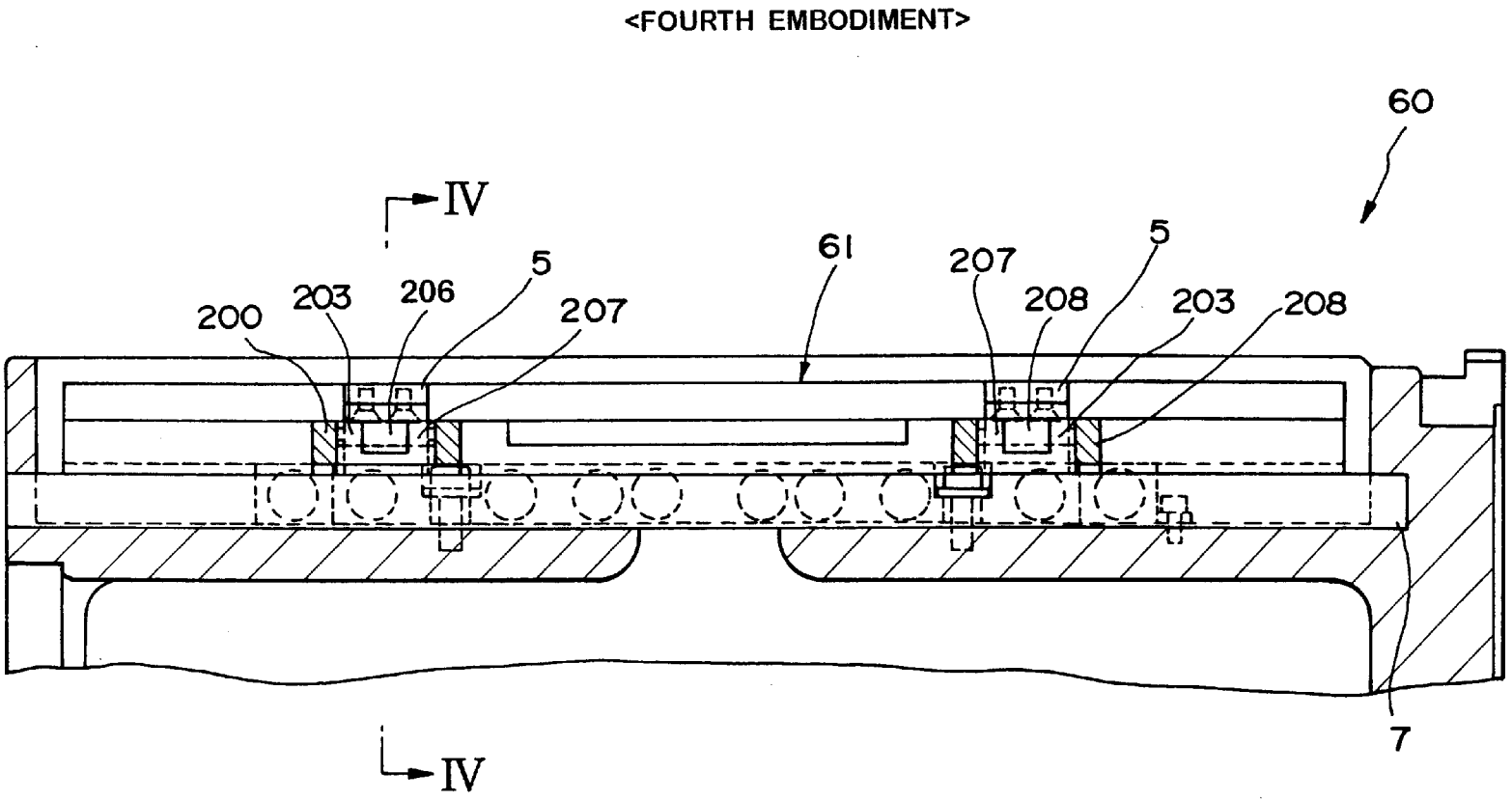
FIG. 14 is a cross sectional view taken along line III—III of FIG. 13.
Figure 15:
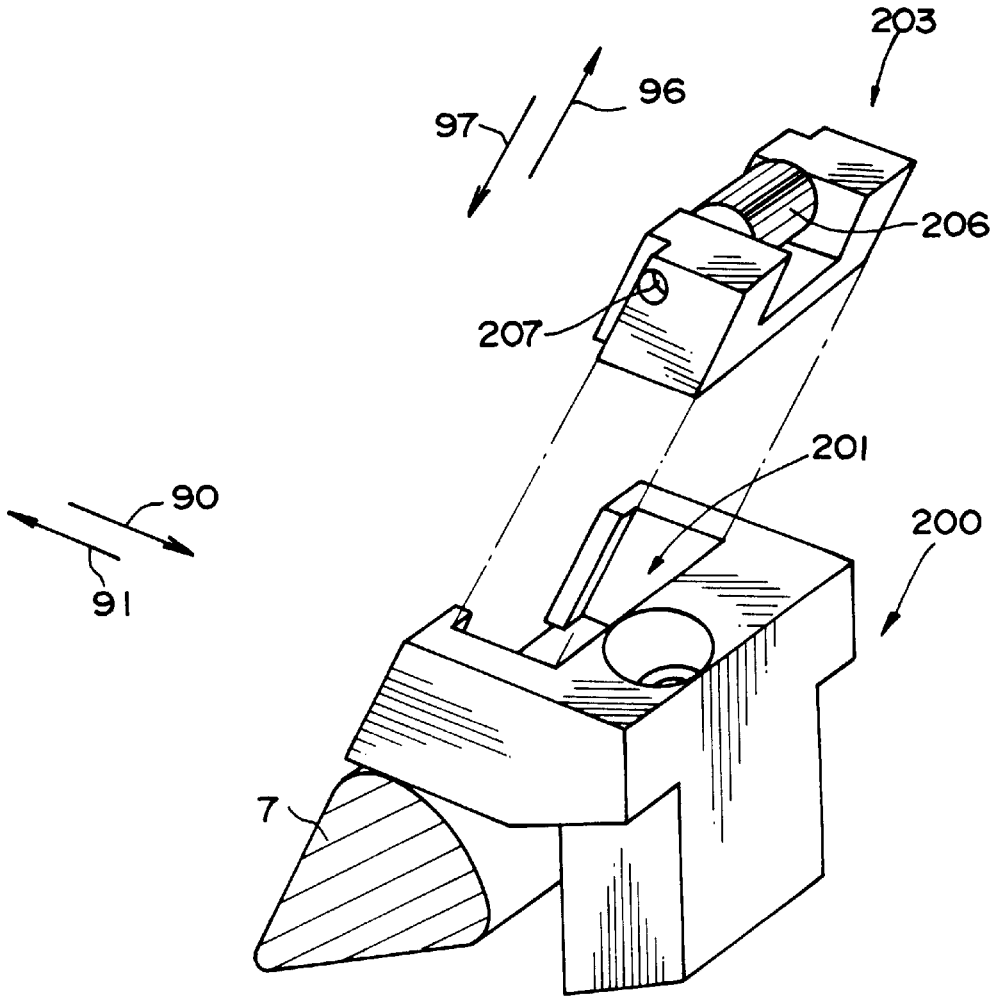
FIG. 15 is a perspective view of the supporting base 200 and the block 203 shown in FIG. 13 and FIG. 14.

Next, the fourth embodiment of all apparatus for driving a clamping device for fixing a plate on the plate cylinder of a printing machine in accordance with the present invention will be described with reference to FIG. 13, FIG. 14 and FIG. 15. FIG. 13 is a sectional side elevation of the plate cylinder 60, and FIG. 14 shows a front view of the section. FIG. 13 shows a cross sectional view taken along line IV—IV of FIG. 14, and FIG. 14 shows a cross sectional view taken along line III—III of FIG. 13. Further, FIG. 15 is a perspective view of a supporting base 200 and a block 203 shown in FIG. 13 and FIG. 14.

A block 203 is used in this embodiment instead of the block 11 shown in the first embodiment[in this embodiment]. The block 11 shown in the first embodiment is supported by the tail edge side clamping base 3 so as to be moved together with the tail edge side clamping base 3 as a unit within the cut-out part 61 in the directions of the arrow 90 and the arrow 91.

On the contrary, the block 203 used in this embodiment is supported in the supporting base 200 which is fixed to the cut-out part 61. The supporting base 200 is fixed to the bottom of the cut-out part 61 by a screw bolt. The block 203 is supported by the supporting base 200 by inserting the block 203 into a block supporting space 201 formed in the supporting base 200. The block 203 is movable in the directions of an arrow 96 and an arrow 97 within the block supporting space 201 formed in the supporting base 200. But the block 203 is not moved in the directions of the arrow 90 and the arrow 91 (see FIG. 13).

The block 203 is not moved in the directions of the arrow 90 and the arrow 91 regardless of the movement of the tail edge side clamping base 3 unlike [to] the block 11 shown in the first embodiment because the block 203 used in this embodiment is supported by the supporting base 200. Further, a roller 206 is provided to the block 203. The roller 206 is supported to the block 203 so as to be rotated about a shaft 207. The remaining structures are the same as the first embodiment.

FIG. 13 shows a condition that the spring base 8 is moved in the direction of the arrow 90 by releasing the restriction caused by the tail edge side shaft 7. In other words, FIG. 13 is a view corresponds to the FIG. 9C in the first embodiment. The tail edge side clamping base 3 is located at a position apart from the block 203 (not shown) when the spring base 8 is pushed in the direction of the arrow 91 with the restriction caused by the tail edge side shaft 7 (see FIG. 8A, FIG. 8C and FIG. 9A in the first embodiment).

The rear end of the tail edge side clamp 5 is in contact with the roller 206 of the block 203 even when the tail edge side clamping base 3 is located at a position apart from the block 203. The rear end of the tail edge side clamp 5 is pushed up with the block 203 being moved in the direction of the arrow 96 by the rotation of the tail edge side shaft 7 when the tail edge side shaft 7 is rotated in the direction of the arrow 102. The change of condition is carried out similar to the change performed during the procedure shown in FIG. 8C to FIG. 9A in the first embodiment. In this way, the tail edge side part 10*b* of the plate 10 is clamped between the tail edge side clamping base 3 and the tail edge side clamp 5 by closing the tail edge side clamp 5 (see FIG. 9A in the first embodiment).

Thereafter, the tail edge side clamping base 3 is moved in the direction of the arrow 90 together with the movement of the spring base 8 in the direction of the arrow 90 as a result of releasing the restriction caused by the tail edge side shaft 7 as shown in FIG. 13 when the tail edge side shaft 7 is rotated further in the direction of the arrow 102. The tail edge side clamp base 5 is moved in the direction of the arrow 90 with the roller 206 rotating by the rear end thereof because the roller 206 is supported to the block 203 so as to be rotatable.

By rotating the roller 206, the tail edge side part 10*b* of the plate 10 can be pulled by moving both the tail edge side clamping base 3 and the tail edge side clamp base 5 smoothly as a result of reducing the friction caused between the tail edge side clamp 5 thus moved and the block 203. On the other hand, both the tail edge side clamping base 3 and the tail edge side clamp base 5 are smoothly moved as a result of reducing the friction by rotating the roller 206 when the tail edge side clamping base 3 and the tail edge side clamp base 5 are moved backwardly in the direction of the arrow 91.

Thus, the plate 10 can be pulled reliably by securing a smooth movement of members by providing one of the members which reduces friction (such as the roller 206 in this embodiment) between another member which is moved for tensioning the plate 10 (such as the tail edge side clamp base 5 in this embodiment) and another member which is not moved (such as the block 203). Any member(s) capable of reducing the friction can be employed for the roller 206.

(5) Fifth Embodiment

Figure 17B:
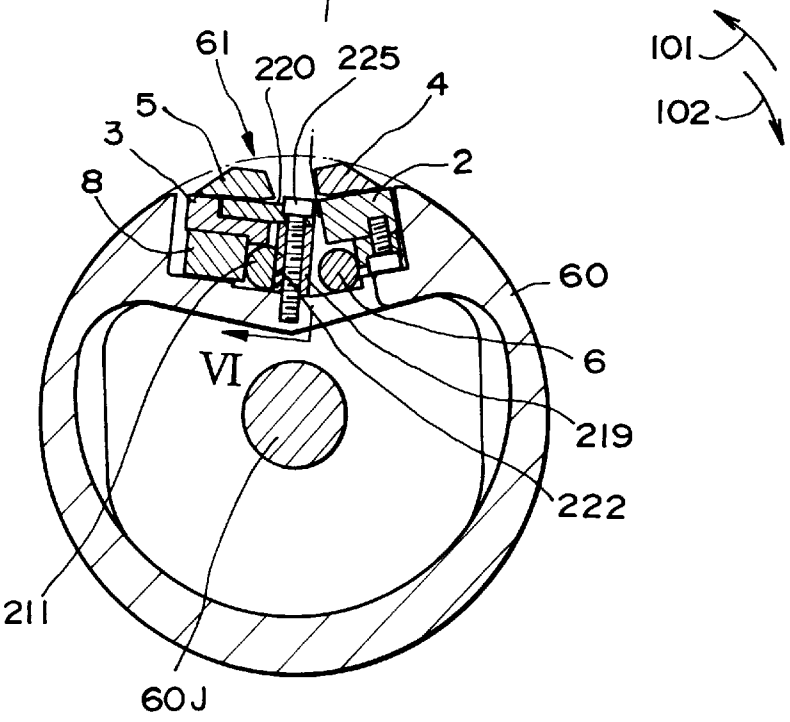
FIG. 17B is another side view of the plate cylinder 60 shown in FIG. 1 in different condition. The view showing another cross sectional view taken along line IX—IX of FIG. 19.
Figure 17A:
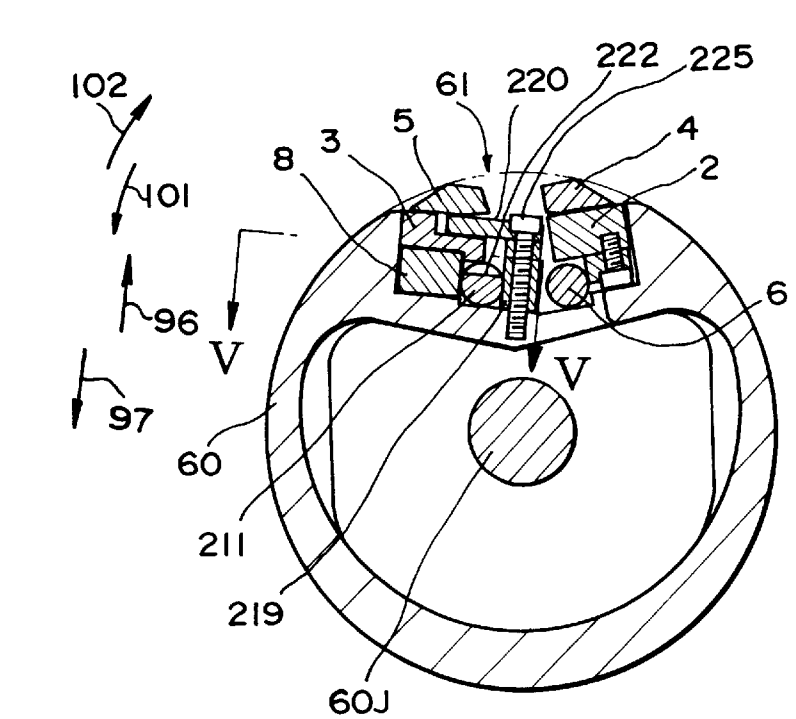
FIG. 17A is a side view of the plate cylinder 60 shown in FIG. 1. The view showing a cross sectional view taken along line IX—IX of FIG. 19.
Figure 18:
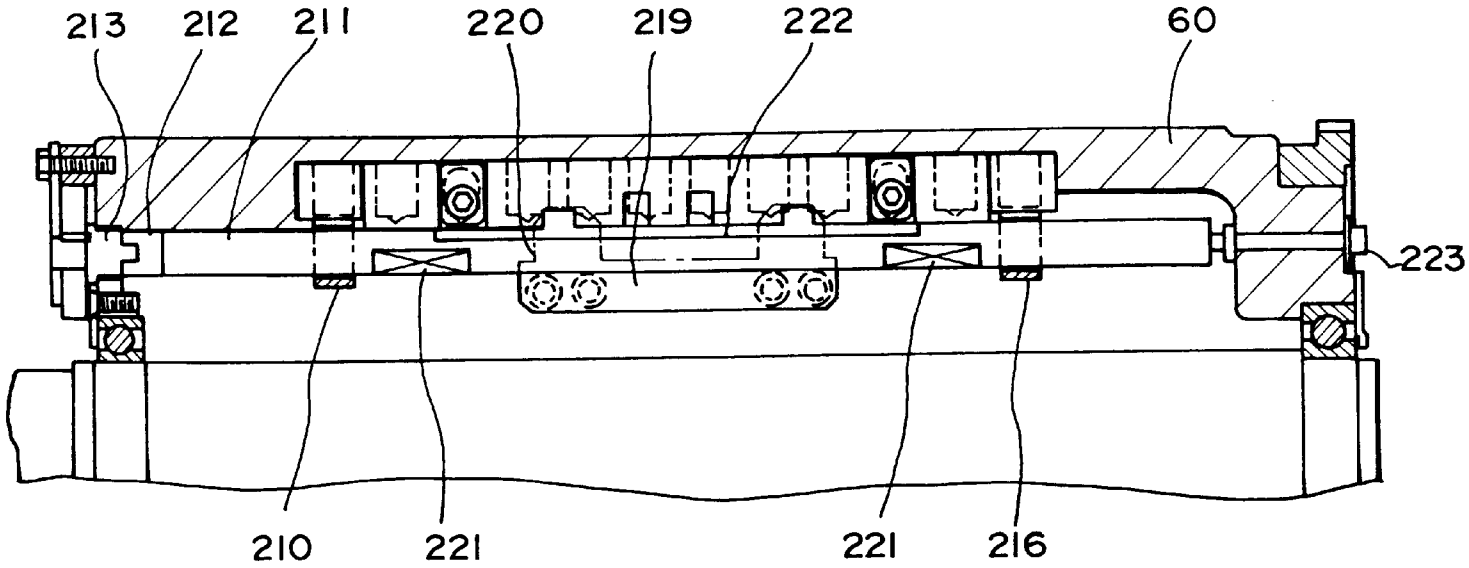
FIG. 18 is a cross sectional view taken along line V—V of FIG. 17A.

Next, the fifth embodiment of an apparatus for driving a clamping device for fixing a plate on the plate cylinder of a printing machine in accordance with the present invention will be described with reference to FIG. 16A, FIG. 16B, FIG. 17A, FIG. 17B, FIG. 18, FIG. 19, FIG. 20, FIG. 21A and FIG. 21B. FIG. 16A, FIG. 16B, FIG. 17A and FIG. 17B are sectional side elevations of the plate cylinder 60. Further, FIG. 18 is a cross sectional view taken along line V—V of FIG. 17A, and FIG. 19 is a cross sectional view taken along line VI—VI of FIG. 17B.

Figures 16A, 16B:
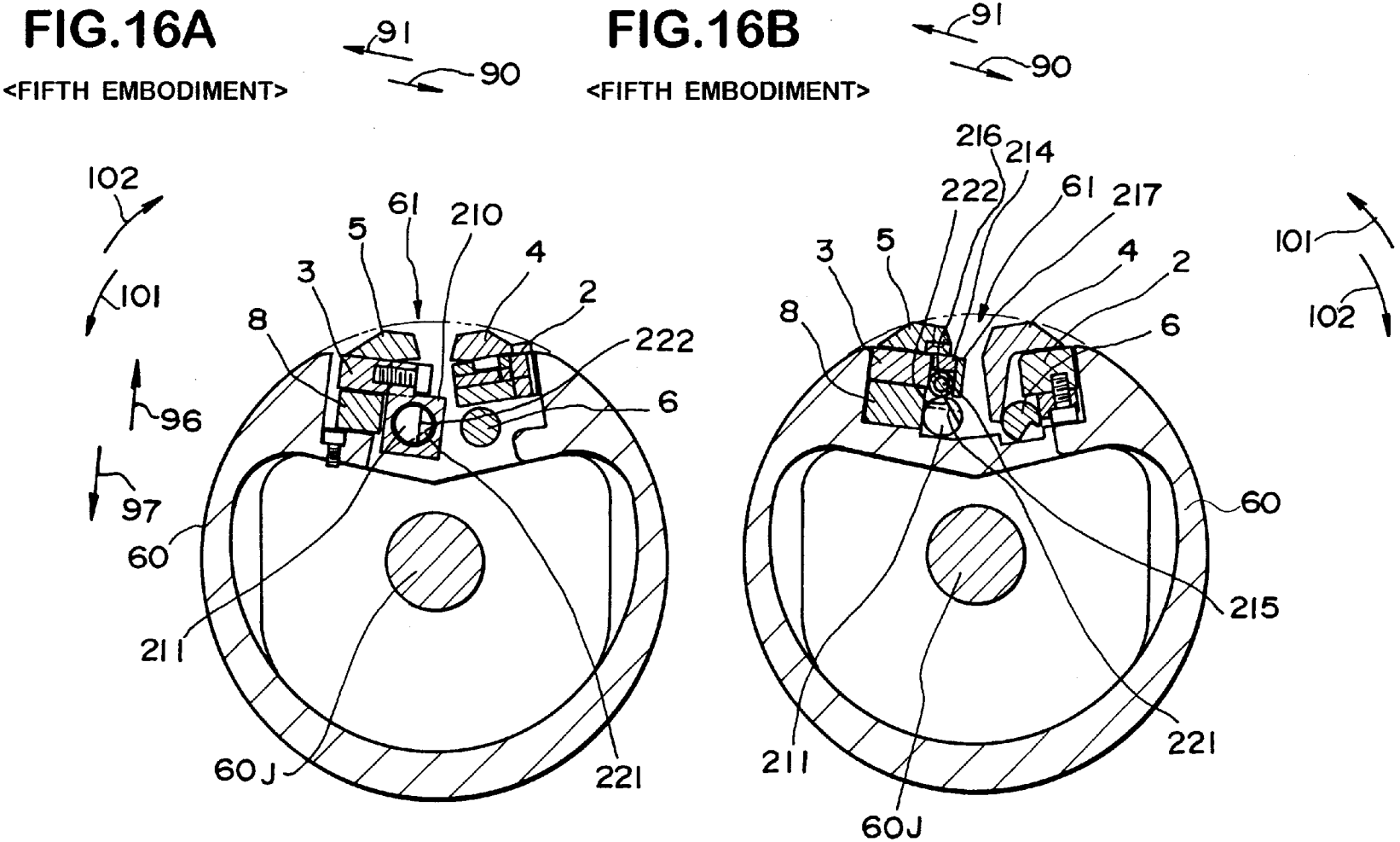
FIG. 16A is a side view of the plate cylinder 60 of the fifth embodiment of the apparatus for driving a clamping device for fixing a plate on the plate cylinder of a printing machine in accordance with the present invention. The view showing a cross sectional view taken along line VII—VII of FIG. 19.
FIG. 16B is a side view of the plate cylinder 60 of the fifth embodiment of the apparatus for driving a clamping device for fixing a plate on the plate cylinder of a printing machine in accordance with the present invention. The view showing a cross sectional view taken along line VIII—VIII of FIG. 19.
Figure 19:
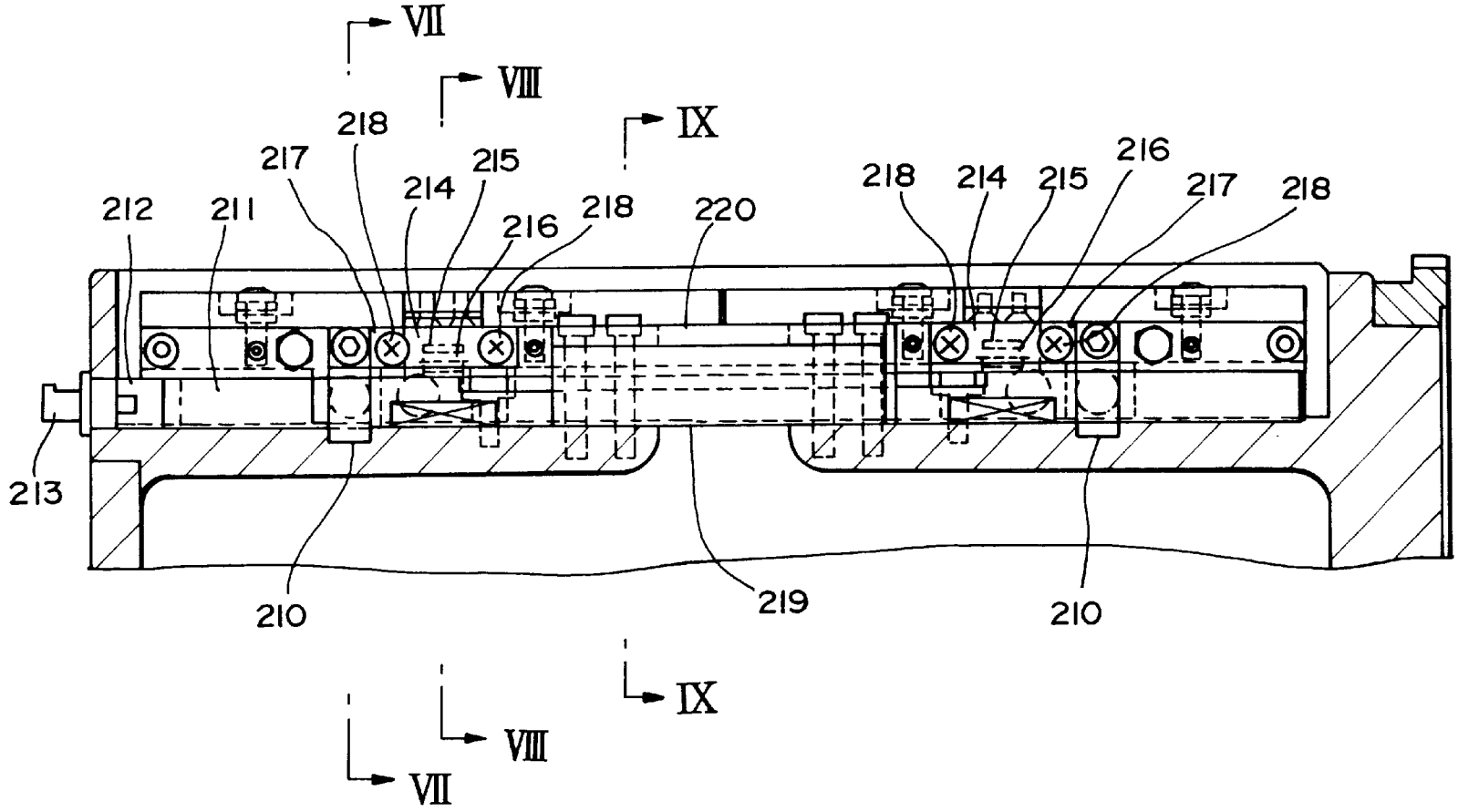
FIG. 19 is a cross sectional view taken along line VI—VI of FIG. 17B.
Figure 20:
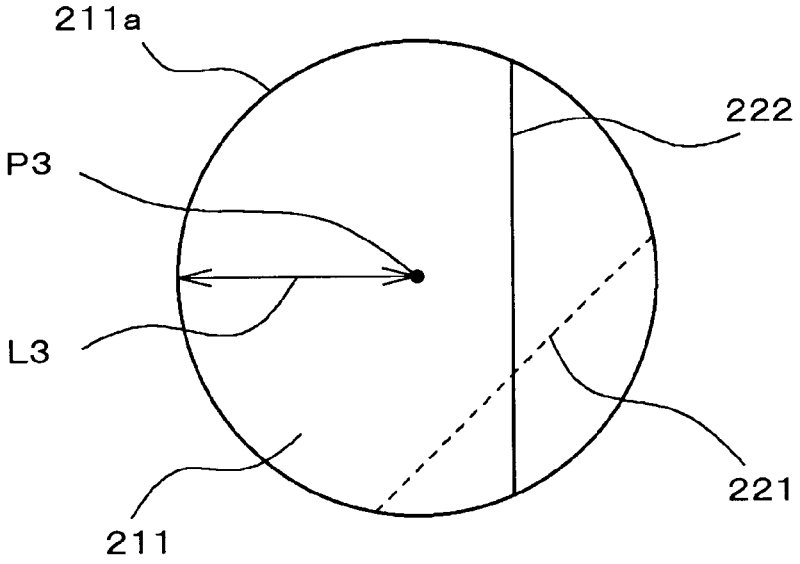
FIG. 20 is a detailed side view of the tail edge side shaft 211.

FIG. 16A is a cross sectional view taken along line VII—VII of FIG. 19, and FIG. 16B is a cross sectional view taken along line VIII—VIII of FIG. 19. Further, FIG. 17A and FIG. 17B are cross sectional views taken along line IX—IX of FIG. 19. Still further, FIG. 20 is a detailed side view of a tail edge side shaft 211. In addition, FIG. 21A is a perspective view of the tail edge side shaft 211, a coupler 212 and a stud 213 in detail, and FIG. 21B is a detailed perspective view of the tail edge side clamping base 3 (FIG. 16A) In this manner, the tail edge side clamping base 3, the tail edge side clamp 5, the bracket 210 and the tail edge side shaft 211 are moved in the directions of the arrow 90 and the arrow 91 as a unit.

A block 219 and a pressure plate 220 are fixed on the bottom of the cut-out part 61 with a screw bolt 225. The pressure plate 220 is located on the block 219 for preventing raising of the tail edge side clamping base 3 in an upward direction. The tail edge side clamping base 3, the tail edge side claim 5, the bracket 210 and the tail edge side shaft 211 are moved in the directions of the arrow 90 and the arrow 91 along with the pressure plate 220.

As shown in FIG. 21, the tail edge side shaft 211 is connected to the stud 213 through the coupler 212. The tail edge side shaft 211 has a groove for coupling, and the coupler 212 is equipped with a flange and a groove for coupling. The flange is formed for engaging the coupler 212 with the tail edge side shaft 211. Also, the stud 213 has a flange which is engaged with the groove of the coupler 212. The engagement maintained between the flange of the stud 213 and the groove of the coupler 212, and that maintained between the flange of the coupler 212 and the groove of the tail edge side shaft 211 are crossed with each other looking at a position on the stud 213. By employing the structure described above such as called Oldham's coupling, the rotation of the stud 213 is conveyed to the tail edge side shaft 211 reliably even when a rotation axis of the tail edge side shaft 211 and that of the stud 213 does not coincide with each other.

As shown in FIG. 18, a screw bolt 223 is screwed into and pass the side face of the plate cylinder 60 opposite to the side face having the stud 213. The tail edge side shaft 211 is in contact with an end of the screw bolt 223, and movement of the tail edge side shaft 211 along with the rotation axis is restricted by the screw bolt 223.

The tail edge side gear 211 shown in the first embodiment is connected to the stud 213, so that the tail edge side shaft 211 is rotated by the rotation of the leading edge side gear 22.

Details of the tail edge side shaft 211 will be described with reference to FIG. 20 illustrating a side view thereof. A circumferential surface 211*a* having an equal radius L3 from a center point P3 is formed on the tail edge side shaft 211. Further, a flat surface 221 and another flat surface 222 are formed on the tail edge side shaft 211. The lengths between the flat surface 221, the flat surface 222 and the center point P3 are less than that of the radius L3. Each of the flat surface 221 and the flat surface 222 is formed with different angle at different part of the tail edge side shaft 211.

As shown in FIG. 21B, a space 224 for installing a block is formed in the tail edge side clamping base 3, and a block 214 is installed into the space 224. A shaft 215 is provided in the block 214, and roller 216 is mounted to the shaft 215. The roller 216 is rotatable supported to the block 214.

The block 214 installed into the space 224 of the tail edge side clamping base 8 is covered with a plate 217. The plate 217 is fixed to the tail edge side clamping base 3 with screw bolts 218. In this manner, the block 214 is movable in the direction of the arrow 96 and the arrow 97 within the space 224. The remaining structures are remained the same as the first embodiment.

FIG. 16B and FIG. 17A are views showing a condition of closing the tail edge side clamp 5 as a result of moving the block 214 in the direction of the arrow 96. The block 214 is pushed in the direction of the arrow 96 with the tail edge side shaft 211 being rotated in the direction of the arrow 102. The tail edge side clamp 5 is still opened when the flat surface 221 formed on the tail edge side shaft 211 is in contact with the roller 216 of the block 214 because the block has not been pushed in the direction of the arrow 96 (not shown).

The block 214 is pushed in the direction of the arrow 96 as shown in FIG. 16B by contacting the circumferential face

211*a* of the tail edge side shaft 211 with the roller 216 of the block 214 as a result of rotating the tail edge side shaft 211 in the direction of the arrow 102. The block 214 can be moved smoothly in the direction of the arrow 96 as a result of reducing the friction caused between the tail edge side shaft 211 and the block 214 by the rotation of the roller 216 because the roller 216 is rotatably supported to the block 214 as described earlier.

The movement of the tail edge side clamping base 3, the tail edge side clamp 5, the bracket 210 and the tail edge side shaft 211 in the direction of the arrow 90 is restricted at the time of closing the tail edge side clamp 5 because the circumferential face 211*a* is in contact with the block 219 as shown in FIG. 17A. FIG. 16A and FIG. 17B are views showing a condition that the tail edge side shaft 211 is rotated further in the direction of the arrow 102 from the condition shown in FIG. 17A.

The tail edge side clamping base 3, the tail edge side clamp 5, the bracket 210 and the tail edge side shaft 211 are moved in the direction of the arrow 90 as a unit together with the spring base 8 because the flat face 222 is located at a position opposite to the block 219 by the rotation of the tail edge side shaft 211 as shown in FIG. 17B.

In this way, the tail edge side part 10*b* of the plate 10 clamped by the tail edge side clamp 5 is pulled in the direction of the arrow 90, thereby the plate 10 is fitted tightly onto the cylinder surface of the plate cylinder 60. The contact between the tail edge side shaft 211 and the stud 213 is maintained by the coupler 212 shown in FIG. 21A even when the tail edge side shaft 211 is moved in the direction of the arrow 90 together with the tail edge side clamping base 3, the tail edge side clamp 5, the bracket 210 as a unit. In addition, the tail edge side shaft 211 is moved in the direction of the arrow 90 with maintaining its rotation angle to the tail edge side clamping base 3.

The roller 216 is rotated when the tail edge side clamping base 3, the tail edge side clamp 5, the bracket 210 and the tail edge side shaft 211 are moved in the direction of the arrow 90 as a unit. Hence, the tail edge side clamping base 3, the tail edge side clamp 5, the bracket 210 and the tail edge side shaft 211 can be moved smoothly in the direction of the arrow 90 as a result of reducing the friction caused between the tail edge side shaft 211 and the block 214.

The friction caused between the tail edge side shaft 211 and the block 214 is reduced as a result of rotating the roller 216 of the block 214 when the tail edge side shaft 211 is rotated reversely in the direction of the arrow 102. The tail edge side shaft 211, the spring base 8 and the coil springs 9 form the movement control part in this embodiment.

Tensioning the plate 10 and closing the tail edge side clamp 5 can be performed reliably by securing a smooth movement of members by providing one of the members which reduces the friction (such as the roller 216 in this embodiment) between another member which is rotated in the cut-out part 61 of the plate cylinder 60 (such as the tail edge side shaft 211 in this embodiment) and another member which is in contact with the member being rotated (such as the block 214 in this embodiment). Any member(s) capable of reducing the friction can be employed for the roller 216 as long as the member(s) can reduce the friction.

Further, the tail edge side shaft 211 also functions as the shaft for opening and closing movements and the shaft for movement in this embodiment. In other words, the tail edge side shaft 211 is used instead of both the shaft for opening and closing movements and the shaft for movement in this embodiment. The flat surface 221 of the tail edge side shaft 211 forms the region for opening movement, and the circumferential face 211*a* forms the region for closing movement in this embodiment. Further, the flat face 222 functions as the region for allowing movement in this embodiment.

(6) Sixth Embodiment

Next, the sixth embodiment of an apparatus for driving a clamping device for fixing a plate on the plate cylinder of a printing machine in accordance with the present invention will be described with reference to FIG. 22, FIG. 23, FIG. 24, FIG. 25, FIG. 26A, FIG. 26B, FIG. 27, FIG. 28, FIG. 29A, FIG. 29B, FIG. 29C, FIG. 29D, FIG. 30A, FIG. 30B, FIG. 30C and FIG. 30D.

FIG. 22 is a side view of the plate cylinder 60, and FIG. 23 is a cross sectional view taken along line X—X of FIG. 22. Further, FIG. 24 is another cross sectional view taken along line XI—XI of FIG. 22, and FIG. 25 is far another cross sectional view taken along line XII—XII of FIG. 22. Still further, FIG. 26A is a detailed side view of the tail edge side shaft 12, and FIG. 26B is a detailed side view of the shaft 14.

Further, FIG. 27 is a side view looking in the direction of an arrow S2 of FIG. 22, and FIG. 28 is a perspective view of the tail edge side shaft 12, the stud 47 and the coupler 48 in detail. Still further, FIG. 29A, FIG. 29B, FIG. 29C, FIG. 29D, FIG. 30A, FIG. 30B, FIG. 30C, FIG. 30D are views showing conditions of the plate cylinder 60 in this embodiment. FIG. 29A, FIG. 29C, FIG. 30A and FIG. 30C are sectional side elevations, and FIG. 29B, FIG. 29D, FIG. 30B and FIG. 30D are side views.

In the first embodiment, the tail edge side part 10*b* of the plate 10 is clamped by closing the tail edge side clamp 5 with the pushing force generated by the block 11 pushed up with the tail edge side shaft 7 as a result of rotation thereof (see FIG. 8C, FIG. 9A). The tail edge side part 10*b* of the plate 10 is pulled in the plate tensioning direction by moving the spring base 8, tail edge side clamping base 3, the block 11 and the tail edge side clamp 5 in the direction of the arrow 90 as a unit as a result of rotating the tail edge side shaft 7 (see FIG. 9A, FIG. 9C).

In the meantime, it is preferred to fit the plate 10 onto the cylinder surface of the plate cylinder 60 as tight as possible. In order to do so, the tail edge side part 10*b* of the plate 10 needs to be clamped between the tail edge side clamping base 3 and the tail edge side clamp 5 as firmly as possible.

The tail edge side part 10*b* of the plate 10 can be clamped firmly by closing the tail edge side clamp 5 to the tail edge side clamping base 3 hardly when the block 11 is pushed up strongly with the tail edge side shaft 7 (see FIG. 9A). However, there is a probability that the plate 10 can not be pulled strong enough in the procedures carried out during the conditions shown in FIG. 9A to FIG. 9C.

Although, the block 11 supported by the tail edge side clamping base 3 is moved in the direction of the arrow 90 together with the tail edge side clamping base 3 during the fitting of the plate 10, the position of the rotation axis of the tail edge side shaft 7 is unchanged to the plate cylinder 60 because the tail edge side shaft 7 is supported to thereto. In this manner, the block supported by the tail edge side clamping base 3 is slidably moved on the circumferential surface 7*a* of the tail edge side shaft 7 shown in FIG. 4B in the direction of the arrow 90.

In this case, the tail edge side clamping base 3 can not be moved smoothly in the direction of the arrow 90 because of higher friction caused between the tail edge side shaft 7 and the block 11 when the block 11 is pushed up strongly with the tail edge side shaft 7. As a result, the plate 10 can not be pulled strongly enough. Also, much force is required in order to rotate the tail edge side shaft 7 from the condition shown in FIG. 9A to the condition FIG. 9C because of the higher friction caused between the tail edge side shaft 7 and the block 11.

In order to pull the plate 10 strongly, it is preferable to push up the block 11 with less force. On the other hand, the tail edge side part 10*b* of the plate 10 can not be clamped firmly between the tail edge side clamping base 3 and the tail edge side clamp 5.

In the fourth embodiment described above, the friction caused between the tail edge side clamp 5 and the block 203 is reduced by providing the roller 206 to the block 203 (see FIG. 13, FIG. 14 and FIG. 15). However, reduction of the friction by providing the roller 206 has a certain limit, so that the plate 10 can not be pulled strongly with certain reliability.

Further, in the fifth embodiment described above, the friction caused between the tail edge side shaft 211 and the block 214 is reduced by providing the roller 216 to the block 214 (see FIG. 16, FIG. 17A, FIG. 17B, FIG. 18, FIG. 19, FIG. 20, FIG. 21A and FIG. 21B). However, reduction of the friction by providing the roller 216 also has a certain limit, so that the plate 10 can not be pulled strongly as well as unfirm clamping by the tail edge side clamp 5.

In this embodiment, a tail edge side shaft 12 and a pulling shaft 14 are provided instead of the tail edge side shaft 7 used in the first and the fourth embodiment and the tail edge side shaft 211 used in the fifth embodiment in order to secure firm clamping and strong pulling of the plate 10.

In other words, both a rotating shaft such as the tail edge side shaft 12 which is used for closing the tail edge side clamp 5 and another rotating shaft such as the pulling shaft 14 which is used for moving the tail edge side clamp 5 in the direction of the arrow 90 are provided independently. Also, the tall edge side shaft 12 can be moved in the directions of the arrow 90 and the arrow 91 together with a tail edge side clamping base 53 and the tail edge side clamp 5 as a unit utilizing the structure shown in FIG. 28 in this embodiment.

In this way, the plate 10 can be fitted onto the cylinder surface of the plate cylinder 60 by strongly pulling the tail edge side clamping base 53 and the tail edge side clamp 5 in the direction of the arrow 90 with clamping the tail edge side part 10*b* of the plate 10 firmly by hard closing of the tail edge side clamp 5 to the tail edge side clamping base 53. The remaining structures are remained almost the same as the first embodiment. Details of the apparatus for driving a clamping device for fixing a plate on the plate cylinder of a printing machine in accordance with the present invention will be described hereunder.

The leading edge side clamping base 2 and the tail edge side clamping base 53 are provided in the cutout part 61. A leading edge side clamp 4 is provided at a position above the leading edge side clamping base 2, and leading edge side clamp 4 can be rotated in the directions of the arrow 101 and the arrow 102 by rotating about the leading edge supporting bolt 4J (see FIG. 23).

Further, the leading edge side clamp 4 has a rear end 4K, and the rear end 4K is in contact with the leading edge side shaft 6. The structure and the functions of the leading edge side clamp 4 and the leading edge side shaft 6 are the same as those described in the first embodiment. The leading edge side shaft 6 forms a first shaft in this embodiment, and an axis which pass through the center point P1 described in the first embodiment forming a central rotation axis in this embodiment.

Each of the leading edge side clamping base 2 and the leading edge side clamp 4 forms the first clamping base and the first clamping plate respectively in this embodiment. Further, a space formed between the leading edge side clamping base 2 and the leading edge side clamp 4 forms the first space in this embodiment. Further, both the leading edge side clamping base 2 and the leading edge side clamp 4 form the first clamping part in this embodiment.

The tail edge side clamp 5 is provided at a position above the tail edge side clamping base 53, and the tail edge side part 10*b* forming the second end or the end of the plate 10 disposed on the cylinder surface of the plate cylinder 60 is clamped between the tail edge side clamping base 53 and the tail edge side clamp 5. The tail edge side clamp 5 is urged in the direction of the arrow 102. In this manner, the tail edge side part 10*b* of the plate 10 is released by opening the tail edge side clamp 5 in the direction of the arrow 102.

As shown in FIG. 25, the pressure plate 220 is fixed on the bottom of the cut-out part 61 with the screw bolt 225. The pressure plate 220 is used for preventing raising of the tail edge side clamping base 3 in the upward direction. The tail edge side clamping base 53 and the tail edge side clamp 5 are moved in the directions of the arrow 90 and the arrow 91 along with the pressure plate 220.

The tail edge side clamping base 53 forms the second clamping base, or a clamping base in this embodiment, and the tail edge side clamp 5 forms the second clamping plate, or a clamping plate in this embodiment. Further, the space formed between the leading edge side clamping base 2 and the leading edge side clamp 4 forms the second space, or the space in this embodiment. Further, both the tail edge side clamping base 53 and the tail edge side clamp 5 form the second clamping part, or the clamping part in this embodiment.

A pair of coil springs 13 are located between the leading edge side clamping base 2 and the tail edge side clamping base 53 (see FIG. 22). The leading edge side clamping base 2 is pushed in the direction of the arrow 90, and the tail edge side clamping base 53 is pushed in the direction of the arrow 91 by the coil springs 13 respectively.

As shown in FIG. 23, the tail edge side clamp 5 has a rear end 5K, and the rear end 5K extends to the inside of the cut-out part 61. Also, the rear end 5K is in contact with the tail edge side shaft 12 as shown in FIG. 23. The tail edge side shaft 12 forms a second shaft, or the shaft for opening and closing movements in this embodiment.

Details of the tail edge side shaft 12 will be described herein with reference to FIG. 26A illustrating a side view thereof. A circumferential surface 12*a* having an equal radius L4 from a center point P4 is formed on the tail edge side shaft 12. Further, a flat surface 12*b* is also formed on the tail edge side shaft 12. The length between the flat surface 12*b* and the center point P4 is less than that of the radius L4.

An axis which passes through the center point P4 forms the central rotation axis in this embodiment. Further, the flat surface 12*b* and the circumferential surface 12*a* form the region for opening movement and the region for closing movement respectively in this embodiment.

The tail edge side clamp 5 is closed in the direction of the arrow 101 by rotating about the tail edge supporting bolt 5J shown in FIG. 24 with a force applied to the rear end 5K when the circumferential surface 12*a* is in contact with the rear end 5K of the tail edge side clamp 5. On the other hand, the tail edge side clamp 5 is opened in the direction of the arrow 102 by releasing the force applied to the rear end 5K with the circumferential surface 12*a* when the flat surface 12*b* is in contact with the rear end 5K of the tail edge side clamp 5.

The tail edge side shaft 12 is rotatably supported in the tail edge side clamping base 53, so that the tail edge side shaft 12 is moved together with the tail edge side clamping base 53 as a unit in the directions of the arrow 90 and the arrow 91. As shown in FIG. 28, the tail edge side shaft 12 is connected to the stud 47 through the coupler 48. The stud 47 is supported to the side faces of the plate cylinder 60 in a penetrated fashion so as to be rotatable.

The tail edge side shaft 12 has a groove for coupling, and the coupler 48 is equipped with a flange and a groove for coupling. The flange is formed for engaging the coupler 48 with the tail edge side shaft 12. Also, the stud 47 has a flange which is engaged with the groove of the coupler 48. The engagement maintained between the flange of the stud 47 and the groove of the coupler 48, and that maintained between the flange of the coupler 48 and the groove of the tail edge side shaft 12 are crossed with each other looking at a position on the stud 47. By employing the structure described above so called Oldham's coupling, the rotation of the stud 47 is conveyed to the tail edge side shaft 12 reliably even when a rotation axis of the tail edge side shaft 12 and that of the stud 47 do[es] not coincide with each other.

A spring base 17 is located at a position beneath the tail edge side clamping base 53. A plurality of coil springs 19 are provided in the spring base 17 as shown in FIG. 23, and the spring base 17 is pushed in the direction of the arrow 90. The coil springs 19 are arranged in a spaced fashion along the cylinder shaft 60J of the plate cylinder 60.

The pulling shaft 14 is positioned into the spring base 17 in a penetrated fashion. The pulling shaft 14 is rotatably supported to side faces of the plate cylinder 60. Details of the pulling shaft 14 will be described with reference to FIG. 26B illustrating a side view thereof. A circumferential surface 14*a* having an equal radius L5 from a center point P5 is formed on the pulling shaft 14. Further, a flat surface 14*b* is also formed on the pulling shaft 14. The length between the flat surface 14*b* and the center point P5 is less than that of the radius L5.

The pulling shaft 14 forms a movement restricting shaft, or the shaft for movement in this embodiment. An axis which passes through the center point P5 forms the central rotation axis in this embodiment. Further, the flat surface 14*b* forms the region for allowing movement, and the circumference surface 14*a* forms the region for restricting movement in this embodiment. The spring base 17 is moved in the direction of the arrow 90 with the pushing force of the coil springs 19 when the flat surface 14*b* of the pulling shaft 14 is in contact with a contact wall 17W of the spring base 17 (see FIG. 23). On the contrary, the spring base 17 is moved in the direction of the arrow 91 as a result of pushing the contact wall 17W with the circumferential surface 14*a* when the circumferential surface 14*a* of the pulling shaft 14 is in contact with the contact wall 17W of the spring base 17 by the rotation of the pulling shaft 14 about the center point P5.

A flange part 53T is formed on the bottom of the tail edge side clamping base 53 as shown in FIG. 23, and the flange part 53T is in contact with a side wall of the spring base 17. The flange part 53T is pushed with the spring base 17 which is moved by the spring force of the coil springs 19, thereby the tail edge clamping base 53 and the tail edge side clamp 5 are pushed in the direction of the arrow 90 as a unit.

The spring base 17, the coil springs 19 and the pulling shaft 14 all of which are used for moving both the tail edge side clamping base 53 and the tail edge side clamp 5 in the direction of the arrow 90 and the arrow 91 form the movement control part in this embodiment. The direction of the arrow 90 corresponds to the plate tensioning direction for fixing the plate 10 on the surface of the plate cylinder 60, and the direction of the arrow 91 corresponds to the plate loosening direction for loosening the plate 10 on the surface of the plate cylinder 60. Further, the pulling shaft 14 forms the movement restricting shaft in this embodiment.

An end of the pulling shaft 14 is protruded beyond the side face of the plate cylinder 60, and a gear 41 is connected to a part of the pulling shaft 14 thus protruded via a key 39*b*. Also, a gear stand 44 is connected to the part of the pulling shaft 14 thus protruded.

In addition, a stud 47 connected to the tail edge side shaft 12 through the coupler 48 as shown in FIG. 28 is fixed to a tail edge side gear 42 through the key 39*a*. The tail edge side gear 42 is located at a position outside of the side face of the plate cylinder 60, and the tail edge side gear 42 is engaged with the gear 41. Further, the leading edge side gear stud 29 is connected to the leading edge side shaft 6 through a joint. The leading edge side gear stud 29 is located at a position outside of the side face of the plate cylinder 60, and the leading edge side gear 22 is connected to the leading edge side gear stud 29 thorough the key 36*b*. The leading edge side gear 22 is engaged with the tail edge side gear 42.

Further, the leading edge side gear 22 is engaged with the first lever driving gear 23 located at a position outside of the side face of the plate cylinder 60. The first lever driving gear 23 is connected to the first lever driving gear stud 30 through the key 35*b*. Also, the first lever 26 is fixed to the first lever driving gear stud 30 with the screw 38*a*. Further, the roller 33 forming the part to be contacted is connected to an end of the first lever 26.

As shown in FIG. 27, the roller 33 is rotated about the cylinder shaft 60J when the plate cylinder 60 is rotated. This is because the roller 33 is located at a position beside the leading edge side clamping base 2 provided adjacent to the plate surface of the plate cylinder 60, whereby the roller 33 is positioned at a position far from the shaft 60J and parallel thereto.

The idler gear 24 which is located at a position outside of the side face of the plate cylinder 60 is also engaged with the first lever driving gear 23. The idler gear 24 is fixed to the idler gear stud 31 thorough the key 35*c*. Further, the idler gear 24 is engaged with the second lever driving gear 25 located at a position outside of the side face of the plate cylinder 60.

The second lever driving gear 25 is fixed to the second lever driving gear stud 32 through the key 35d. The second lever 27 is fixed to the second lever driving gear stud 32 via the screw 38*b*.

The roller 34 is connected to an end of the second lever 27. As shown in FIG. 5, the roller 34 is rotated about the cylinder shaft 60J in the rotated direction of the plate cylinder 60 when the plate cylinder 60 is rotated. This is because the roller 34 is located at a position adjacent to the plate surface of the plate cylinder 60, whereby the roller 34 is positioned at a position far from the shaft 60J and parallel thereto.

The gear 41, the tail edge side gear 42, the leading edge side gear 22, the first lever driving gear 23, the idler gear 24 and second lever driving gear 25 all of which are used for interlocking the movement of the leading edge side clamp 4, the tail edge side clamp 5 and the tail edge side clamping base 53 form the interlocking part in this embodiment.

The second air cylinder 46 described in the first embodiment (see FIG. 5 and FIG. 7) is also provided as the driving part in this embodiment. The structures and the functions of the second air cylinder 46 are the same as those described in the first embodiment. In this manner, the pushing shaft 46T forming the contact part is extendedly and contractedly moved in directions of the arrow 92 and the arrow 93 as shown in FIG. 5 and FIG. 7 under the control of the second air cylinder 46 in accordance with the signals inputted therein.

The pushing shaft 46T reaches a position on the track formed by rotation of the roller 34 connected to the second lever 27 which is rotated together with the rotation of the plate cylinder 60 when the pushing shaft 46T is moved extendedly in the direction of the arrow 92. On the other hand, the pushing shaft 46T is out from the track formed by rotation of the roller 34 when the pushing shaft 46T is moved contractedly in the direction of the arrow 93.

Further, the first air cylinder 40 described in the first embodiment is also provided as the driving part in this embodiment (see FIG. 6). The structure of the first air cylinder 40 is identical with that of the first air cylinder 40 used in the first embodiment. The roller shaft 40T also forming the contact part is moved extendedly and contractedly in directions of the arrow 94 and the arrow 95 under the control of the first air cylinder 40 in accordance with signals inputted therein.

The roller shaft 40T reaches a position on a track formed by rotation of the roller 33 connected to the first lever 26 which is rotated together with the rotation of the plate cylinder 60 when the roller shaft 40T is moved extendedly in the direction of the arrow 94. On the other hand, the roller shaft 40T is out from the track formed by rotation of the roller 33 when the roller shaft 40T is moved contractedly in the direction of the arrow 95.

Next, the movement and conditions of the plate cylinder 60 and the apparatus for driving a clamping device will be described herein with reference to FIG. 29A, FIG. 29B, FIG. 29C, FIG. 29D, FIG. 30A, FIG. 30B, FIG. 30C, and FIG. 30D.

In order to fix the plate 10 on the plate cylinder 60, the plate cylinder 60 is rotated about the cylinder shaft 60J, and the rotation is suspended at a predetermined position. The predetermined position is referred to as the plate clamping position. FIG. 29A and FIG. 29B show a condition of the plate cylinder 60 at that time.

The cut-out part 61 is illustrated so as to locate on the upper part of the plate cylinder 60 regardless of a degree of the rotation of the plate cylinder 60 in the FIG. 29A, FIG. 29B, FIG. 29C, FIG. 29D, FIG. 30A, FIG. 30B, FIG. 30C and FIG. 30D for a reason of convenience for description.

In the conditions shown in FIG. 29A and FIG. 29B, the roller 34 connected to the second lever 27 is located at a position adjacent to the pushing shaft 46T of the second air cylinder 46, and capable of being contacted with the pushing shaft 46. The roller 34 also forms the part to be contacted in this embodiment. In other words, the plate clamping position is a position that the roller 34 can be in contact with the pushing shaft 46T by the rotation of the plate cylinder 60 in the direction of the arrow 101.

The leading edge side part 10*a* of the plate 10 is inserted between the leading edge side clamping base 2 and the leading edge side clamp 4 after suspending the rotation of the plate cylinder 60 at the plate clamping position. The pushing shaft 46T is moved extendedly to the direction of the arrow 92 by driving the second air cylinder 46 described in the first embodiment at the plate clamping position. As described earlier, the roller 34 is pushed by the pushing shaft 46T thus moved in the direction because the roller 34 is located at the position capable of being contacted with the pushing shaft 46T.

The second lever driving gear stud 32 is rotated in the direction of the arrow 102 by the movement of the second lever 27 connecting the roller 34 thus pushed (see FIG. 8B and FIG. 8D). The rotation of the second lever driving gear stud 32 is conveyed to the second lever driving gear 25 because the second lever driving gear 25 is fixed to the second lever driving gear stud 32. As a result, the second lever driving gear 25 is rotated in the direction of the arrow 102 when the second lever driving gear stud 32 is rotated.

As described earlier, each of the second lever driving gear 25, the idler gear 24, the first lever driving gear 23, the leading edge side gear 22, the tail edge side gear 42 and the gear 41 is engaged with adjacent gears. Thus, all the gears are rotated together with others because the rotation of the second lever driving gear 25 is conveyed to all the gears.

FIG. 29C and FIG. 29D are views showing a condition of the gears being rotated by the movement of the pushing shaft 46T of the second air cylinder 46. As shown in FIG. 29C, the leading edge side gear 22 is rotated in the direction of the arrow 101 from the condition shown in FIG. 29A because the leading edge side gear 22 is connected to the leading edge side shaft 6. Hence, the leading edge side clamp 4 is closed in the direction of the arrow 102 by rotating about the leading edge supporting bolt 4J as a result of pushing the rear end 4K of the leading edge side clamp 4 with the circumferential surface 6*a* of the leading edge side shaft 6.

The leading edge side part 10*a* of the plate 10 is clamped between the leading edge side clamping base 2 and the leading edge side clamp 4 by closing the leading edge side clamp 4 in the direction. At that time, the tail edge side gear 42 and the gear 41 are also rotated in the direction of the arrow 102 in accordance with the rotation of other gears generated by the movement of the pushing shaft 46T described in the first embodiment (see FIG. 29A and FIG. 29C).

However, the flat surface 12*b* of the tail edge side shaft 12 is in contact with the rear end 5K of the tail edge side clamp 5 in the condition shown in FIG. 29A. The rear end 5K of the tail edge side clamp 5 is still in contact with the flat surface 12*b* even when the tail edge side shaft 12 is rotated as a result of rotating the tail edge side gear 42 to a position shown in FIG. 29D from the position of that shown in FIG. 29B. In this way, the tail edge side clamp 5 remains a condition of open to the tail edge side clamping base 53.

Further, the circumference surface 14*a* of the pulling shaft 14 is in contact with the contact wall 17W of the spring base 17 in the condition shown in FIG. 29A. Thereafter, the gear 41 is rotated in the condition shown in FIG. 29D from the condition shown in FIG. 29B. Therefore, the circumference surface 14*a* of the pulling shaft 14 is in contact with the contact wall 17W of the spring base 17 even when the pulling shaft 14 is rotated.

The position of the spring base 17 is unchanged even when the pulling shaft 14 is rotated to a position shown in FIG. 29C from the position of that shown in FIG. 29A because the circumferential surface 14*a* having an equal radius L5 from the center point P5 is formed on the pulling shaft 7 (see FIG. 26B). Therefore, the movement of the spring base 17 which is pushed in the direction of the arrow 90 with the coil springs 19 (see FIG. 23) is suspended by the circumferential surface 14*a* of the pulling shaft 14. Consequently, the position of the spring base 17 is unchanged.

The pushing shaft 46T of the second air cylinder 46 described in the first embodiment is moved contractedly in the direction of the arrow 93 immediately after pushing the roller 34 connected to the second lever 27. Thereafter, the plate 10 is pushed to the cylinder surface of the plate cylinder 60 by the plate pushing roller (not shown) being moved along with the cylinder surface of the plate cylinder 60. The plate pushing roller is located at a position adjacent to the cylinder surface. Then the plate cylinder 60 is rotated about the cylinder shaft 60J in the direction the arrow 101 with pushing the plate 10 by the plate pushing roller.

The plate 10 is disposed onto the cylinder surface of the plate cylinder 60 with pushing force of the plate pushing roller by the rotation of the plate cylinder 60. None of the gear 41, the tail edge side gear 42, the leading edge side gear 22, the first lever driving gear 23, the idler gear 24 and the second lever driving gear 25 are rotated together with the plate cylinder 60, and the leading edge side clamp 4, the tail edge side clamping base 53 and tail edge side clamp 5 maintain the positions shown in FIG. 29C during the rotation of the plate cylinder 60.

The rotation of the plate cylinder 60 is suspended when the plate 10 is disposed on the cylinder surface almost completely. The tail edge side part 10*b* of the plate 10 is inserted between the tail edge side clamping base 3 and the tail edge side clamp 5. After the insertion of the tail edge side part 10*b*, the plate cylinder 60 is rotated again in the direction of the arrow 101, and the roller shaft 40T of the first air cylinder 40 described in the first embodiment is moved extendedly in the direction of the arrow 94. The first air cylinder 40 maintains the position of the roller shaft 40T.

As described earlier, the roller shaft 40T reaches the position on the track formed by the rotation of the roller 33 connected to the first lever 26 when the roller shaft 40T is moved extendedly in the direction of the arrow 94. The roller 33 is pushed by the roller shaft 40T in accordance with the rotation of the plate cylinder 60 as a result of contacting the roller shaft 40T with a first point of action 33*a* of the roller 33 because the first air cylinder 40 is rigidly fixed to the frame 18 of the printing machine.

The first lever driving gear stud 30 is rotated in the direction of the arrow 102 by the movement of the first lever 26 connecting the roller 33 thus pushed. The rotation of the first lever driving gear stud 30 is conveyed to the first lever driving gear 23 because the first lever driving gear 23 is fixed to the first lever driving gear stud 30. As a result, the first lever driving gear 23 is rotated in the direction of the arrow 102 when the first lever driving gear stud 30 is rotated. As described earlier, each of the second lever driving gear 25, the idler gear 24, the first lever driving gear 23, the leading edge side gear 22, the tail edge side gear 42 and the gear 41 is engaged with adjacent gears. Thus, all the gears are rotated together with others because the rotation of the first lever driving gear 23 is conveyed to all the gears.

FIG. 30A and FIG. 30B are views showing a condition of the gears being rotated by the movement of the roller shaft 40T of the first air cylinder 40 described in the first embodiment. As shown in FIG. 30A, the tail edge side shaft 12 is rotated in the direction of the arrow 102 from the condition shown in FIG. 29C because the tail edge side gear 42 is connected to the tail edge side shaft 12. In this manner, the tail edge side clamp 5 is closed in the direction of the arrow 101 by rotating about the tail edge supporting bolt 5J shown in FIG. 24 by contacting the circumference surface 12*a* of the tail edge side shaft 12 shown in FIG. 26A with the rear end 5K of the tail edge side clamp 5.

Throughout the first embodiment to the fifth embodiment, the tail edge side clamp 5 is closed by pushing up the rear end 5K positioned adjacent to a point for rotation which is equivalent to the tail edge supporting bolt 5J with the block 11, the block 203 or the block 214. The tail edge side clamp 5 is closed by pushing the rear end 5K extending to the inside of the cut-out part 61 with the circumference surface 12*a* of the tail edge side shaft 12 in this embodiment.

In this way, it is possible to close the tail edge side clamp 5 reliably by applying the pushing force to an end of the rear end 5K efficiently. This is because the rear end 5K of the tail edge side clamp 5 located far from the point for rotation equivalent to the tail edge supporting bolt 5J is pushed by the circumference surface 12*a* of the tail edge side shaft 12. So that, the rear end 5K is pushed by utilizing the principles of the lever and fulcrum.

The tail edge side part 10*b* of the plate 10 is clamped between the tail edge side clamping base 53 and the tail edge side clamp 5 by closing the tall edge side clamp 5. At that time, a part of the plate 10 located at vicinity of the tail edge side part 10*b* is not tightly fitted onto the cylinder surface of the plate cylinder 60, so that looseness of the plate 10 is observed in the part of the plate 10. The circumference surface 14*a* of the pulling shaft 14 shown in FIG. 26B is in contact with the side wall of the spring base 8 in the condition shown in FIG. 30A and FIG. 30B. Therefore, the movement of the spring base 17 and the tail edge side clamping base 53 in the direction of the arrow 90 is flat surface 14*a* of the pulling shaft 14. Consequently, the position of the spring base 17 and the tail edge side clamping base 53 is unchanged.

The leading edge side gear 22 is also rotated in the direction of the arrow 101 by the rotation of the first lever driving gear 23 caused by the movement of the roller shaft 40T of the first air cylinder 40 described in the first embodiment (see FIG. 29B and FIG. 30A). However, as described in the first embodiment, the rear end 4K of the leading edge side clamp 4 is in contact with the circumferential surface 6*a* having the equal radius L1 from the center point P1 as shown in FIG. 4A.

Therefore, the leading edge side part 10*a* of the plate 10 is clamped between the leading edge side clamping base 2 and the leading edge side clamp 4 with a certain clamping force regardless of the degree of the plate cylinder 60 because the leading edge side shaft 6 still maintains its pushing force to the rear end 4K of the leading edge side clamp 4.

The plate cylinder 60 is further rotated from the condition shown in the FIG. 30A and FIG. 30B, thereby the roller 33 being in contact with the first point of action 33*a* of the roller 33 is pushed by the roller shaft 40T of the first air cylinder 40. As a result, the pulling shaft 14 connected to the gear 41 is further rotated in the direction of the arrow 101.

In this embodiment, two separate shafts such as the tail edge side shaft 12 for closing the tail edge side clamp 5 and the pulling shaft 14 for moving the tail edge side clamping base 53 in the direction of the arrow 101 are used.

In this manner, the pulling shaft 14 can be rotated smoothly from the condition shown in FIG. 30A without any affection of the friction caused between the rear end 5K of the tall edge side clamp 5 and the tail edge side shaft 12. The flat surface 14*b* of the pulling shaft 14 shown in FIG. 26B is located at a position opposed to the contact wall 17W of the spring base 17 by the rotation of the pulling shaft 14. FIG. 30C and FIG. 30D are views showing the rotation of the pulling shafts 14.

The spring base 17 being pushed by the coil springs 19 is moved in the direction of the arrow 90 by releasing the restriction caused by the circumferential surface 14*a* as a result of opposing the flat surface 14*b* of the tail edge side shaft 14 to the contact wall 17W of the spring base 17. Both the tail edge side clamping base 53 and tail edge side clamp 5 are moved together with the spring base 17 in the direction of the arrow 90 because the flange part 53T formed on the bottom of the tail edge side clamping base 53 is pushed by the spring base 17 in that direction.

Therefore, the tail edge side part 10*b* of the plate 10 is pulled in the direction of the arrow 90, thereby the plate 10 is fitted tightly onto the cylinder surface of the plate cylinder 60. In order to apply sufficient tension to the plate 10 for tightening thereof, both the spring base 17 and the tail edge side shaft 14 are provided so as not to contact the contact wall 17W with the flat surface 14*b* in the condition shown in FIG. 30C.

The tail edge side shaft 12 supported in the tail edge side clamping base 53 is moved in the direction of the arrow 90 together with the tail edge side clamping base 53 and tail edge side clamp 5 as a unit when both the tail edge side clamping base 53 and tail edge side clamp 5 are moved in that direction. As described above, the contact between the tail edge side shaft 12 and the stud 47 is maintained by the coupler 48 even when the tail edge side shaft 12 is moved in the direction of the arrow 90 together with the spring base 17, the tall edge side clamping base 53 and the tail edge side clamp 5 as a unit. In addition, the tail edge side shaft 12 is moved in the direction of the arrow 90 with maintaining its rotation angle to the tail edge side clamping base 53.

Therefore, the tail edge side clamp 5 keeps the position to the tail edge side clamping base 53 so as to clamp the tail edge side part 10*b* even when the tail edge side shaft 12 is moved in the direction of the arrow 90 together with the spring base 17, the tail edge side clamping base 53 and the tail edge side clamp 5. In this way, the tail edge side part 10*b* of the plate 10 can be pulled hardly with clamping the tail edge side part 10*b* firmly by the tail edge side clamp 5.

The roller shaft 40T is moved contractedly in the direction of the arrow 95 after tightening the plate 10 onto the cylinder surface of the plate cylinder 60. At that time, the plate pushing roller described earlier is detached from the cylinder surface. Printing work will be started after tensioning the plate 10.

Upon completion of the printing work, the plate 10 is ejected from the plate cylinder 60. In order to eject the plate 10 from the plate cylinder 60, the plate cylinder 60 is rotated in the direction of the arrow 101 from the position shown in FIG. 30C and FIG. 30D both of which illustrate[ing] the condition of tightening the plate 10 onto the cylinder surface, and the roller shaft 40T of the first air cylinder 40 is moved extendedly in the direction of the arrow 94.

The rotation of the plate cylinder 60 is suspended when the plate cylinder 60 is moved slightly in the direction of the arrow 101. As a result of the rotation, the roller shaft 40T of the first air cylinder 40 is located at a position adjacent to the second point of action 33*b* of the roller 33.

The plate cylinder 60 is rotated in the direction of the arrow 102 opposite to the rotating direction for tightening the plate 10 onto the cylinder surface. In this way, the roller shaft 40T of the first air cylinder 40 is in contact with the second point of action 33*b* of the roller 33. The first lever 26 connecting the roller 33 is rotated in the direction of the arrow 101 by maintaining the contact between the roller shaft 40T and the second point of action 33*b* during the rotation of the plate cylinder 60. The plate 10 is ejected from the plate cylinder 60 by performing the procedures described above in the reversed order as a result of rotating the first lever 26 in the direction of the arrow 101.

In other words, the contact wall 17W of the spring base 17 is moved in the direction of the arrow 91 as a result of contacting the circumferential surface 14*a* the pulling shaft 14 with the contact wall 17W of the spring base 17 by the rotation of the pulling shaft 14 in the direction of the arrow 102. Therefore, the plate 10 is loosened from the cylinder surface of the plate cylinder 60 (see FIG. 30A and FIG. 30B). The tail edge side clamp is opened by contacting the flat surface 12*b* of the tail edge side shaft 12 with the rear end 5K of the tail edge side clamp 5 as a result of continuous rotation of the first lever 26 in the direction of the arrow 101 as shown in FIG. 29C and FIG. 29D. Further, the leading edge side clamp 4 is opened by plunging the rear end 4K of the leading edge side clamp 4 into the circumferential surface 6*a* of the leading edge side shaft 6 as a result of rotating the leading edge side shaft 6 in the direction of the arrow 102 continuously. Thus, the plate 10 is ejected from the plate cylinder 60. The second air cylinder 46 described in the first embodiment is not used in the procedures for ejecting the plate 10.

As described above, two separate shafts such as the tail edge side shaft 12 for closing the tail edge side clamp 5 and the pulling shaft 14 for moving the tall edge side clamping base 53 in the direction of the arrow 101 are used in this embodiment. In addition, the pulling shaft 12 is also moved in the direction of the arrow 90 together with the tall edge side clamp 5 and the tail edge side clamping base 53. Therefore, the plate 10 can be fixed tightly onto the cylinder surface of the plate cylinder 60 by clamping the tail edge side part 10*b* of the plate 10 with the tail edge side clamp 5 firmly as a result of closing the tail edge side clamp 5 hard[ly] to the tail edge side clamping base 53 with pulling both the tail edge side clamp 5 and the tail edge side clamping base 53 smoothly in the direction of the arrow 90.

(7) Other Embodiments

The apparatus for driving a clamping device in accordance with the present invention is not limited to the embodiments described above, any other structure(s) can be employed as long as control for opening and closing movements of the first space formed on the first clamping part, control for opening and closing movements of the second space formed on the second clamping part, and control for moving the second clamping part either in a plate tensioning direction or in a plate loosening direction carried out by the movement control part is performed in accordance with rotation of the plate cylinder.

For instance, both the leading edge side clamping base 2 and the leading edge side clamp 4 forming the first clamping part, and the tail edge side clamping base 3, the tail edge side clamping base 53 and the tail edge side clamp 5 introduced as the second clamping part, or the clamping part are used in the embodiments described above. Any other structure(s) capable of clamping the first end and the second end of the plate can be used for the first clamping part, the second clamping part, or the clamping part.

Also, the tail edge side shaft 7, the spring base 8, the coil springs 9 and tail edge side shaft 211, the pulling shaft 14, the spring base 17 and the coil springs 19 are used as the movement control part in the embodiments described above. Any other structure(s) can be employed for the movement control part as long as it is capable of controlling the movement of the second clamping part in a plate tensioning direction for fixing the plate on the surface of the plate cylinder or in a plate loosening direction for loosening the plate on the surface of the plate cylinder.

The gear 41, the tail edge side gear 42, the tail edge side gear 21, the leading edge side gear 22, the first lever driving gear 23, the idler gear 24 and second lever driving gear 25, the chain 55, the tail edge side sprocket 56 the leading edge side sprocket 57 are used as the interlocking part in the embodiments described above. The number of the gears and the chain thus provided can be varied in either in larger numbers or smaller numbers. The structure of the interlocking part is not limited to use the gears and the chain(s), any other structures capable of interlocking the first clamping part, the second clamping part and the movement control part can be used for the interlocking part.

Further, both the first air cylinder 40 and the second air cylinder 46 are introduced as the driving part in the embodiments described above. Any other structures capable of moving the contact part to a position on the track formed by the part to be contacted or moving the contact part to a position out of the track formed by the part to be contacted can be used for the driving part. In addition, both the roller 33 and the roller 34, and both the roller shaft 40T and the pushing shaft 46T are used as the part to be contacted and the contact part respectively in the embodiments described above. The structure of the part to be contacted and the contact part are not limited to the embodiments described above, any other structures can be employed for the part to be contacted and/or the contact part.

The contact part of the driving part being mounted on the frame 18 of the printing machine is moved in extendedly and contractedly for pushing the part to be contacted in the embodiments described above. The part to be contacted can be provided movably in a direction approach to the contact part. So that, the part to be contacted thus moved is in contact with the contact part. In this manner, the contact part is in a position on the track formed by the part to be contacted or is in a position out of the track formed by the part to be contacted.

The leading edge side shaft 6 is introduced as the first shaft in the embodiments described above. Any other structures capable of controlling the first clamping part so as to open and close the first space in accordance with the rotation thereof can be used for the first shaft. Further, the tail edge side shaft 12 is used as the second shaft in the embodiments described above. Any other structures capable of controlling the second clamping part so as to open and close the second space in accordance with the rotation thereof can be used for the second shaft. In addition, the pulling shaft 14 is introduced as the movement restricting shaft in the embodiments described above. Any other structures capable of controlling the movement control part so as to move the second clamping part in the plate tensioning direction or the plate loosening direction can be used for the movement restricting shaft.

Still further, the tail edge side shaft 12 is also introduced as the shaft for opening and closing movements. Any other structures capable of closing the space formed between the clamping base and the clamping plate when the region for opening movement formed on the outer surface of the shaft for opening and closing movements is in contact with the clamping plate, and capable of closing the space formed between the clamping base and the clamping plate by pushing the clamping part with the shaft for opening and closing movements when the region for closing movement formed on the outer surface of the shaft is in contact with the clamping plate can be used for the shaft for opening and closing movements.

Yet further, the pulling shaft 14 is also used as the shaft for movement in the embodiments described above. Any other structure(s) capable of restricting the movement of the clamping part in the plate tensioning direction when the region for restricting movement formed on the outer surface of the shaft for movement is in contact with the clamping base, and capable of allowing the movement of the clamping part in the plate tensioning direction when the region for allowing movement formed on the outer surface of the shaft for movement is in contact with the clamping base can be used for the shaft for movement.

The apparatus for driving a clamping device in accordance with the present invention, control for opening and closing movements of the first space formed on the first clamping part, control for opening and closing movements of the second space formed on the second clamping part, and control for moving the second clamping part either in the plate tensioning direction or in the plate loosening direction carried out by the movement control part is performed in accordance with rotation of the plate cylinder.

In this manner, the control for opening and closing movements of the first space and the second space, and the control for moving the second clamping part either in the plate tensioning direction or in the plate loosening direction can be performed respectively in accordance with the rotation of the plate cylinder. Therefore, no additional motor or other source for driving the clamping parts is required separately from the driving part for rotating the plate cylinder. As a result, the printing machine can be made under lower profile, and manufacturing cost of the printing machine can be depreciated.

The apparatus for driving a clamping device in accordance with the present invention, the apparatus includes the interlocking part for directly or indirectly interlocking the first clamping part, the second clamping part and the movement control part with one another. And, the movement control for opening and closing movements of the first space formed on the first clamping part and the control for opening and closing movements of the second space formed on the second clamping part, and the control for moving the second clamping part either in the plate tensioning direction or in the plate loosening direction carried out by the movement control part are interlocked with one another through the interlocking part.

In this manner, the control for opening and closing movements of the first space and the second space as well as the control for moving the second clamping part either in the plate tensioning direction or in the plate loosening direction can be performed by applying a force to a part of the interlocking part. Thus, the printing machine can be made under lower profile because the controls can be performed by applying the force to just one part of the interlocking part. Further, the part of the interlocking s part being applied with the force can be set at any part which is easy to be moved.

Still further, the control for opening and closing movements of the first space and the second space, and the control for moving the second clamping part can be performed at a efficient timing because the control for opening and closing movements of the first space and the second space as well as the control for moving the second clamping part either in the plate tensioning direction or in the plate loosening direction are interlocked with one another. Consequently, work efficiency of the printing can be improved.

The apparatus for driving a clamping device in accordance with the present invention, the first space is opened and is closed by the first clamping part in accordance with rotation of the first shaft, and the second space is opened and is closed by the second clamping part in accordance with the rotation of the second shaft. And the movement control part is moved both in the plate tensioning direction and the plate loosening direction in accordance with rotation of the movement restricting shaft. And the first shaft, the second shaft and the movement restricting shaft are interlocked with one another through the interlocking part.

As described, the control for opening and closing movements of the first space and the second space, and the control for moving the second clamping part can be performed by rotating the first shaft, the second shaft and the movement restricting shaft through the interlocking part. Therefore, it is possible to make a printing machine having a simple structure which achieves a lower profile of the printing machine as well as a lower manufacturing cost with higher reliability.

Yet further, the first shaft, the second shaft and the movement restricting shaft are provided as independent shafts. In this manner, the control for opening and closing movements of the first space and the second space, and the control for moving the second clamping part can be performed by the first shaft, the second shaft and the movement restricting shaft respectively. Therefore, the control for opening and closing movements and the control for moving the second clamping part can be performed reliably.

The apparatus for driving a clamping device in accordance with the present invention, the second shaft is rotatably supported by the second clamping part, and is moved in the plate tensioning direction together with the second clamping part as one united body. The second shaft is moved in the plate tensioning direction together with the second clamping part as one united body with maintaining its rotation angle.

In this manner, the plate is fitted tightly onto the cylinder surface of the plate cylinder by moving the second clamping part clamping the second end of the plate as a result of closing the second space of the second clamping part in accordance with the second shaft in the plate tensioning direction. Therefore, the plate can be fitted tightly onto the cylinder surface of the plate cylinder by reliably clamping the second end of the plate.

Further, the apparatus for driving a clamping device in accordance with the present invention, the rotation of the plate cylinder is conveyed to the interlocking part by contacting the contact part with the part to be contacted when the plate cylinder is rotated. And the control for opening and closing movements of the first space formed on the first clamping part, the control for opening and closing movements of the second space formed on the second clamping part, and the control for moving the second clamping part in the plate tensioning direction or in the plate loosening direction carried out by the movement control part are performed respectively in accordance with the rotation of the plate cylinder thus conveyed to the interlocking part.

Thus, the control for opening and closing movements of the first space and the second space as well as the control for moving the second clamping part either in the plate tensioning direction or in the plate loosening direction can be performed reliably by using the rotation of the plate cylinder because the rotation of the plate cylinder is conveyed to the interlocking part by the contact between the contact part and the part to be contacted.

Still further, the apparatus for driving a clamping device in accordance with the present invention, the apparatus comprises the driving part for moving both the part to be contacted and the contact part or either of the part to be contacted or the contact part. And the driving part moves the contact part to a position on the track formed by the part to be contacted or moves the contact part to a position out of the track formed by the part to be contacted.

In this manner, the contact part can be moved contractedly to the position out of the track formed by the part to be contacted before starting the printing work after fixing the plate on the plate cylinder. Therefore, the printing work can be carried out smoothly because the contact part does not bother the rotation of the plate cylinder.

Yet further, the apparatus for driving a clamping device in accordance with the present invention, the interlocking part is used for carrying out following procedures when the plate is disposed on the plate cylinder. The first space formed on the first clamping part is closed, and the second space formed on the second clamping space is closed after elapsing of a predetermined duration from the closure of the first space. And the second clamping part is moved in the plate tensioning direction after elapsing of a predetermined duration from the closure of the second space under control of the movement control part.

In this manner, the plate is fitted tightly on the plate cylinder by moving the second clamping part in the plate tensioning direction after clamping the second end of the plate as a result of closing the second space upon disposing the plate on the cylinder surface of the plate cylinder after clamping the first end of the plate by closing the first space. Therefore, the plate can be disposed on the plate cylinder reliably.

The apparatus for driving a clamping device in accordance with the present invention, the space formed between the clamping base and the clamping plate is opened when the region for opening movement formed on the outer surface of the shaft for opening and closing movements is in contact with the clamping plate, and the space formed between the clamping base and the clamping plate is closed by pushing the clamping part with the shaft for opening and closing movements when the region for closing movement formed on the outer surface of the shaft is in contact with the clamping plate.

In this manner, either of the region for opening movement or the region for closing movement both of which being formed on the outer surface of the shaft for opening and closing movements can selectively be in contact with the clamping plate by rotating the shaft for opening and closing movements. Therefore, it is possible to make a printing machine having a simple structure, and capable of opening or closing the clamping part by a simple operation. The printing machine can achieve a lower profile as well as a lower manufacturing cost with higher reliability.

Further, the movement of the clamping part in the plate tensioning direction is restricted by the shaft for movement when the region for restricting movement formed on the outer surface of the shaft for movement is in contact with the clamping base. And the movement of the clamping part in the plate tensioning direction is allowed by the shaft for movement when the region for allowing movement formed on the outer surface of the shaft for movement is in contact with the clamping base.

In this manner, either of the region for restricting movement or the region for allowing movement both of which being formed on the outer surface of the shaft for movement can selectively be in contact with the clamping plate by rotating the shaft for movement. Therefore, it is possible to make a printing machine having a simple structure, and capable of restricting or allowing the movement of the clamping part in the plate tensioning direction by a simple operation. The printing machine can achieve a lower profile as well as a lower manufacturing cost with higher reliability.

While the invention has been described in its preferred embodiments, it is to be understood that the words which have been used are words of description rather than limitation and that changes within the purview of the appended claims may be made without departing from the true scope and spirit of the invention in its broader aspects.

What is claimed is:

1. An apparatus for driving a clamping device for fixing a printing plate on a plate cylinder of a printing machine comprising:

a first clamping part mounted on the plate cylinder and including a first clamping base and a first clamping plate, a first end of the printing plate inserted into a first space formed between the first clamping base and the first clamping plate being clamped by closing the first space, and the first end of the printing plate clamped in the first space being released by opening the first space, a second clamping part mounted on the plate cylinder and including a second clamping base and a second clamping plate, a second end of the printing plate inserted into a second space formed between the second clamping base and the second clamping plate being clamped by closing the second space, the printing plate being disposed around a surface of the plate cylinder, and the second end of the printing plate clamped in the second space being released by opening the second space, and a movement control part for controlling movement of the second clamping part in a plate tensioning direction for fixing the printing plate on the surface of the plate cylinder or in a plate loosening direction for loosening the printing plate on the surface of the plate cylinder, wherein control for opening and closing the first space formed on the first clamping part, control for opening and closing the second space formed on the second clamping part, and control for moving the second clamping part either in a plate tensioning direction or in a plate loosening direction carried out by the movement control part being performed during rotation of the plate cylinder; and further including an interlocking part provided on the plate cylinder, the interlocking part interlocking the first clamping part, the second clamping part and the movement control part, and the interlocking part including a part to be contacted;

wherein the apparatus further includes a contact part that is engageable with the part to be contacted upon rotation of the plate cylinder; and wherein at least the second clamping part and the movement control part are operated during rotation of the plate cylinder.

2. An apparatus for driving a clamping device for fixing a printing plate on a plate cylinder of a printing machine in accordance with claim 1, wherein the control for opening and closing the first space formed on the first clamping part and the control for opening and closing the second space formed on the second clamping part, and the control for moving the second clamping part either in the plate tensioning direction or in the plate loosening direction are interlocked with one another through the interlocking part.

3. An apparatus for driving a clamping device for fixing a plate on a printing plate cylinder of a printing machine in accordance with claim 2, wherein the interlocking part comprises a plurality of gears, and wherein each of the gears is engaged with adjacent gears.

4. An apparatus for driving a clamping device for fixing a printing plate on a plate cylinder of a printing machine in accordance with claim 2, wherein the interlocking part includes chains.

5. An apparatus for driving a clamping device for fixing a printing plate on a plate cylinder of a printing machine in accordance with claim 2, wherein a first shaft being rotated around its central rotation axis is connected to the first clamping part, and wherein the first space is opened and is closed by the first clamping part in accordance with rotation of the first shaft, and wherein a second shaft being rotated around its central rotation axis is connected to the second clamping part, and wherein the second space is opened and is closed by the second clamping part in accordance with rotation of the second shaft, and wherein the movement control part includes a movement restricting shaft which is rotatable around its central rotation axis, and wherein the movement control part is moved both in the plate tensioning direction and the plate loosening direction in accordance with rotation of the movement restricting shaft, and wherein the first shaft, the second shaft and the movement restricting shaft are provided as independent shafts, and wherein the first shaft, the second shaft and the movement restricting shaft are interlocked with one another through the interlocking part.

6. An apparatus for driving a clamping device for fixing a printing plate on a plate cylinder of a printing machine in accordance with claim 5, wherein the second shaft is rotatably supported by the second clamping part, and wherein the second shaft is moved in the plate tensioning direction together with the second clamping part as one united body while maintaining its rotation angle.

7. An apparatus for driving a clamping device for fixing a printing plate on a plate cylinder of a printing machine in accordance with claim 2, wherein the contact part is disposable on a track formed by rotation of the part to be contacted, and wherein the part to be contacted is rotatable around a cylinder shaft of the plate cylinder in accordance with the rotation of the plate cylinder, and wherein rotation of the plate cylinder is conveyable to the interlocking part by contacting the contact part with the part to be contacted when the plate cylinder is rotated.

8. An apparatus for driving a clamping device for fixing a printing plate on a plate cylinder of a printing machine in accordance with claim 7, wherein the apparatus further comprises a driving part for moving both the part to be contacted and the contact part or either of the part to be contacted or the contact part, and wherein the contact part is moveable by the driving part to a position on the track formed by the part to be contacted or moveable by the driving part to a position out of the track formed by the part to be contacted.

9. An apparatus for driving a clamping device for fixing a printing plate on a plate cylinder of a printing machine comprising:

a clamping part mounted on the plate cylinder being rotated around a cylinder shaft, the clamping part including a clamping base and a clamping plate, an end of the printing plate inserted into a space formed between the clamping base and the clamping plate being clamped by closing the space, the clamping part being pushed in a plate tensioning direction for fixing the printing plate on the plate cylinder, a shaft for opening and closing movements capable of contacting with the clamping plate, the shaft having both a region for opening movement and a region for closing movement formed on its outer surface being rotated around its central rotation axis, a shaft for movement capable of contacting with the clamping base, the shaft having both a region for restricting movement and a region for allowing movement formed on its outer surface being rotated around its central rotation axis, and an interlocking part for directly or indirectly interlocking the shaft for opening and closing movements with the shaft for movement and the clamping part, the interlocking part being provided on the plate cylinder so as to be rotatable therewith, wherein the space formed between the clamping base and the clamping plate is closed when the region for opening movement formed on the outer surface of the shaft for opening and closing movements is in contact with the clamping plate, the space formed between the clamping base and the clamping plate is closed by pushing the clamping part with the shaft for opening and closing movements when the region for closing movement formed on the outer surface of the shaft is in contact with the clamping plate, movement of the clamping part in the plate tensioning direction is restricted by the shaft for movement when the region for restricting movement formed on the outer surface of the shaft for movement is in contact with the clamping base, the movement of the clamping part in the plate tensioning direction is allowed by the shaft for movement when the region for allowing movement formed on the outer surface of the shaft for movement is in contact with the clamping base, and both the shaft for opening and closing movements and the shaft for movement are rotated by applying a rotating force of the plate cylinder to the interlocking part.

10. An apparatus for driving a clamping device for fixing a printing plate on a plate cylinder of a printing machine in accordance with claim 9, wherein the interlocking part includes chains.

11. An apparatus for driving a clamping device for fixing a plate on a printing plate cylinder of a printing machine in accordance with claim 9, wherein the interlocking part comprises a plurality of gears, and wherein each of the gears is engaged with adjacent gears.

* * * * *